US010760538B2

(12) United States Patent
Tiramani et al.

(10) Patent No.: US 10,760,538 B2
(45) Date of Patent: Sep. 1, 2020

(54) CUSTOMIZABLE ENGINE AIR INTAKE/EXHAUST SYSTEMS

(71) Applicant: 500 Group, Inc., Las Vegas, NV (US)

(72) Inventors: Paolo Tiramani, Las Vegas, NV (US); Kyle Denman, North Las Vegas, NV (US)

(73) Assignee: 500 Group, Inc., Las Vegas, NV (US)

( * ) Notice: Subject to any disclaimer, the term of this patent is extended or adjusted under 35 U.S.C. 154(b) by 117 days.

(21) Appl. No.: 16/168,984

(22) Filed: Oct. 24, 2018

(65) Prior Publication Data

US 2019/0128221 A1 May 2, 2019

Related U.S. Application Data

(60) Provisional application No. 62/697,072, filed on Jul. 12, 2018, provisional application No. 62/687,461, (Continued)

(51) Int. Cl.
*F02M 35/104* (2006.01)
*F01N 13/10* (2010.01)
*F02M 35/10* (2006.01)

(52) U.S. Cl.
CPC ..... *F02M 35/10091* (2013.01); *F01N 13/10* (2013.01); *F01N 13/107* (2013.01); (Continued)

(58) Field of Classification Search
CPC ..... F02M 35/10091; F02M 35/10242; F02M 35/104; F02M 2700/05; F01N 13/10; (Continued)

(56) References Cited

U.S. PATENT DOCUMENTS 4,444,012 A * 4/1984 Gauffres ..... F01N 3/2053 60/276
4,924,967 A 5/1990 Ike et al.
(Continued)

FOREIGN PATENT DOCUMENTS

CN 104279042 A 1/2015
WO 2016/195573 A1 12/2016

OTHER PUBLICATIONS

International Search Report and Written Opinion dated Mar. 29, 2019 for PCT application PCT/US2018/057228.
(Continued)

*Primary Examiner* — Jacob M Amick
(74) *Attorney, Agent, or Firm* — McCarter & English, LLP

(57) ABSTRACT

A multi-stage reconfigurable air intake and exhaust system for a piston engine having first and second rows of cylinders forming a V configuration. The system includes plural stage packages having inter-related components that can be connected and changed to form different air intake and exhaust gas configurations. There is particularly provided a Stage 1 package with first and second exhaust manifolds adapted to be respectively secured to the first and second rows of cylinders, and a Stage 2 package with a turbo exhaust manifold adapted for mounting a turbocharger, and also adapted to be secured to the first row of cylinders in lieu of the first exhaust manifold, and a crossover pipe assembly adapted for coupling the turbo exhaust manifold to the second exhaust manifold.

16 Claims, 38 Drawing Sheets

Related U.S. Application Data filed on Jun. 20, 2018, provisional application No. 62/678,460, filed on May 31, 2018, provisional application No. 62/616,601, filed on Jan. 12, 2018, provisional application No. 62/598,045, filed on Dec. 13, 2017, provisional application No. 62/577,965, filed on Oct. 27, 2017, provisional application No. 62/577,423, filed on Oct. 26, 2017.

(52) U.S. Cl.
CPC .... *F02M 35/104* (2013.01); *F02M 35/10242* (2013.01); *F01N 2340/02* (2013.01); *F01N 2340/04* (2013.01); *F01N 2340/06* (2013.01); *F01N 2450/24* (2013.01); *F01N 2470/14* (2013.01); *F01N 2470/16* (2013.01); *F02M 2700/05* (2013.01)

(58) Field of Classification Search
CPC ..... F01N 13/107; F01N 2340/04; F01N 2340/06; F01N 2340/02; F01N 2470/14; F01N 2470/16; F01N 2450/24
See application file for complete search history.

(56) References Cited

U.S. PATENT DOCUMENTS

| | | | | |
|---|---|---|---|---|
| 5,689,954 | A | 11/1997 | Blocker et al. | |
| 6,227,179 | B1 | 5/2001 | Eiermann et al. | |
| 6,263,672 | B1 * | 7/2001 | Roby ..... | F02B 37/22 123/568.11 |
| 6,422,222 | B1 | 7/2002 | Arbeiter et al. | |
| 6,688,103 | B2 | 2/2004 | Pleuss et al. | |
| 6,748,934 | B2 | 6/2004 | Natkin et al. | |
| 6,904,885 | B2 | 6/2005 | Osband | |
| 6,976,479 | B1 | 12/2005 | Gottemoller et al. | |
| 7,950,228 | B2 | 5/2011 | Yoon et al. | |
| 8,297,053 | B2 | 10/2012 | Gladden et al. | |
| 8,539,768 | B2 | 9/2013 | Hayman et al. | |
| 9,151,208 | B2 | 10/2015 | Schumnig | |
| 9,175,602 | B2 | 11/2015 | Gunkel et al. | |
| 9,316,151 | B2 | 4/2016 | Keating et al. | |
| 10,132,424 | B2 | 11/2018 | Graichen et al. | |
| 2005/0183414 | A1 | 8/2005 | Bien et al. | |
| 2012/0285427 | A1 | 11/2012 | Hayman et al. | |
| 2018/0156164 | A1 | 6/2018 | Keating et al. | |

OTHER PUBLICATIONS

NPL-5 International Search Report dated Jan. 17, 2019, in PCT/US2018/057218.

NPL-6 International Search Report dated Jan. 4, 2019, in PCT/US2018/057233.

NPL-7 Facebook Post May 7, 2017 <https://www.facebook.com/SupercarSystem/posts/788183328008424:0>.

NPL-8 Facebook Post May 2, 2016 <https://www.facebook.com/SupercarSystem/posts/591367204356705:0>.

NPL-1 Turbo Tech introductory guide, accessed Dec. 18, 2018. (7 pages).

NPL-2 Turbo Tech advanced guide, accessed Dec. 18, 2018. (8 pages).

NPL-3 Turbo Tech expert guide, accessed Dec. 18, 2018. (12 pages).

NPL-4 http://www.tialsport.com/ website, accessed Dec. 18, 2018.

NPL-5 https://www.holley.com/products/exhaust/headers_and_exhaust_manifolds/, accessed Jan. 8, 2019.

NPL-6 https://www.holley.com/products/exhaust/headers_and_exhaust_manifolds/exhaust_manifolds/parts/8510HKR, accessed Jan. 8, 2019.

NPL-7 http://stratifiedauto.com/blog/adjusting-and-upgrading-your-wastegate-actuator/, accessed Jan. 8, 2019.

* cited by examiner

CUSTOMIZABLE ENGINE AIR INTAKE/EXHAUST SYSTEMS

CROSS-REFERENCES TO RELATED APPLICATIONS

This application claims the benefit of U.S. Provisional Application No. 62/577,423, filed Oct. 26, 2017, U.S. Provisional Application No. 62/577,965, filed Oct. 27, 2017, U.S. Provisional Application No. 62/598,045, filed Dec. 13, 2017, U.S. Provisional Application No. 62/616,601, filed Jan. 12, 2018, U.S. Provisional Application No. 62/678,460, filed May 31, 2018, U.S. Provisional Application No. 62/687,461, filed Jun. 20, 2018, and U.S. Provisional Application No. 62/697,072, filed Jul. 12, 2018.

BACKGROUND OF THE INVENTION

Field of the Invention

This invention relates to the air intake and exhaust systems for internal combustion engines.

Description of the Related Art

When reciprocating internal combustion engines draw intake air from the atmosphere into the cylinders, the air often passes through various connecting passageways, such as pipes and chambers. In some cases, where increased power and/or thermal efficiency is desired, the intake air is compressed prior to entering the cylinders. To further increase the charge to the engine cylinders, the compressed intake air may also be cooled prior to introduction to the engine intake manifold.

After combustion, the exhaust gases are conducted to be discharged to the atmosphere, often passing them through pollution control and/or noise reduction devices. While in some automotive systems the air intake and exhaust systems may be separate from each other, in other automotive systems they may be interrelated, typically by way of a turbocharger, which is a mechanical unit that contains one or more turbines that are rotated by exhaust gases, which rotation in turn actuates a pump, such as a centrifugal or axial-flow pump, to compress intake air prior to entering the cylinders.

The design of the intake and exhaust systems can impact engine power and efficiency. Specifically, the path that the intake air must take to the cylinders can affect engine performance, with a lengthier and/or circuitous path reducing the flow rate and the air charge introduced into the cylinders. Likewise, turbocharging and intercooling often requires circuitous plumbing to deliver and regulate the flow of exhaust gases to the turbocharger and then to downstream components. In order to accommodate the various design requirements, intake and exhaust systems are often specific to a particular engine and vehicle platform, with only limited ability to reconfigure the design prior to vehicle shipment, and even less in the after-market.

SUMMARY OF THE INVENTION

The present invention provides compact and reconfigurable automotive internal combustion engine air intake and exhaust systems suitable for use in front-engine, mid-engine and rear-engine vehicles. The systems are designed to yield superior engine performance and to permit substantial increases in engine power by exchanging and adding relatively few principal components, which themselves are designed to cooperate and permit easy substitution. The components utilized in the systems of the present invention are inter-related and capable of being attached to and disconnected with relative ease to form various air intake and exhaust gas configurations. The systems of the present invention offer at least ten different configuration options, and are particularly suitable for an internal combustion piston engine having two cylinder banks of at least two cylinders each, each bank arranged in a row and inclined from the vertical so as to form a V.

In one aspect, the invention is directed to a system for configuring in different power stages an internal combustion piston engine having a first row of at least two cylinders inclined relative to a vertical plane, a second row of at least two cylinders inclined relative to the vertical plane, and the two rows of cylinders form a V configuration with the vertical plane being approximately equidistant between the two rows. The system comprises a Stage 1 package and a Stage 2 package. The Stage 1 package includes a first exhaust manifold adapted to be secured to the first row of cylinders for receiving and collecting in a plenum exhaust gases from the first row of cylinders, where the first exhaust manifold includes a first exhaust gas discharge aperture for discharging exhaust gases, the first exhaust gas discharge aperture is located at a first fixed spatial position when the first exhaust manifold is secured to the first row of cylinders, and there is provided first connecting means proximate the first exhaust gas aperture. The Stage 1 package additionally includes a second exhaust manifold adapted to be secured to the second row of cylinders for receiving and collecting in a plenum exhaust gases from the second row of cylinders, where the second exhaust manifold includes a second exhaust gas discharge aperture for discharging exhaust gases, the second exhaust gas discharge aperture is located at a second fixed spatial position when the second exhaust manifold is secured to the first row of cylinders, and there is provided second connecting means proximate the second exhaust gas aperture. The Stage 2 package includes a first turbo exhaust manifold adapted to be secured to the first row of cylinders for receiving and collecting in a plenum exhaust gases at least from the first row of cylinders, where the first turbo exhaust manifold includes a first turbocharger connection aperture adapted for mounting a turbocharger and for delivering to the turbocharger exhaust gases from either the first row of cylinders or the first row of cylinders and the second row of cylinders, a first exhaust gas passage aperture and third connecting means proximate the first exhaust gas passage aperture, the first turbo exhaust manifold being dimensioned so that the first exhaust gas passage aperture is located at about the first fixed spatial position when the first turbo exhaust manifold is secured to the first row of cylinders in lieu of the first exhaust manifold, and a crossover pipe assembly having a second exhaust gas passage aperture and fourth connecting means proximate the second exhaust gas passage aperture, and having a third exhaust gas passage aperture and fifth connecting means proximate the third exhaust gas passage aperture, where the fourth and fifth connecting means are each adapted for coupling to any two of the first, second and third connecting means.

In other aspects, there are provided further additional Stage 3, 4 and 5 packages, each of which yields substantial increases in engine power for exchange and/or addition of relatively few principal parts. These and other aspects of the present invention are described in the drawings annexed hereto, and in the description of the preferred embodiments and claims set forth below.

DETAILED DESCRIPTION OF THE PREFERRED EMBODIMENTS

Figure 1:
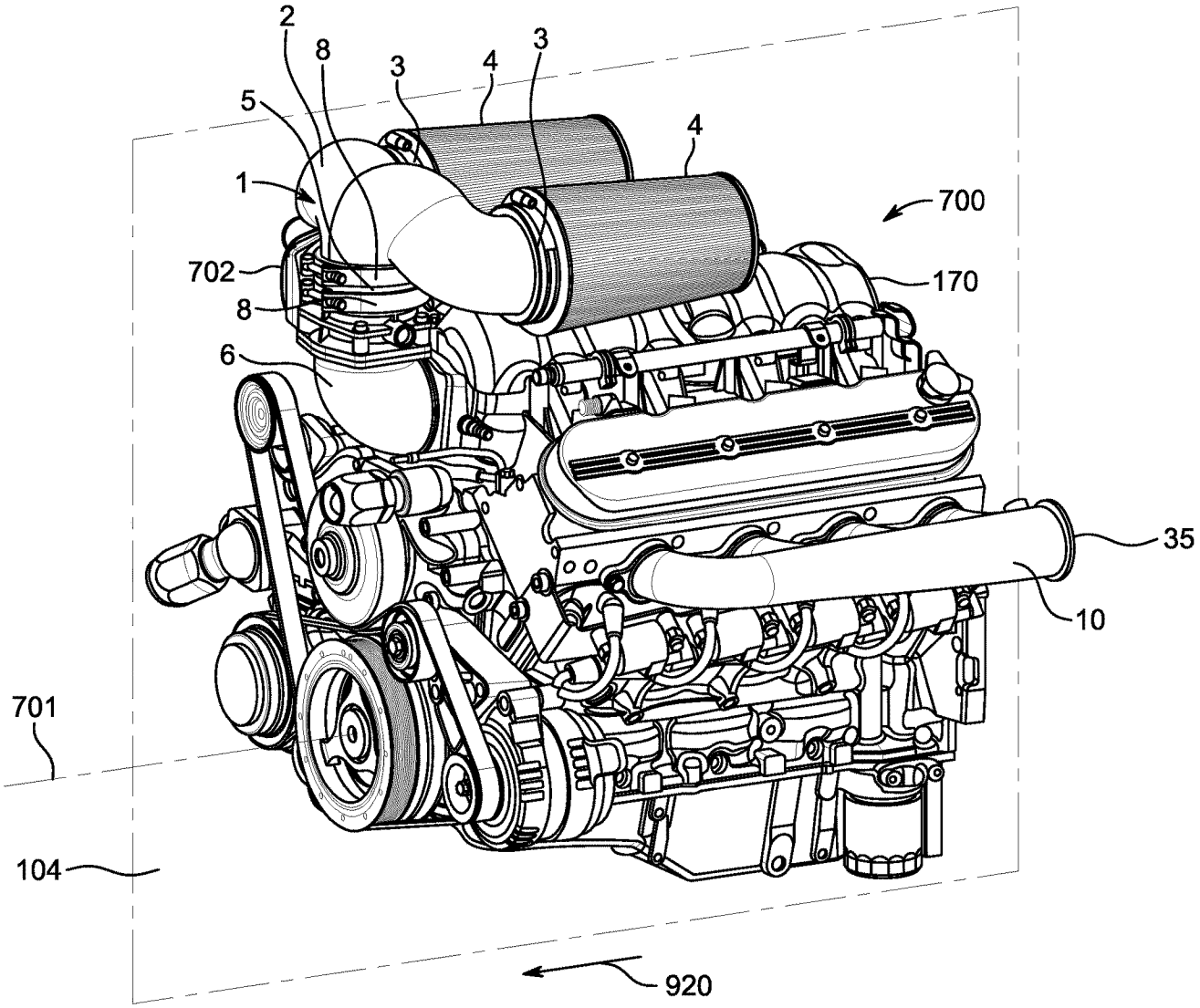
FIG. 1 is a schematic perspective view of a Standard Installation of the Stage 1 air intake-exhaust system of the present invention.

In the embodiment of the present invention depicted in FIG. 1, there is shown an eight cylinder V-8 engine 700. The "forward" portion or "front" of engine 700, and like references, refers to those portions of engine 700 most closely oriented to the head of the arrow 920, shown in FIG. 1; for the engine of the preferred embodiment, the belt-driven accessories are located at the front of engine 700. The "rearward" portion or "rear" of engine 700, and like references, refers to those portions of engine 700 least closely oriented to the head of the arrow 920; for the engine of the preferred embodiment, the drive shaft will exit at the rear of engine 700. Correspondingly, the "left" side of the engine is that side which is generally visible in FIG. 1, whereas the "right" side of the engine generally is not visible in FIG. 1.

In similar manner, references in this disclosure to the "forward" or "front" portion of any component or assemblage, and like references, refers to the portion of the component or assemblage oriented most closely to the head of arrow 920, and reference in this disclosure to the "rearward" or "rear" portion of any component or assemblage, and like references, refers to the portion of the component or assemblage oriented least closely to the head of arrow 920. Where arrow 920 is presented in a figure showing a component or components in isolation from engine 700, it is assumed that the orientation of that component or those components when secured to engine 700 is with their respective arrows 920 aligned and pointing in the same direction, unless stated otherwise.

Figure 33:
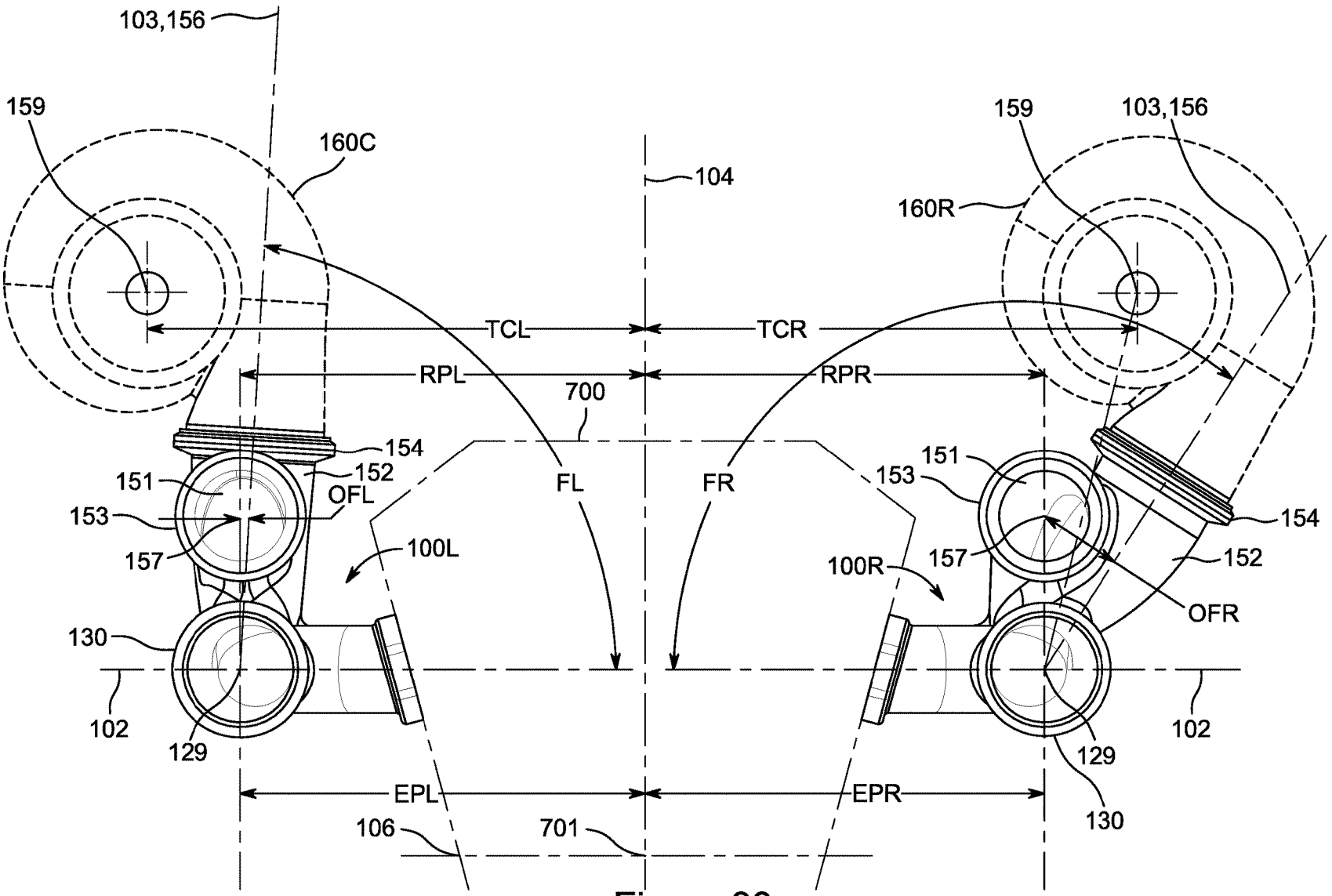
FIG. 33 is a rear view of a turbo exhaust manifold pair utilizable in the Stage 4 air intake-exhaust system of the present invention.

Furthermore, references in this disclosure to the vertical direction, or like statements, refers to the direction normal to the ground (the ground being generally parallel to a horizontal plane 106, shown on edge in FIG. 33). In the case of V-8 engines mounted in a conventional upright orientation, as depicted in FIG. 1, there is a vertically oriented geometrical plane 104 (FIG. 1; also shown on edge in FIG. 33) that passes through the crankshaft centerline 701 and is equidistant between the cylinder banks. In this disclosure, a horizontal line contained in this vertical plane 104 oriented parallel to the ground is said to define the longitudinal direction. Correspondingly, vertical plane 104 is sometimes referred to herein as longitudinal plane 104.

Additionally, any of the set of geometrical planes perpendicular to longitudinal plane 104 and orthogonal to crankshaft centerline 701 may be referred to in this disclosure as a transverse plane (in this disclosure, all transverse planes are vertically oriented).

The particular engine shown is FIG. 1 is an LS3 model 6.2 liter displacement small block V-8 engine, with fuel injection (marketed by General Motors Company). The concepts of the inventions described herein are particularly applicable to V-style engines generally; i.e., engines having two cylinder banks of at least two cylinders each, each bank arranged in a row inclined from the vertical so as to form a "V", including V-4 engines, V-6 engines, V-12 engines, V-16 engines, etc. In the LS3 model engine depicted, the ignition system module has been relocated from above the air intake manifold 710 to below the engine 700, in order to provide space above the air intake manifold 710 for certain of the features of the present invention, as described below. In addition, the valve covers depicted in FIG. 1 provide additional space for use of taller valve trains, relative to stock covers.

The inventive systems described herein feature plural inter-cooperative components capable of being attached to and disconnected with relative ease to the engine and each other to yield substantial increases in engine power as the user may choose. In particular, the present invention provides five principal different engine configurations, referred to herein as Stages 1 through 5. Each stage develops increasing engine power than the last stage, using largely the same basic engine block and components throughout. The engine configuration in each of these stages is described below, together with the components used in that stage. Each stage can be installed in forward and reverse orientations, as is also described below. Further, given the flexibility of the present invention it is possible to create even further configurations beyond the Stages 1 through 5 expressly described herein.

Stage 1 Configuration

The engine 700 in its Stage 1 configuration is shown in FIG. 1. The engine 700 in its Stage 1 configuration is naturally aspirated; i.e., air is drawn into the cylinders without any air compression steps performed in the course of air induction, and in its Stage 1 configuration the exhaust gases are conducted to the atmosphere without making use of the enthalpy contained in those exhaust gases. The principal components utilized in the Stage 1 configuration are the Stage 1 air intake assembly 1 and the single outlet exhaust manifold 10, described below.

Stage 1 Air Intake Assembly (1)

The Stage 1 air intake assembly 1 includes a dual ramshorn air intake 2 with two round input ports 3, on each of which is secured a cylindrical air filter 4, which is shown in FIG. 1. The air received through this air intake assembly 1 is delivered to the engine intake manifold 710 through an air intake connector 5, a throttle assembly 702 and an air intake elbow 6. Air intake connector 5 is a pliable conduit (such as silicone hose) that is secured to air intake 2 and throttle assembly 702 with two T-bolt clamps 8. Although first identified herein in connection with the description of the Stage 1 configuration, the air intake elbow 6, the throttle assembly 702 and the engine intake manifold 710 are common to all stages.

Single Outlet Exhaust Manifold (10)

Figure 2:
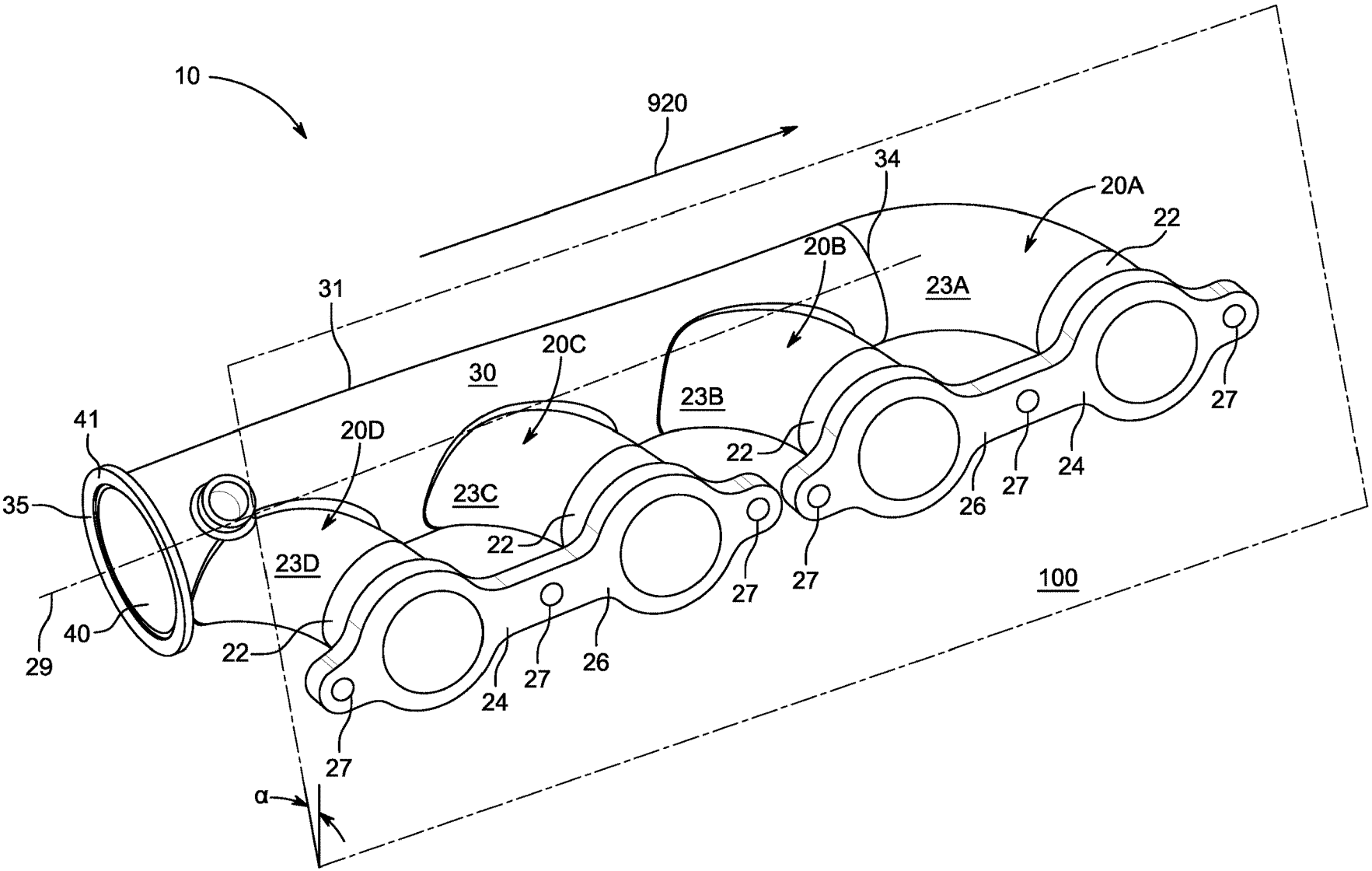
FIG. 2 is a schematic perspective view of the single outlet exhaust manifold first utilized in the Stage 1 air intake-exhaust system of the present invention.

FIG. 2 shows the single outlet exhaust manifold 10 for mounting to a cylinder bank of engine 700. In the Stage 1 configuration, two single outlet exhaust manifolds 10 are utilized, one for each cylinder bank. The single outlet exhaust manifold 10 shown in FIG. 2 is mounted in FIG. 1 to the left cylinder bank of engine 700. The single outlet exhaust manifold 10 for the right cylinder bank is in general design a mirror image of single outlet exhaust manifold 10 shown in FIG. 2. However, in the preferred embodiment of the present invention, the single outlet exhaust manifolds for the left and right cylinder banks differ in overall length. Where pertinent to this disclosure, the single outlet exhaust manifold 10 to be mounted on one cylinder bank will be referred to as single outlet exhaust manifold 10L and the single outlet exhaust manifold for the other cylinder bank will be referred to as single outlet exhaust manifold 10R. Where the designs features are the same for both of the single outlet exhaust manifolds, this disclosure will generically refer to single outlet exhaust manifold 10 for convenience of reference.

References herein to the "forward" or "rearward" portions of single outlet exhaust manifold 10 are made with reference to the orientation of exhaust manifold 10 relative to arrow 920 depicted in FIG. 2. Thus in FIG. 1, each single outlet exhaust manifold 10 is installed on engine 700 so that its rearward end 35 is proximate the rear of engine 700.

Single Outlet Exhaust Manifold 10 Generally.

Figure 3:
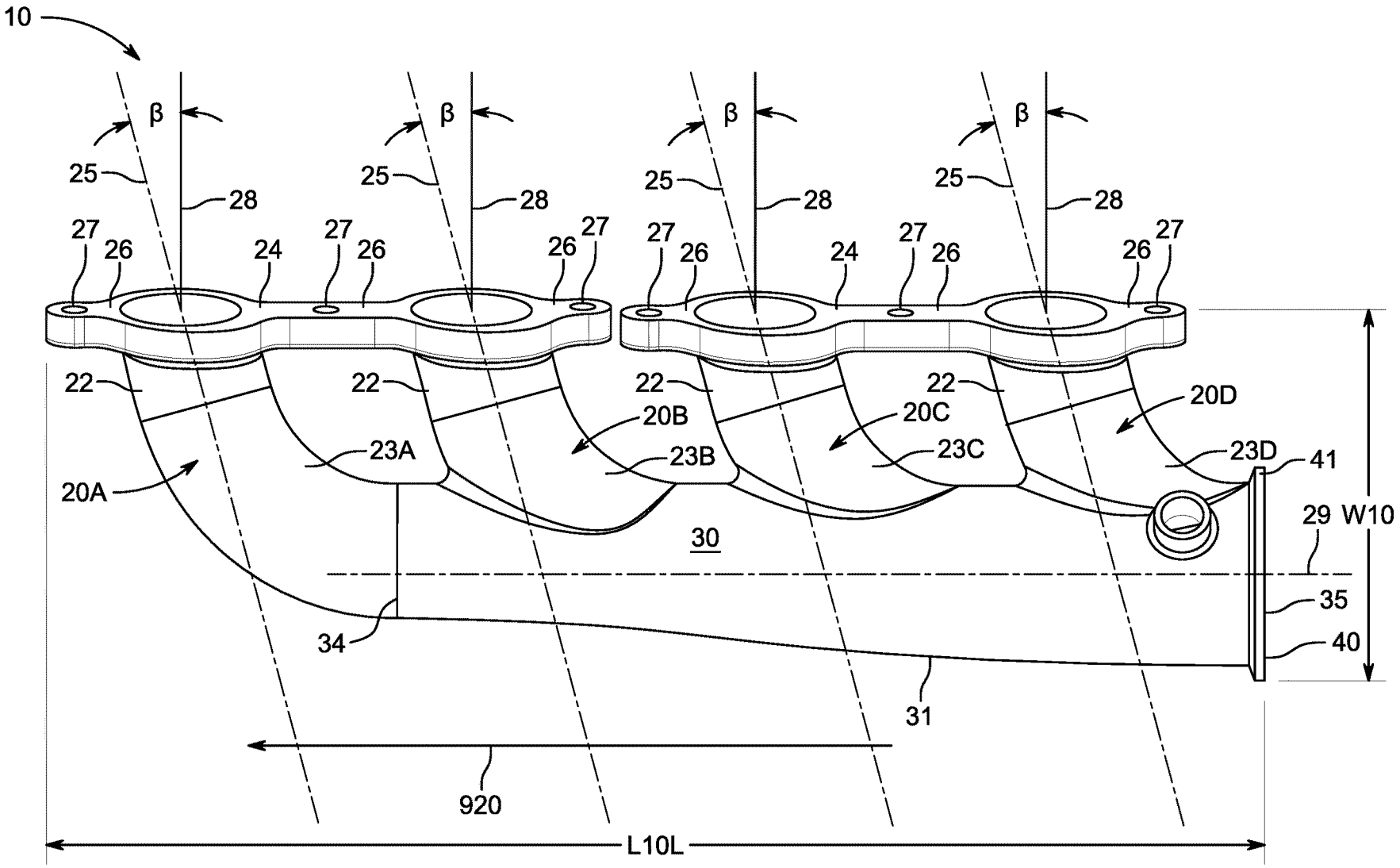
FIG. 3 is a top view of the single outlet exhaust manifold first utilized in the Stage 1 air intake-exhaust system of the present invention.

As shown in FIGS. 2 and 3, single outlet exhaust manifold 10 includes a manifold plenum 30, for collecting exhaust gases from the engine. In the preferred embodiment, which refers for exemplary purposes to a V-8 engine, single outlet exhaust manifold 10 depicted in FIGS. 2 and 3 includes four exhaust stack assemblies 20A, 20B, 20C and 20D (collectively referred to as exhaust stack assemblies 20), one for each cylinder of the left cylinder bank (for purposes of example) of the V-8 engine depicted in FIG. 1. From the cylinder bank to which they are secured, exhaust stack assemblies 20 channel exhaust gases to manifold plenum 30, which collects and channels the collected gases to exhaust outlet 40, from which the collected gases are discharged in the Stage 1 configuration to the atmosphere optionally through a catalytic converter and/or muffler, but without conducting the exhaust gases to intervening components, such as gas turbines, for extracting thermal energy contained in the exhaust gases for other use.

Figure 4:
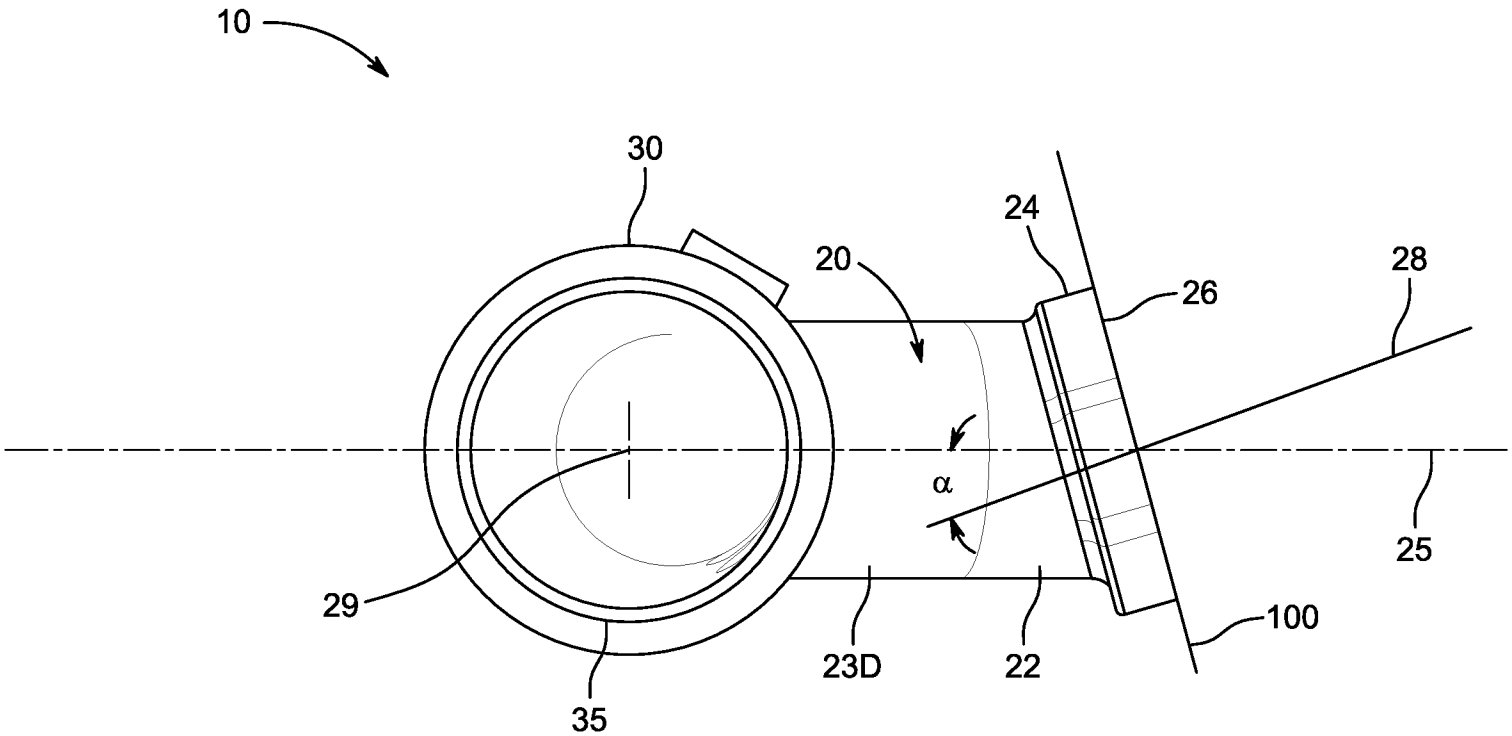
FIG. 4 is a rear view of the single outlet exhaust manifold first utilized in the Stage 1 air intake-exhaust system of the present invention.

Manifold Plenum (30):

Manifold plenum 30 has a generally elongate cylindrical shape and a generally cylindrical wall 31, as shown in FIGS. 2 and 4, and is generally circular in cross-section, as shown for example in FIG. 4, with an axial centerline 29.

The forward end 34 of manifold plenum 30 is closed off by the first exhaust stack assembly 20A (containing exhaust connector 23A). The rearward end 35 of manifold plenum 30 defines exhaust outlet 40, for discharge of all or substantially all exhaust gases received in plenum 30. It is preferred that the diameter of manifold plenum 30 become greater along its length; i.e., from the forward end 34 of plenum 30 to the rearward end 35. This growth in diameter yields an expanding cylindrical volume from the forward end 34 to the rearward end 35, which serves to accommodate the introduction of additional exhaust gases from each successive cylinder along the length, as well as to permit the expansion of the exhaust gases. It is particularly preferred that the rate of diameter growth of manifold plenum 30 not be constant along its length from forward end 34 to rearward end 35. Rather, it is particularly preferred that the growth in diameter of manifold plenum 30 start at zero at forward end 34, then grow at an increasing rate from forward end 34 up to approximately the mid-point between forward end 34 and rearward end 35, then grow at a decreasing rate from that mid-point up to rearward end 35, and again reach a zero growth rate at rear end 35. The result of changing the growth rate in this manner is to generally give an "S" shape to wall 31 in profile, from forward end 34 to rearward end 35, as can be seen in FIG. 3. Put another way, the profile of wall 31 of manifold plenum 30 comes to be defined by an S-shaped curve rotated about the centerline 29 of plenum 30, as in FIG. 3.

The length of manifold plenum 30, together with first exhaust stack assembly 20A, largely determines the overall length of single outlet exhaust manifold 10. For V-configuration engines whose left and right cylinder bank discharge ports are offset (typically a consequence of utilizing crankshafts with crankpins arranged along the length of the crankshaft), it is preferred that the overall length of the single outlet exhaust manifold 10 for one of the cylinder banks not be the same as the overall length of the single outlet exhaust manifold 10 for the other of the cylinder banks.

Thus, referring to the single outlet exhaust manifold 10 visible in FIG. 1 as 10L, and the single outlet exhaust manifold not visible in FIG. 1 as 10R, it is preferred that the overall lengths of 10L and 10R (referred to herein as L10L and L10R; overall length L10L is explicitly shown in FIG. 3) differ an amount approximately equal to the offset distance between the engine's left and right cylinder bank discharge ports, so as to result in the rearward ends 35 of each manifold plenum 30 of the single outlet exhaust manifolds (10L and 10R) terminating approximately in the same transverse plane ("Relationship A"). For example, in the case of the LS3 model V-8 engine shown in FIG. 1, the left cylinder bank is offset forward of the right cylinder bank. Thus for the single outlet exhaust manifold 10 visible in FIG. 1 and shown in FIG. 3, L10L will be larger than L10R by an amount approximately equal to the cylinder bank offset distance.

It is preferred that rearward end 35 of manifold plenum 30 include means for coupling, so as to facilitate (in this instance) the passage of gas through exhaust passageway 40 to other components. In this disclosure, "means for coupling" includes any mechanical elements or components that facilitate the mechanical joining of two adjacent components. "Mechanical joining" includes joining mechanisms such as by use of screw threads, bayonet connections, mechanical clamping, but excludes any process of joining involving the melting of material for fusing together two or more components, such as welding and brazing. In the case of the rearward end 35 of manifold plenum 30, it is particularly preferred that the means for coupling include a flanged connector 41, as shown in FIGS. 2 and 3.

Exhaust Stack Assemblies (20).

Exhaust stack assembly 20A is the forward most exhaust stack assembly, exhaust stack assembly 20B is immediately to the rear of 20A, exhaust stack assembly 20C is immediately to the rear of 20B, exhaust stack assembly 20D is immediately to the rear of 20C, as shown for example in FIGS. 2 and 3.

Exhaust stack assemblies 20 each comprises a leader pipe 22 and one of exhaust connectors 23A, 23B, 23C and 23D (collectively referred to as exhaust connectors 23). The portions of leader pipes 22 proximate the engine are joined to manifold flanges 24. In particular, in the embodiment shown there are two manifold flanges 24, one of which is joined to the forward two leader pipes 22 and the other of which is joined to the rearward two leader pipes 22. Each leader pipe 22 has a centerline 25 (see FIGS. 3 and 4) and has a generally circular diameter along the length of centerline 25.

In the embodiment shown in FIGS. 2 and 3, the first exhaust connector 23A is a curved pipe of relatively uniform diameter, whereas the diameters of second, third and fourth exhaust connectors 23B, 23C and 23D increase with increasing distance from flanges 24, in order to permit the expansion of the exhaust gases along their length. This increase in diameter is for purposes of reducing cylinder backpressure and improving exhaust gas scavenging during the exhaust cycle.

Manifold flanges 24 include engine-side generally planar mating surfaces 26, which form a relatively gas-tight seal when fastened to an engine, and additionally, which define a plurality of apertures 27 that permit exhaust manifold 10 to be fastened (using nuts) to threaded studs extending from a cylinder bank of engine 700. The portion of each stack assembly 20 distal from the engine is joined to manifold plenum 30.

The engine-side mating surfaces 26 of manifold flanges 24 are oriented parallel to a plane 100, shown in FIGS. 2 and 4. An engine generally will have contact surfaces machined or formed on the engine in a region circumscribing the engine exhaust ports, in order to form a relatively gas-tight seal with appropriate portions of a manifold, which in this embodiment are the engine-side mating surfaces 26 of single outlet exhaust manifold 10. For V-8 engines, those contact surfaces generally are inclined from the vertical, for example at an angle V equal to approximately one-half the angle subtended by the cylinder banks; thus, for a V-8 engine, the angle V relative to vertical plane 104 will be for example approximately 22.5°, 30° or 36°.

In the present invention, it is preferred that the centerline 25 of each leader pipe 22, as well as the centerlines of exhaust connectors 23, be inclined upwardly at an angle $\alpha$ from a line 28 orthogonal to plane 100, as shown in FIG. 4, so that the exhaust stack assemblies 20 lie generally in a horizontal plane when exhaust manifold 10 is joined to an engine having an inclined cylinder bank. Thus in the rear view of FIG. 4, the centerlines of exhaust connectors 23, as well as centerlines 25, collectively coincide so as to be located in that horizontal plane. In some V-8 engine cases, angle α will be approximately the same as angle V, although the ultimate choice for angle α depends on the orientation of the specific engine contact surfaces. Also, relative to arrow 920 and flanges 24 shown in FIG. 3, the centerline 25 of each leader pipe 22 is inclined rearwardly at an angle β from line 28 orthogonal to plane 100. Inclining leader pipes 22 at angles α and β is for purposes of improving engine performance.

Leader pipes 22 are joined to flange fittings 24 via welding, brazing or by being integrally formed with manifold flanges 24. Likewise, exhaust connectors 23 are joined to manifold plenum 30 via welding, brazing or by being integrally formed with manifold plenum 30, and leader pipes 22 are joined to exhaust connectors 23 via welding, brazing or by being integrally formed with exhaust connectors 23.

The overall width of single outlet exhaust manifold 10, denominated W10 in FIG. 3, is largely determined by the diameter of manifold plenum 30, together with the lengths of exhaust stacks 20 (coinciding with the distance between flanges 24 and manifold plenum 30). It is preferred that width W10 be as compact as exhaust gas flow, structural and service access considerations will permit, in order to yield a compact design. It is further preferred that width W10 be the same for both single outlet exhaust manifold 10L and single outlet exhaust manifold 10R, so that their centerlines 29 are equidistant from the vertical plane 104 passing through the engine crankshaft centerline 701. Centerlines 29 of exhaust manifolds 10L and 10R as a general matter will be located approximately in the same horizontal plane in view of their general mirror symmetry.

An exhaust manifold design generally corresponding to single outlet exhaust manifold 10 is described in U.S. Provisional Application No. 62/598,045 entitled "Dual-Angle Exhaust Manifold," filed Dec. 13, 2017, the contents of which are hereby incorporated by reference as if fully set forth herein, including the aforementioned exhaust manifold design. Likewise, an exhaust manifold design generally corresponding to exhaust manifold 10 is described in U.S. patent application Ser. No. 16/168,971, entitled "Dual-Angle Exhaust Manifold," having the same inventors as the subject application and filed on the same date as the subject application, the contents of which are hereby incorporated by reference as if fully set forth herein, including the aforementioned exhaust manifold design, found for example at paragraphs 12-20 and FIGS. 1-3 thereof.

Stage 1 Reverse Installation

As indicated above, FIG. 1 depicts a single outlet exhaust manifold 10 installed on engine 700 so that its rearward end 35 is proximate the rear of engine 700 and distal from the head of arrow 920. When a Stage 1, 2 or 3 engine configuration includes a single outlet exhaust manifold 10 with this orientation, then that configuration is referred to herein as a "Standard Installation." Thus FIG. 1 depicts a Standard Installation of the Stage 1 configuration (which configuration has one single outlet exhaust manifold 10 on the left side of engine 700 and a second single outlet exhaust manifold 10 on the right side of engine 700).

However, in certain embodiments of the present invention, a single outlet exhaust manifold 10 is installed on engine 700 rotated 180 degrees about the vertical direction relative to the Standard Installation orientation, such that the portions that are proximate to the rear of engine 700 in the Standard Installation (furthest from the head of arrow 920) are instead proximate to the front of engine 700 (closest to the head of arrow 920). An engine configuration having such an orientation is referred to herein as a "Reverse Installation." A Reverse Installation can have especial utility, for example, in vehicles having a rear engine design.

Thus in the Reverse Installation of the Stage 1 configuration, each exhaust manifold 10 is rotated 180° about the vertical direction, relative to a Standard Installation, and installed on the side of engine 700 opposite to its location in the Standard Installation, such that the rearward end 35 of manifold plenum 30 of each exhaust manifold 10 is oriented proximate to the head of arrow 920. The Stage 1 air intake assembly 1 is the same in both a Standard Installation and a Reverse Installation of the Stage 1 configuration.

Stage 2 Configuration

Figure 5A:
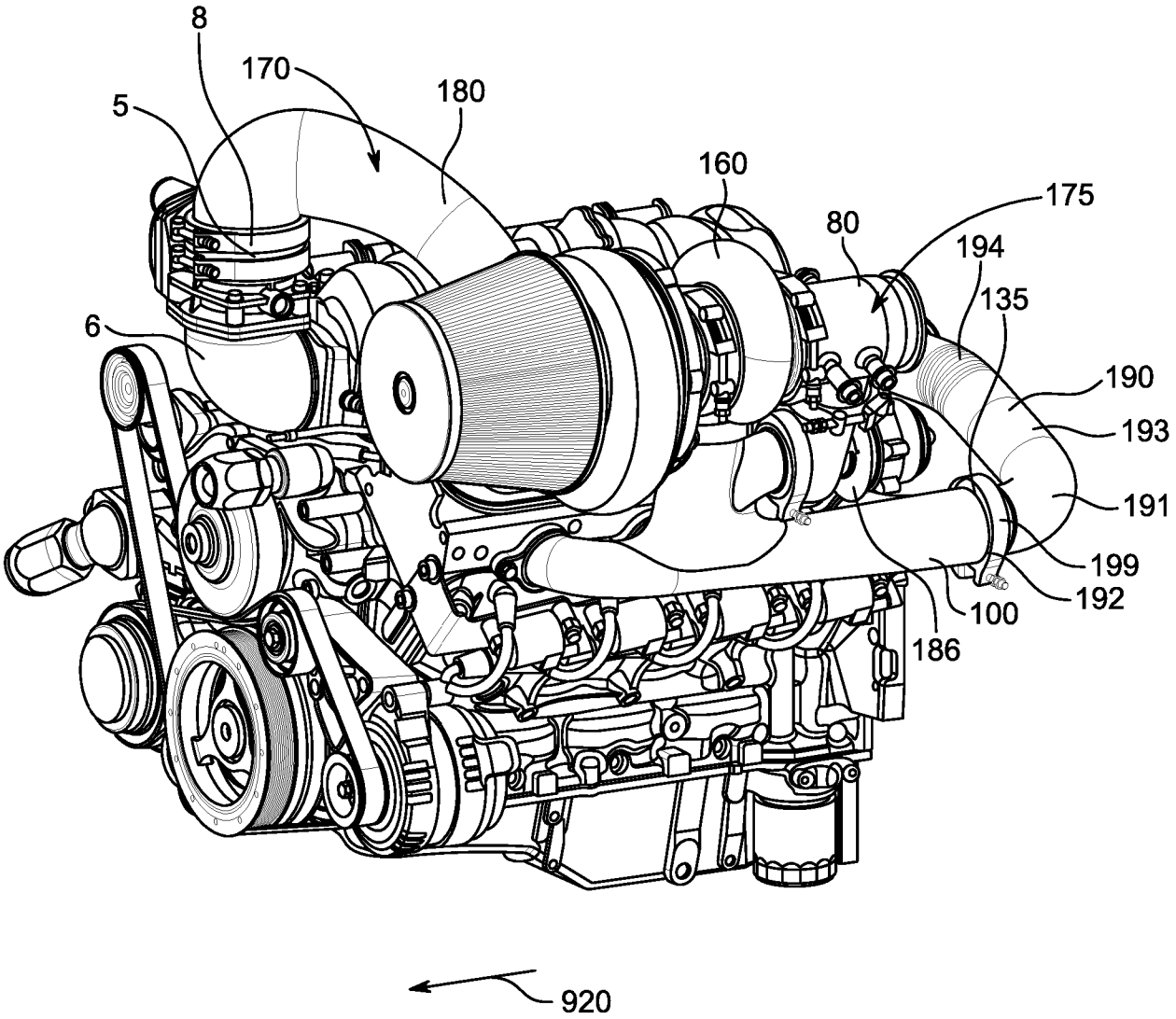
FIG. 5A is a schematic front perspective view of a Standard Installation of the Stage 2 air intake-exhaust system of the present invention.

In Stage 2, the engine is configured to develop substantially more power than in Stage 1. The Stage 2 configuration is depicted in FIG. 5A. In particular, the Stage 2 configuration includes a turbocharger 160, shown in FIG. 5A, for transferring enthalpy from the exhaust gases to the input air by increasing intake manifold pressure.

The principal components first utilized in the Stage 2 configuration are the turbocharger 160, a turbo exhaust manifold 100, a turbocharger exhaust circuit 175, a crossover pipe assembly 190, and a Stage 2 turbocharger air circuit 170, described below.

Turbocharger (160)

Turbocharger 160 extracts enthalpy from the exhaust gases and transfers it to the engine intake air by compressing that intake air. In this disclosure, a "turbocharger" is a mechanical unit that contains one or more turbines that are rotated by exhaust gases, which rotation in turn actuates a pump to compress intake air.

Figure 11A:
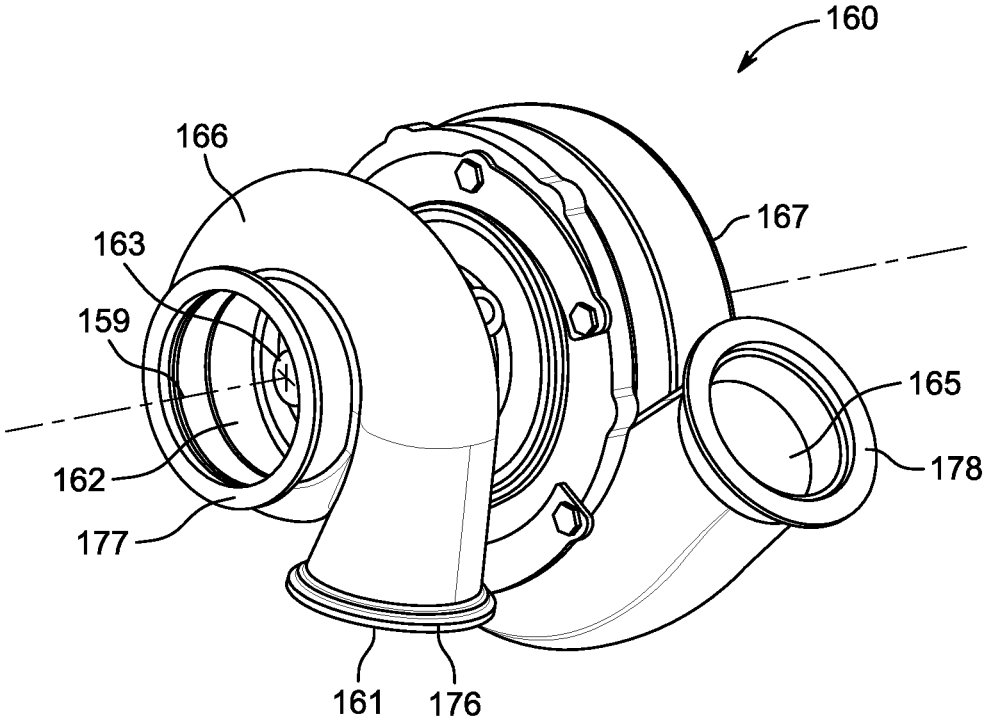
FIGS. 11A and 11B are perspective views of an exemplary turbocharger first utilized in the Stage 2 air intake-exhaust system of the present invention, with the FIG. 11A orientation particularly depicting the exhaust turbine portion and the FIG. 11B orientation particularly depicting the air compressor portion.
Figure 11B:
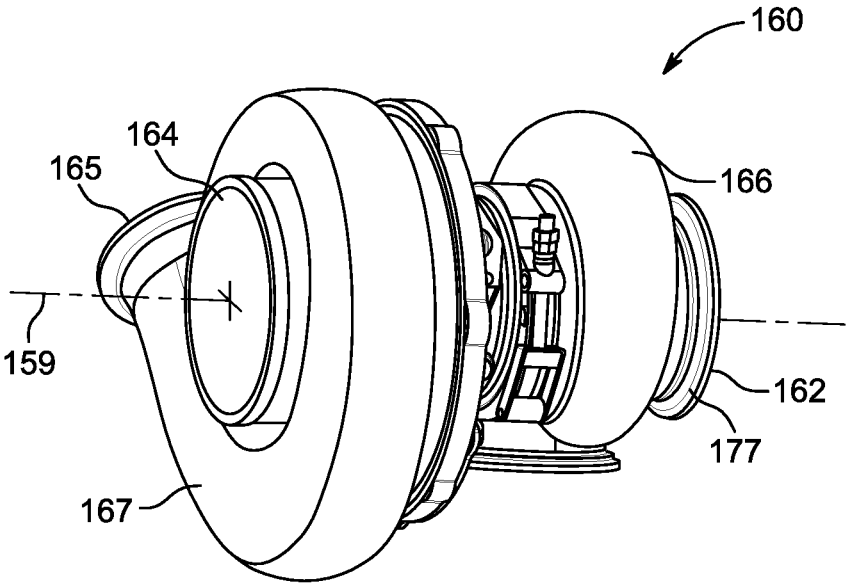

As shown in FIGS. 11A and 11B, a preferred embodiment of turbocharger 160 includes an annular exhaust gas inlet 161 and an annular exhaust gas outlet 162. Each of inlet 161 and outlet 162 preferably is provided with means for coupling, and more particularly with flanged connectors 176 and 177 respectively, as shown in FIGS. 11A and 11B, to facilitate connection of turbocharger 160 with other components. Turbocharger 160 preferably includes a radial flow turbine that rotates a turbocharger shaft 163. In the preferred embodiment shown in the figures, the exhaust gas inlet 161 is generally tangentially-oriented (i.e., generally oriented along a tangent to the circular path defined by rotation of the exhaust gas turbine blades) and the exhaust gas outlet 162 is generally axially-oriented ((i.e., generally oriented along the axis 159 of the turbine shaft 163). In operation, hot exhaust gas is received through exhaust gas inlet 161. The exhaust gas then is directed to the turbine gas blades through a scroll passage 166 (shaped generally in a spiral or snail-shell configuration), which is generally orthogonal to the turbine shaft 163. The exhaust gas passing from this scroll passage 166 causes the gas turbine blades to turn the turbocharger shaft 163. The exhaust gas then exits through exhaust gas outlet 162.

Figure 12:
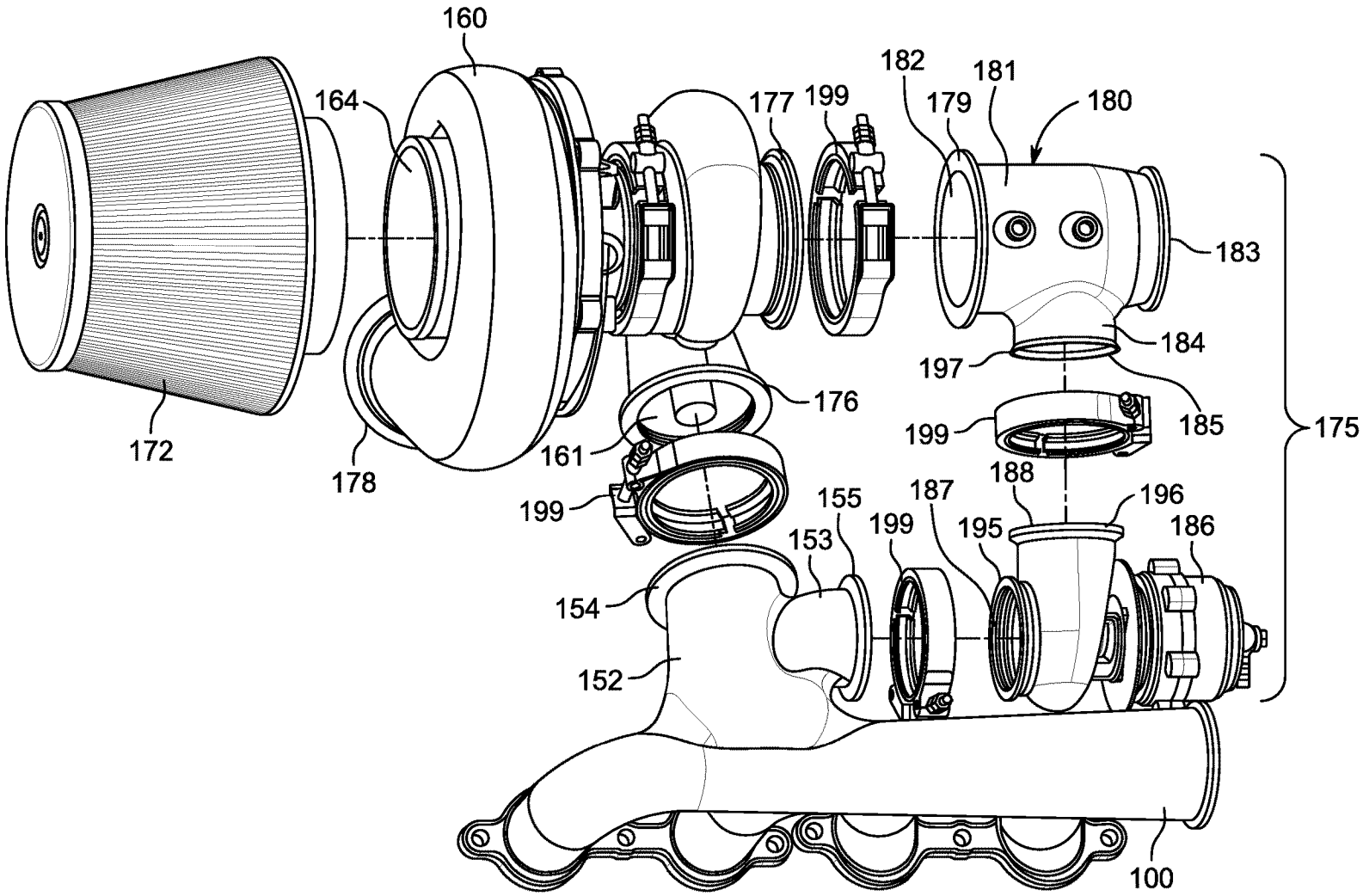
FIG. 12 is an exploded schematic perspective view of the turbocharger and turbocharger exhaust circuit first utilized in the Stage 2 air intake-exhaust system of the present invention.

As further shown in FIGS. 11A and 11B, turbocharger 160 includes an annular turbocharger air inlet 164 and an annular compressed air outlet 165. Outlet 165 preferably is provided with means for coupling, and more particularly a flanged connector 178, to facilitate connection with other components. The turbocharger air inlet 164 is generally axially-oriented (i.e., generally oriented along the axis 159 of the turbine shaft 163), and the compressed air outlet 165 is generally tangentially-oriented (i.e., generally oriented along a tangent to the circular path defined by rotation of the centrifugal air compressor blades). In operation, air is drawn into turbocharger air inlet 164, preferably through an air filter 172 (FIG. 12). The turbocharger shaft 163 rotates the blades/vanes of a centrifugal air compressor within the turbocharger 160, which compresses the air. The compressed air exits through compressed air outlet 165. A turbocharger 160 generally conforming to the foregoing design is a Garrett® GTX4202R turbocharger (available from Honeywell Turbo Technologies, Rolle, Switzerland) with a TiAL® stainless steel exhaust housing (available from TiAL Sport, Owosso, Mich.).

Turbo Exhaust Manifold (100)

FIGS. 6, 7, 9 and 10 depict a turbo exhaust manifold 100 designed in accordance with the teachings herein. Similar to single outlet exhaust manifold 10, references herein to the "forward" or "rearward" portions of turbo exhaust manifold 100 are made with reference to the orientation of exhaust manifold 100 relative to arrow 920 depicted in FIG. 6. Thus in FIG. 5A, turbo exhaust manifold 100 is installed on engine 700 so that its rearward end 135 is proximate the rear of engine 700.

Figure 6:
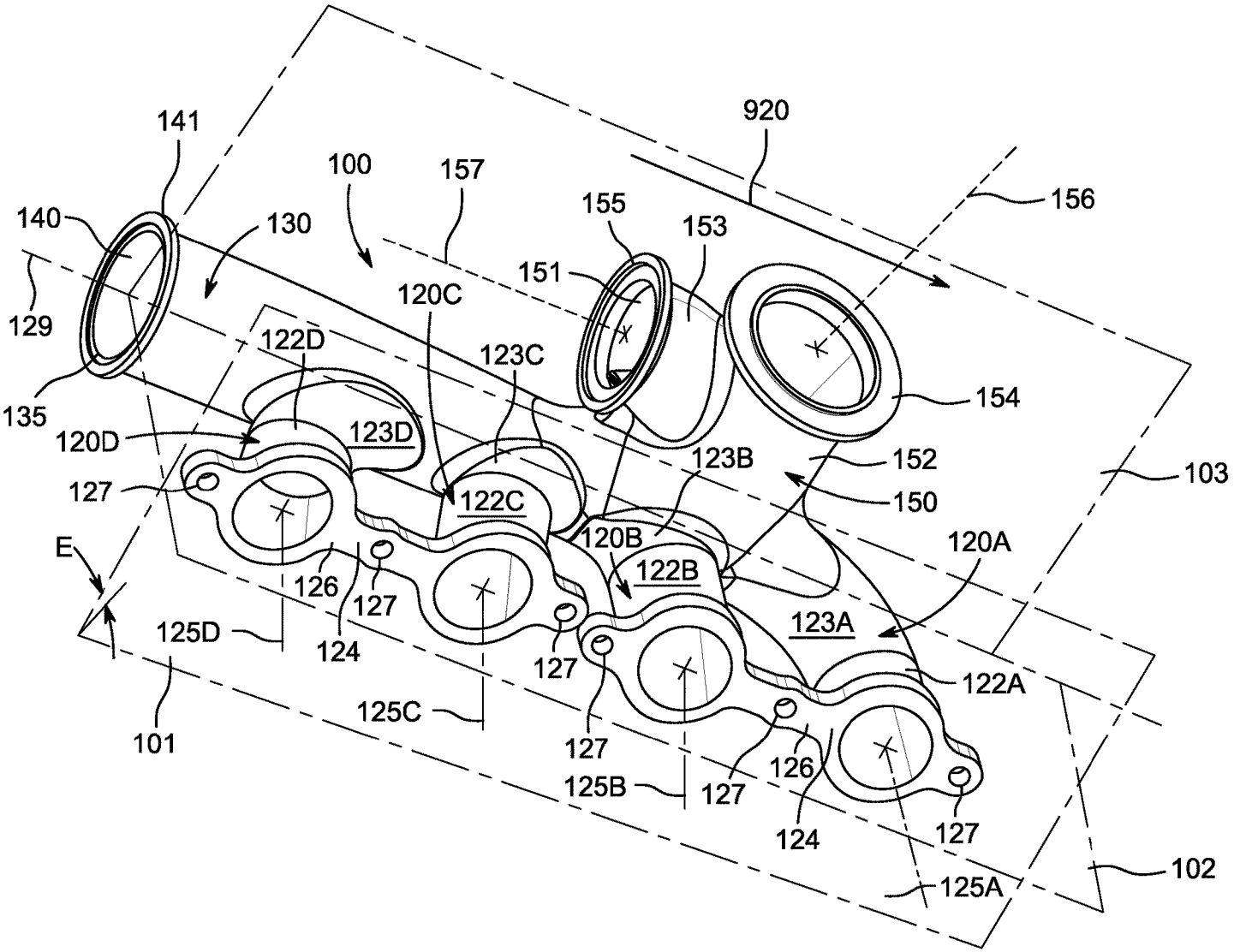
FIG. 6 is a schematic perspective view of the turbo exhaust manifold first utilized in the Stage 2 air intake-exhaust system of the present invention.

FIG. 6 shows the turbo exhaust manifold 100 for mounting to a cylinder bank of engine 700. In the Stage 2 configuration, one turbo exhaust manifold 100 is utilized, and is mounted to either the left cylinder bank or the right cylinder bank of engine 700. The turbo exhaust manifold 100 shown in FIG. 6 is mounted in FIG. 5A to the left cylinder bank of engine 700. A turbo exhaust manifold 100 for the right cylinder bank would in general design mirror turbo exhaust manifold 100 shown in FIG. 6. However, in the preferred embodiment of the present invention, the exhaust manifolds for the left and right cylinder banks differ in overall length, and there are other differences as well in other embodiments relating to turbo exhaust manifold 100. Where pertinent to this disclosure, a turbo exhaust manifold 100 to be mounted on one cylinder bank will be referred to as turbo exhaust manifold 100L and a turbo exhaust manifold for the other cylinder bank will be referred to as single outlet exhaust manifold 100R. Where the designs features do not change depending upon which cylinder bank the turbo exhaust manifold is mounted, this disclosure will generically refer to turbo exhaust manifold 100 for convenience of reference.

Turbo Exhaust Manifold 100 Generally.

Figure 7:
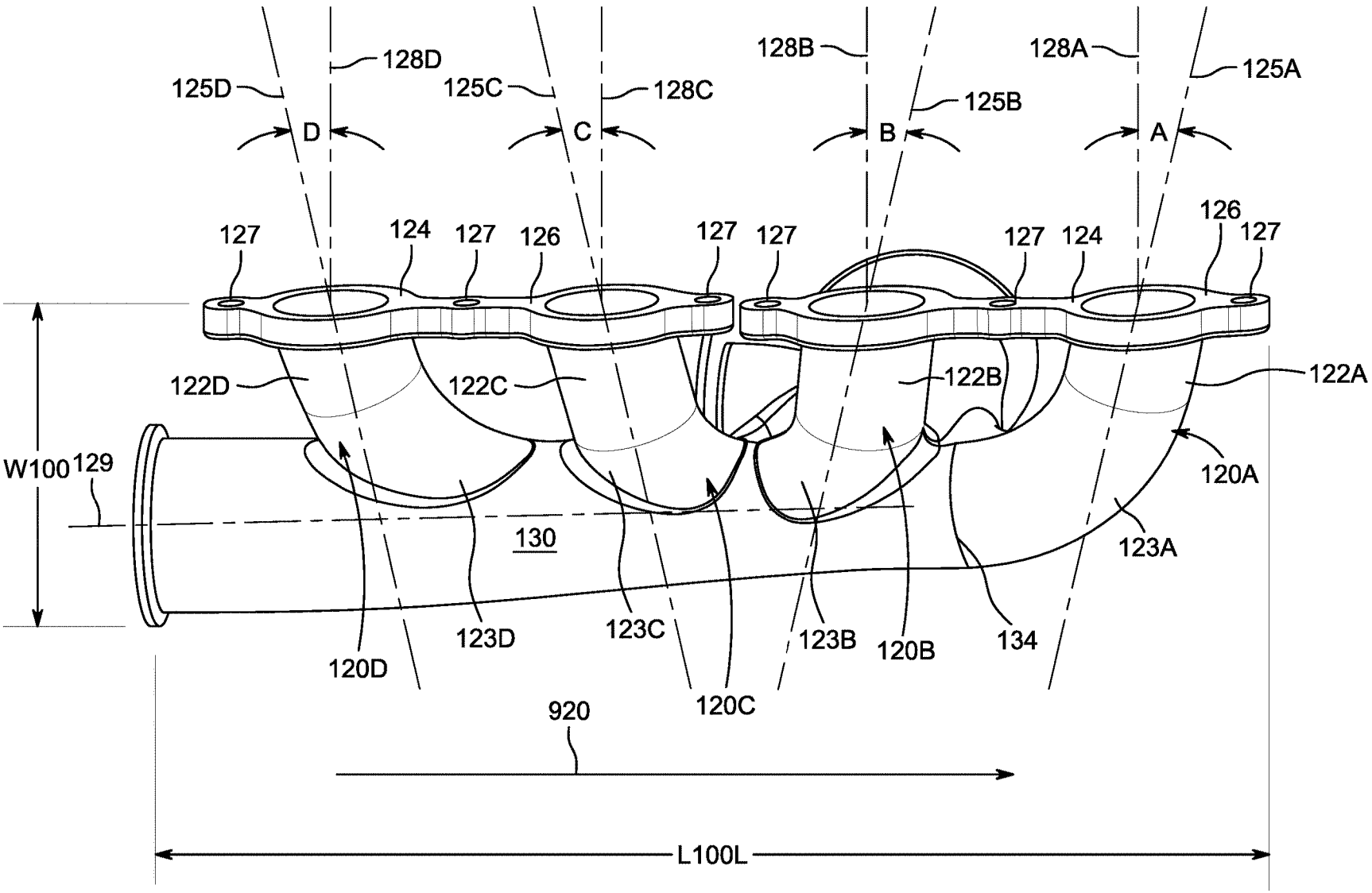
FIG. 7 is a bottom view of the turbo exhaust manifold first utilized in the Stage 2 air intake-exhaust system of the present invention.

As shown for example in FIGS. 6 and 7, turbo exhaust manifold 100 includes a manifold plenum 130, for collecting exhaust gases discharged from one or both cylinder banks of engine 700, depending on the engine configuration. In the preferred embodiment, which refers for exemplary purposes to a V-8 engine, exhaust manifold 100 includes four exhaust stack assemblies 120A, 120B, 120C and 120D (collectively referred to as exhaust stack assemblies 120), one for each cylinder in (for purposes of example) the left cylinder bank of a V-8 engine. Exhaust stack assemblies 120 conduct exhaust gases from the cylinder bank to manifold plenum 130.

Exhaust manifold 100 further includes exhaust gas routing circuit 150 for receiving exhaust gases from manifold plenum 130. Routing circuit 150 in turn includes a turbocharger support column 152 for connection to turbocharger 160, and exhaust gas bypass pipe 153, for bypassing turbocharger 160. Routing circuit 150 conducts exhaust gases from manifold plenum 130 to turbocharger exhaust gas inlet 161 via support column 152, and to a bypass valve 186 via exhaust gas bypass pipe 153.

Manifold Plenum (130).

Figure 8:
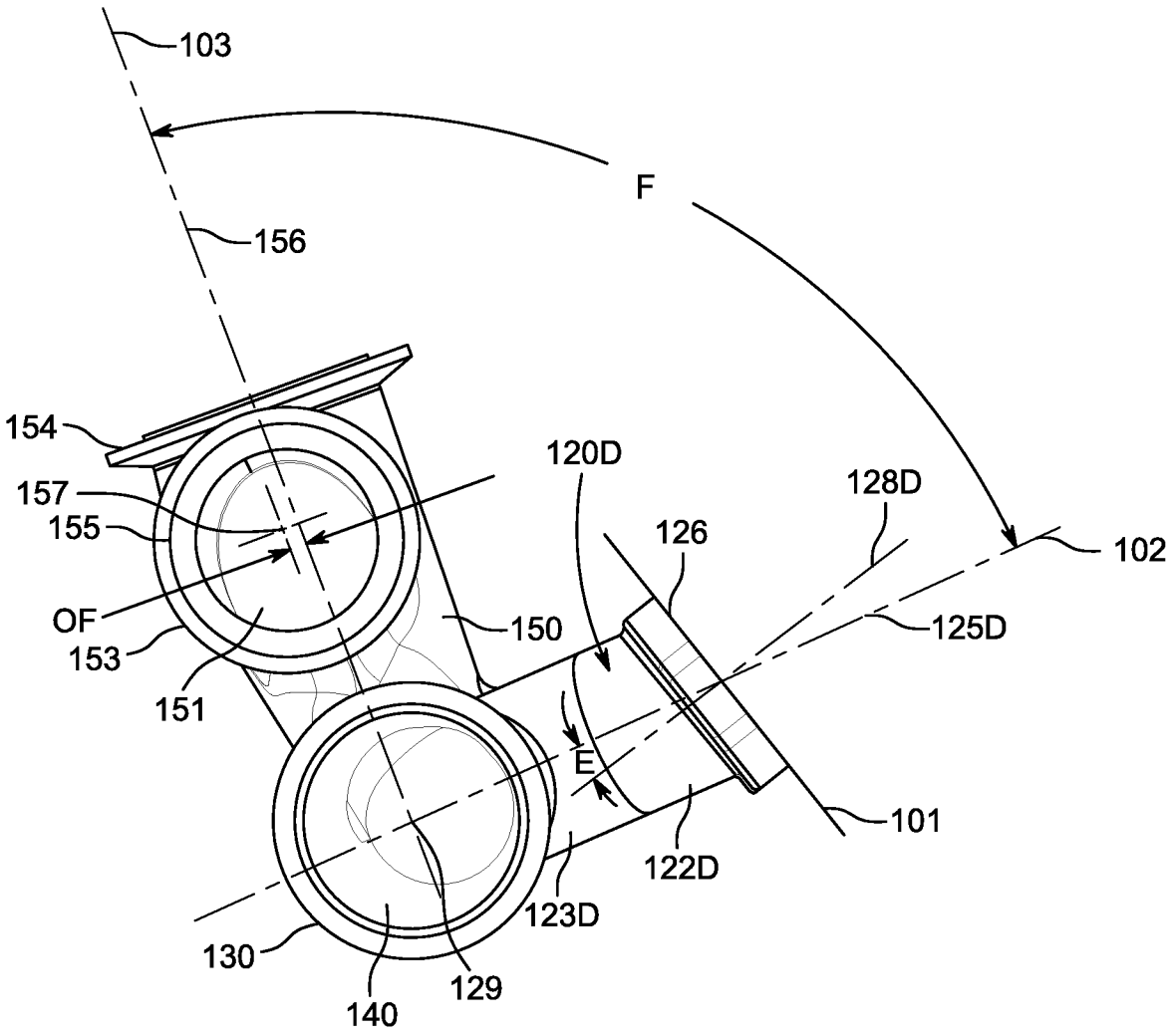
FIG. 8 is a rear view of the turbo exhaust manifold first utilized in the Stage 2 air intake-exhaust system of the present invention.
Figure 9:
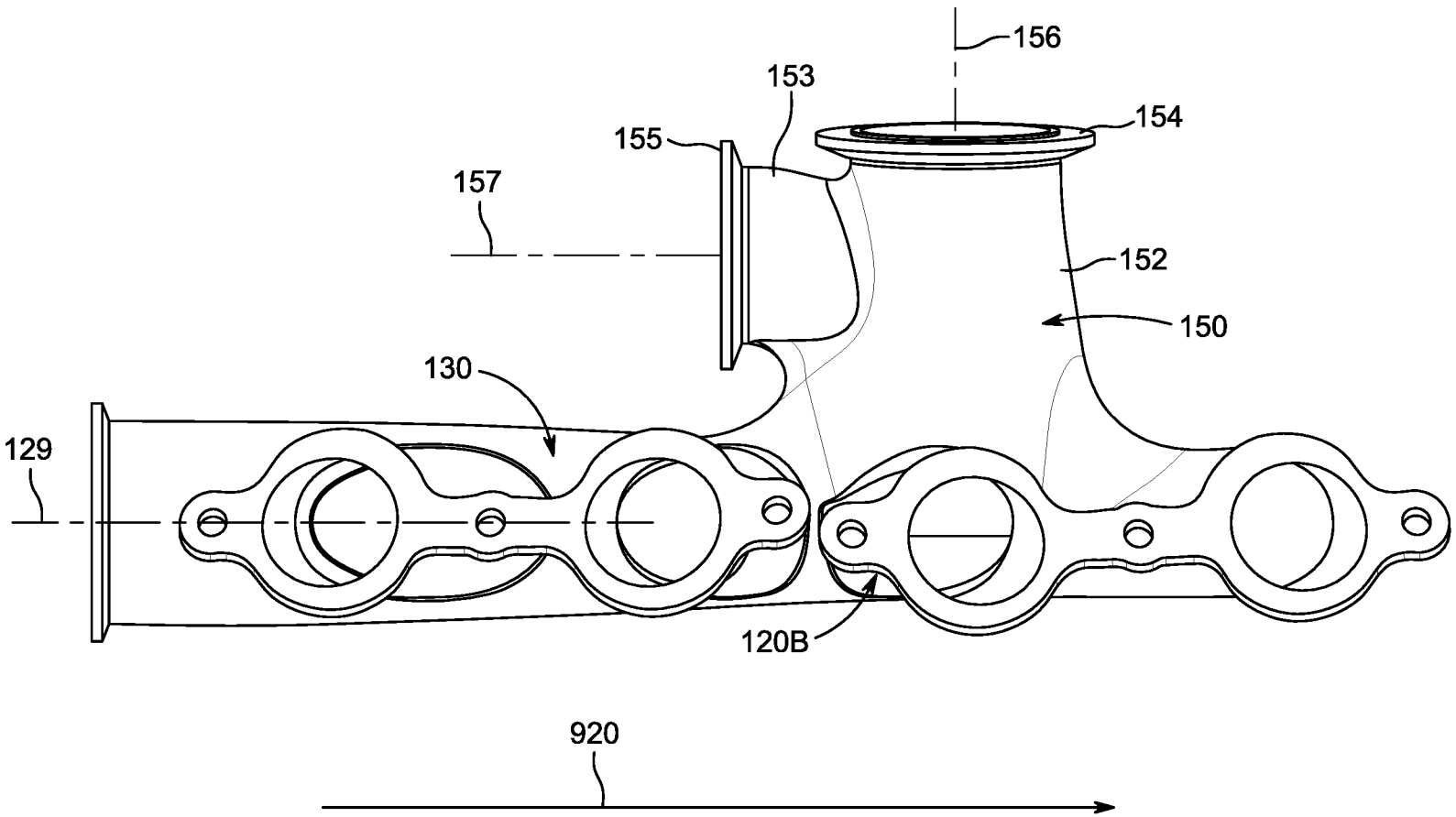
FIG. 9 is a side view of the turbo exhaust manifold first utilized in the Stage 2 air intake-exhaust system of the present invention.

Manifold plenum 130 has a generally cylindrical shape and a generally cylindrical wall, as shown in FIGS. 6 and 8, and is generally circular in cross-section, as shown for example in FIG. 8, with an axial centerline 129.

As shown for example in FIG. 7, the diameter of manifold plenum 130 can be varied along its length; for example, the diameter of manifold plenum 130 preferably increases from the forward end 134 of plenum 130 to the rearward end 135. This growth in diameter yields an expanding cylindrical volume from the forward end 134 to the rearward end 135. Further, it is preferred that the rate of diameter growth of manifold plenum 130 need not be constant, but start at zero at forward end 134, then grow at an increasing rate from forward end 134 up to approximately the mid-point between forward end 134 and rearward end 135, then grow at a decreasing rate from that mid-point up to rearward end 135, and again reach a zero growth rate at rear end 135. The result of changing the growth rate in this manner is to generally give an "S" shape to the cylindrical wall of manifold plenum 130 in profile, from forward end 134 to rearward end 135, as shown for example in FIG. 7. Put another way, the profile of manifold plenum 130 comes to be defined by an S-shaped curve rotated about the centerline 129 of plenum 130.

The forward end 134 of manifold plenum 130 (see FIG. 7) is closed off by a first exhaust stack assembly 120A that forms a passageway between the lead cylinder of the cylinder bank and manifold plenum 130. The rearward end 135 of manifold plenum 130 (FIG. 6) defines an exhaust gas passageway 140 at its rearward terminal portion. In the Stage 2 and Stage 3 configurations of the present invention, in which exhaust manifold 100 shown in FIG. 6 is connected to the one and only turbocharger 160 to be utilized with engine 700, exhaust gas passageway 140 is connected to receive exhaust gases from an exhaust manifold for the right cylinder bank of the engine, to supplement the exhaust gas flow to the turbocharger, as disclosed further below (see description of Crossover Pipe Assembly (190)). In the Stage 4 and 5 configurations, in which the exhaust manifold on the right cylinder bank of the engine connects to a second turbocharger 160, exhaust gas passageway 140 can be connected to its counterpart on the right side of the engine to provide exhaust pulse balancing with the goal of improving engine torque, particularly in the lower range of engine speed.

The length of manifold plenum 130, together with first exhaust stack assembly 120A, largely determines the overall length of turbo exhaust manifold 100. For V-configuration engines whose left and right cylinder bank discharge ports are offset (typically a consequence of utilizing crankshafts with crankpins arranged along the length of the crankshaft), it is preferred that the overall length of the turbo exhaust manifold 100 for one of the cylinder banks not be the same as the overall length of the turbo exhaust manifold 100 for the other of the cylinder banks.

Thus, referring to the turbo exhaust manifold 100 visible in FIG. 5A as 100L, and the turbo exhaust manifold not visible in FIG. 5A as 100R, it is preferred that the overall lengths of 100L and 100R (referred to herein as L100L and L100R; overall length L100L is explicitly shown in FIG. 7) differ an amount equal to the offset distance between the engine's left and right cylinder bank discharge ports, so as to result in the rearward ends 135 of each manifold plenum 130 of the turbo exhaust manifolds (100L and 100R) terminating approximately on the same transverse plane (i.e., they substantively satisfy Relationship A, described in connection with single outlet exhaust manifold 10, above). Further, this transverse plane preferably is the same transverse plane as it is preferred on which terminate the rearward ends 35 of single outlet exhaust manifolds 10L and 10R. For example, in the case of the LS3 model V-8 engine shown in FIG. 5A, the left cylinder bank is offset forward of the right cylinder bank. Thus for the turbo exhaust manifold 100 visible in FIG. 5A and shown for example in FIG. 6, L100L will be larger than L100R by an amount approximately equal to the cylinder bank offset distance.

Exhaust Stack Assemblies (120).

Exhaust stack assembly 120A is the forward most exhaust stack assembly, exhaust stack assembly 120B is immediately to the rear of 120A, exhaust stack assembly 120C is immediately to the rear of 120B, and exhaust stack assembly 120D is immediately to the rear of 120C, as shown for example in FIGS. 6 and 7.

Exhaust stack assemblies 120 are joined to manifold plenum 130 and channel exhaust gases from a cylinder bank (the left cylinder bank in FIG. 5A) into manifold plenum 130, which collects and channels the collected gases to exhaust gas assembly routing circuit 150.

Exhaust stack assemblies 120A, 120B, 120C and 120D each respectively comprises one of a leader pipe 122A, 122B, 122C and 122D (generically referred to as leader pipe 122) and one of exhaust connectors 123A, 123B, 123C and 123D (generically referred to as exhaust connectors 123). The portions of leader pipes 122 proximate the engine are joined to manifold flanges 124. In particular, in the embodiment shown in the figures there are two manifold flanges 124, one of which is joined to the forward two leader pipes 122A and 122B, and the other of which is joined to the rearward two leader pipes 122C and 122D. Alternative designs in accordance with the present invention include individual flanges 124 joining respective individual leader pipes 122, as well as a single flange 124 joining all leader pipes 122.

As shown in FIGS. 6 and 7, each of leader pipe 122A, 122B, 122C and 122D respectively has a centerline 125A, 125B, 125C and 125D (generically referred to as centerline 125). Centerlines 125, as well as the centerlines of exhaust connectors 123, preferably all are oriented to reside in the same geometrical plane 102 (FIGS. 6 and 8), which in the preferred embodiment also contains centerline 129 of manifold plenum 130. As discussed further below, plane 102 preferably is approximately horizontal in orientation when exhaust manifold 100 is joined to a conventionally mounted engine (however, centerlines 125 preferably are not parallel, as explained below). Each of leader pipes 122 has a generally circular diameter along the length of its respective centerline 125.

Manifold flanges 124 include engine-side generally planar mating surfaces 126, which form a relatively gas-tight seal when fastened to an engine, and additionally, which define a plurality of apertures 127 that permit turbo exhaust manifold 100 to be fastened (using nuts) to threaded studs extending from the cylinder bank of the engine. The portion of each of stack assemblies 120 distal from the engine is joined to manifold plenum 130, as shown for example in FIGS. 6 and 7.

The engine-side mating surfaces of manifold flanges 124 are oriented parallel to a plane 101, shown in FIG. 6 and edge-on in FIG. 8. An engine generally will have contact surfaces machined or formed on the engine in a region circumscribing the engine exhaust ports, in order to form a relatively gas-tight seal with appropriate portions of a manifold, which in this embodiment are the engine-side mating surfaces 126 of turbo exhaust manifold 100. For V-8 engines, those contact surfaces generally are inclined from the vertical, for example at an angle V equal to approximately one-half the angle subtended by the cylinder banks, as explained above.

In the present invention, it is preferred that the centerline 125 of each leader pipe 122, as well as the centerlines of exhaust connectors 123, be inclined upwardly at the same angle E from a line 128 orthogonal to plane 101, as exemplified by FIG. 8, which depicts this relationship for leader pipe 122D. In FIG. 8, the centerlines of exhaust connectors 123, as well as centerlines 125, collectively are contained in plane 102. The magnitude of angle E is determined so that geometrical plane 102 containing centerlines 125, and in turn exhaust stack assemblies 120, are generally horizontal when exhaust manifold 100 is joined to a conventionally mounted engine having an inclined cylinder bank. In some V-8 engine cases, angle E will be approximately the same as angle V, although the ultimate choice for angle E depends on the orientation of the specific engine contact surfaces.

In the embodiment shown in the drawings, and particularly as shown in FIG. 7, it is preferred that centerlines 125 not be parallel to each other, but rather be oriented forwardly or rearwardly so as to direct leader pipes 122 at least in part toward the junction of manifold plenum 130 with exhaust gas routing circuit 150, in order to facilitate the passage of exhaust gases to exhaust gas routing circuit 150 with reduced enthalpy loss, with the goal of improving engine performance. The amount of such forward and rearward orientation depends on the location of routing circuit 150 in manifold plenum 130, and may be limited in magnitude in view of structural considerations.

In particular, relative to flanges 124 and arrow 920 shown in FIG. 7, leader pipes 122A and 122B are oriented in a rearward direction, and leader pipes 122C and 122D are oriented in a forward direction. Referring to FIG. 7, it is preferred for the embodiment depicted in the drawings, which is suitable for an LS3 model 6.2 liter displacement V-8 engine (marketed by General Motors Corp.), that centerline 125A of leader pipe 122A be oriented rearwardly at an angle A equal in magnitude to an angle D at which centerline 125D of leader pipe 122D is oriented forwardly. It is particularly preferred that centerline 125A of leader pipe 122A be oriented rearwardly at an angle A of 15°, and that centerline 125D of leader pipe 122D be oriented forwardly at an angle D of 15°. It is also particularly preferred that centerline 125B of leader pipe 122B be oriented rearwardly at an angle B of 10°, and that centerline 125C of leader pipe 122C be oriented forwardly at an angle C of 10°.

In the embodiment shown in the drawings, the first exhaust connector 123A is a curved pipe of relatively uniform diameter, whereas the diameters of second, third and fourth exhaust connectors 123B, 123C and 123D increase with increasing distance from flanges 124, in order to permit the expansion of the exhaust gases along their length. This increase in diameter is for purposes of reducing cylinder backpressure and improving exhaust gas scavenging during the exhaust cycle. Leader pipes 122 are joined to flange fittings 124 via welding, brazing or by being integrally formed with flange fittings 24. Likewise, exhaust connectors 123A, 123B, 123C and 123D are joined to manifold plenum 30 via welding, brazing or by being integrally formed with manifold plenum 130, and leader pipes 122 are joined to exhaust connectors 123A, 123B, 123C and 23D via welding, brazing or by being integrally formed with connectors 123A, 123B, 123C and 123D.

The overall width of turbo exhaust manifold 100, denominated W100 in FIG. 7, is largely determined by the diameter of manifold plenum 130, together with the lengths of exhaust stacks 120 (coinciding with the distance between flanges 124 and manifold plenum 130). It is preferred that width W100 be as compact as exhaust gas flow, structural and service access considerations will permit, in order to yield a compact design.

It is additionally preferred that turbo exhaust manifold 100 be dimensioned so as to be generally interchangeable with single outlet exhaust manifold 10. In particular, turbo exhaust manifold 100 preferably has approximately the same dimensions as single outlet exhaust manifold 10 in the following respects: W100 should be about the same as W10; and angle E should be about the same as angle $\alpha$. As regards overall length, L100 should be about the same as L10 (and if Relationship A is followed for single outlet exhaust manifold 10, so should it be for turbo exhaust manifold 100).

It is also preferred that the rearward end 135 of turbo exhaust manifold 100 include means for coupling so as to facilitate the passage of exhaust gas through exhaust passageway 140 to and from other components. It is likewise preferred that this means for coupling be the same means for coupling as is used for rearward end 35 of single outlet exhaust manifold 10. In particular, if end 35 has a flanged connector 41, then rearward end 135 should be provided with like means, specifically flanged connector 141 shown in FIG. 6.

Exhaust Gas Routing Circuit (150).

As shown in FIGS. 6 and 8, exhaust gas routing circuit 150 is joined to manifold plenum 130 at a junction between turbocharger support column 152 of gas routing circuit 150 and manifold plenum 130, and exhaust gas routing circuit 150 (specifically turbocharger support column 152) extends from manifold plenum 130 in a generally perpendicular direction to centerline 129. The fore-and-aft location of exhaust gas routing circuit 150 on manifold plenum 130 depends on the engine, the amount of space available, the location, size and orientation of the turbocharger and other ancillary components, and like considerations. In the preferred embodiment, which is suitable for an LS3 model 6.2 liter displacement V-8 engine, exhaust gas routing circuit 150 is located toward the forward end of manifold plenum 130 proximate to exhaust stack assembly 120B, as shown for example in FIG. 9.

Turbocharger support column 152 in the preferred embodiment is generally circular in cross section about support column centerline 156, depicted in FIG. 6. Column centerline 156 in the preferred embodiment is contained in geometrical plane 103, which is shown in FIG. 6 and edge-on in FIG. 8; plane 103 also contains axial centerline 129 of manifold plenum 130. The angle F subtended by plane 102 and plane 103, shown in FIG. 8, preferably is determined by considerations such as locating the turbocharger as close to the engine as routing and service access considerations permit, as well as other factors pertinent to the Stage 4 configuration, discussed below in regard to FIG. 33.

In operation, exhaust gas passes from turbocharger support column 152 into turbocharger exhaust inlet 161 of turbocharger 160. Turbocharger support column 152 preferably has a diameter, thickness and robustness sufficient to hold up and support turbocharger 160, and resist road-induced stresses and shocks, without the need for additional supporting structures. Accordingly, in the preferred embodiment, support column 152 terminates in a means for coupling to a turbocharger 160, and for holding turbocharger 160 rigidly in place. For example, such means for coupling preferably comprises flanged connector 154, shown in FIG. 6, to which flanged connector 176 of turbocharger 160 is directly mounted with a suitable clamp or clamps, such as a V-band clamp 199, as shown in FIG. 12. Such flanged connections between turbocharger exhaust inlet 161 and turbocharger support column 152 also permits the centerline 159 of turbocharger 160 to be oriented parallel to engine crankshaft centerline 701. In the preferred embodiment, this orientation results in the flow direction through the compressed air outlet 165 generally being in a transverse plane and preferably directed approximately perpendicular to the incline of the cylinder bank of the turbo exhaust manifold 100 on which the turbocharger 160 is mounted.

It is desirable that the transition between manifold plenum 130 and turbocharger support column 152 be smooth and sufficiently radiused, with no sharp angles or edges, to minimize enthalpy losses associated with exhaust gas flow in the interior exhaust gas passageway to the turbocharger, and also to minimize stress crack generation.

Figure 10:
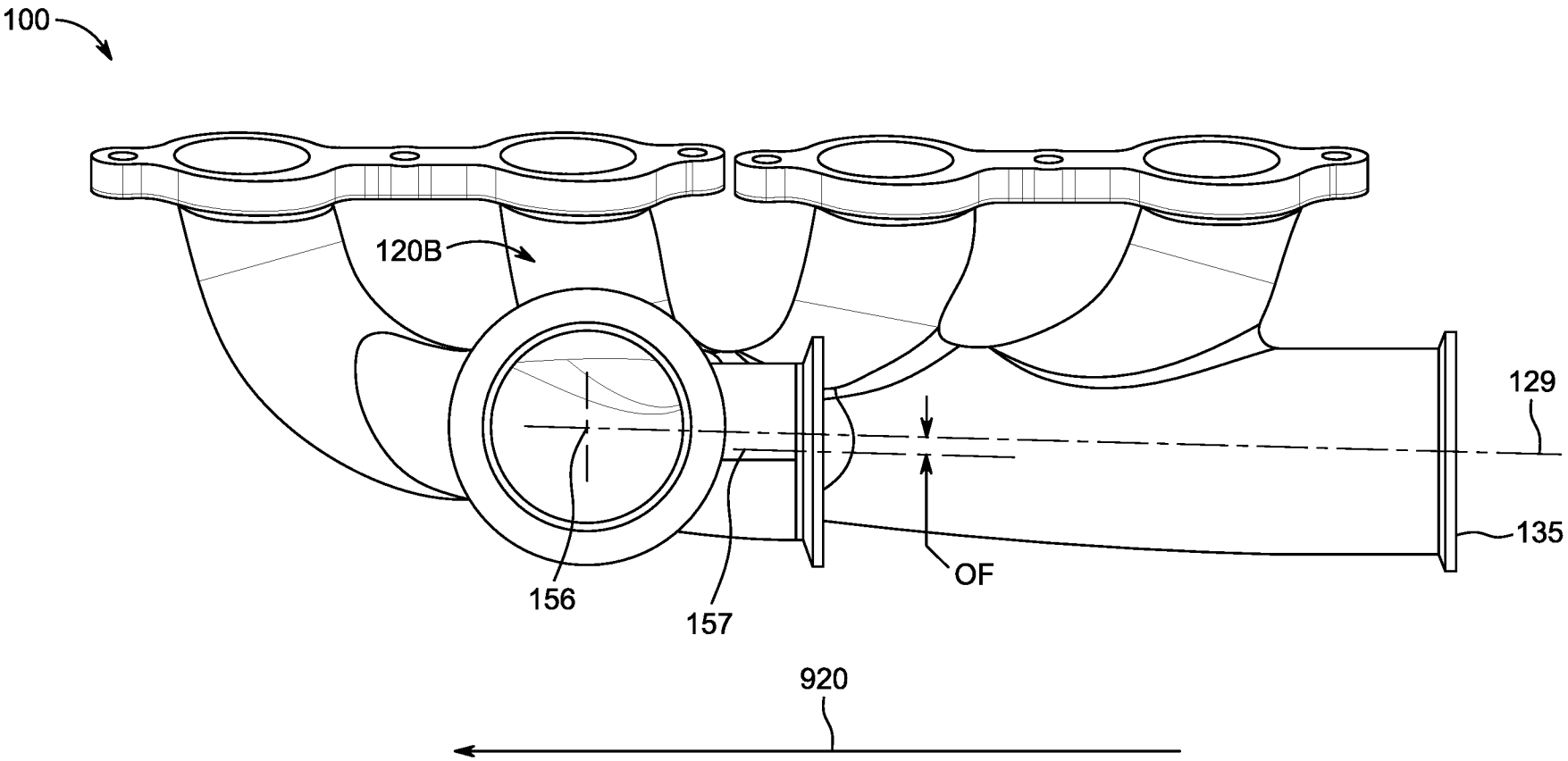
FIG. 10 is a top view of the turbo exhaust manifold first utilized in the Stage 2 air intake-exhaust system of the present invention.

Exhaust gas bypass pipe 153 in the preferred embodiment is generally circular in cross section about its axial centerline 157, depicted in FIG. 6 and end-on in FIG. 8. It is preferred that exhaust gas bypass pipe 153 be oriented in a generally perpendicular direction from and be secured to support column 152 at a junction forming a T-connection, as shown for example in FIG. 9. The location of bypass pipe 153 on support column 152 is determined based upon such factors as connection routing, service access, and cooperation with related components. In the preferred embodiment shown, exhaust gas bypass pipe 153 is rearwardly oriented, as shown for example in FIGS. 6 and 9, and the axial centerline 157 of exhaust gas bypass pipe 153 will be generally parallel to the crankshaft centerline 701 of engine 700. In one embodiment, the axial centerline 157 of exhaust gas bypass pipe 153 can be located in plane 103. In an alternate embodiment, the axial centerline 157 of exhaust gas bypass pipe 153 can be parallel to and offset from plane 103 a distance OF, as shown in FIGS. 8 and 10. The distance OF is determined by considerations such as locating the turbocharger as close to the engine as routing and service access considerations permit, as well as other factors pertinent to the Stage 4 configuration, discussed below in regard to FIG. 33. The design, location and orientation of exhaust gas bypass pipe 153, as shown in the figures and as described herein, provides a compact inline, three-tiered nested configuration consisting of the turbocharger 160, the bypass valve 186, and the manifold plenum 130.

In FIG. 6, exhaust gas bypass pipe 153 terminates in a bypass outlet 151 having means for coupling to an exhaust bypass valve 186. For example, such means for coupling preferably is a flanged connector 155, which is directly mounted to an exhaust bypass valve 186 with a suitable clamp or clamps, such as a V-band clamp 199. The provision of exhaust gas bypass pipe 153 yields a number of engine configuration options, such as for example more easily permitting use of different types and/or models of bypass valves over time, or locating the bypass valve remotely from the turbocharger, in accordance with preference. Should a turbocharger with an integral bypass be utilized, mount 155 can be capped and sealed off.

Turbocharger support column 152 of exhaust gas routing circuit 150 can be joined to manifold plenum 130 via welding, brazing or by being integrally formed with manifold plenum 130. Exhaust gas bypass pipe 153 of exhaust gas routing circuit 150 can be joined to turbocharger support column 152 in like manner. It is preferred that exhaust gas routing circuit 150 be integrally formed with manifold plenum 130, as by casting.

An exhaust manifold design generally corresponding to exhaust manifold 100 is described in U.S. Provisional Application No. 62/678,460 entitled "Turbo Exhaust Manifold with Turbine Bypass Outlet," filed May 31, 2018, the contents of which are hereby incorporated by reference as if fully set forth herein, including the aforementioned exhaust manifold design. Likewise, an exhaust manifold design generally corresponding to turbo exhaust manifold 100 is described in U.S. patent application Ser. No. 16/168,999, entitled "Turbo Exhaust Manifold with Turbine Bypass Outlet," having the same inventors as the subject application and filed on the same date as the subject application, the contents of which are hereby incorporated by reference as if fully set forth herein, including the aforementioned exhaust manifold design, found for example at paragraphs 14-48 and FIGS. 1-5 thereof.

Turbocharger Exhaust Circuit (175)

Turbocharger exhaust circuit 175 features the components for regulating the supply of hot exhaust gases to turbocharger 160. As shown in FIG. 12, turbocharger exhaust circuit 175 includes an exhaust tee 180 and a bypass valve 186 as its principal components.

FIG. 12 shows the exhaust tee 180, which includes a first tubular section 181 having an annular spent exhaust inlet 182 at one end and an annular discharge outlet 183 at the other end. Exhaust tee 180 additionally includes a second tubular section 184 connected to and defining a communicating connection with the first tubular section 181 at one end, and an annular bypassed exhaust inlet 185 at its second end. The second tubular section 184 is generally perpendicular to the first tubular section 181. The turbocharger exhaust gas outlet 162 is connected to the spent exhaust inlet 182 of exhaust tee 180. Inlet 182 is provided with means for coupling to turbocharger exhaust outlet 161, preferably a flanged connector 179, which is secured to flanged connector 177 of exhaust gas outlet 162 with a V-band clamp 199.

As shown in FIG. 12, bypass valve 186 has an annular bypass valve inlet 187 and an annular bypass valve outlet 188 oriented at a generally right angle and connected to the bypass valve inlet 187. Bypass valve inlet 187 is provided with means for coupling to exhaust gas bypass pipe 153, preferably a flanged connector 195, which is secured to flanged connector 155 of bypass outlet 151 with a V-band clamp 199. The bypass valve outlet 188 of the bypass valve 186 is connected to the bypass valve inlet 185 of the exhaust tee 180. Bypass valve outlet 188 of bypass valve 186, and bypass valve inlet 185 of exhaust tee 180, are each provided with means for coupling to the other, preferably a flanged connector 197 for inlet 185 and a flanged connector 196 for outlet 188, which are secured together with a V-band clamp 199.

The bypass valve 186 includes a spring-loaded relief valve that opens and closes a gas passageway between the bypass pipe inlet and the bypass outlet. The bypass valve 186 is used to regulate the control of exhaust gas through the turbocharger 160, and thereby control the boost pressure of the intake air. In normal operation, bypass valve 186 is in a closed condition, preventing substantially any exhaust gas flowing from exhaust gas bypass pipe 153 into exhaust tee 180. In such a state, substantially all exhaust gases from turbocharger exhaust manifold 100 flow through turbocharger support column 152 and into turbocharger 160 to power the air compressor of turbocharger 160. However, in certain situations, such as when the throttle valve assembly 702 is rapidly closed, the pressure within turbocharger exhaust manifold 100 can exceed the preset level of bypass valve 186. That excess pressure opens bypass valve 186, which causes a certain amount of exhaust gas to flow from exhaust gas bypass pipe 153 into exhaust tee 180, where it mixes with the spent exhaust gas from the turbocharger 160 for discharge into the atmosphere, either directly or through other components, such as noise reduction and/or pollution control components.

The design and arrangement of turbocharger exhaust circuit 175 in accordance with the preferred embodiment disclosed herein yields an efficient arrangement, with short connections between operative components and a compact overall package, with turbocharger 160 closely mounted to the engine and with exhaust tee 180 and bypass valve 186 located in the space between turbocharger 160 and the engine.

Stage 2 Turbocharger Air Circuit (170)

The Stage 2 turbocharger air circuit 170 features the components for supply compressed air from turbocharger 160 to engine intake manifold 710.

Figure 5B:
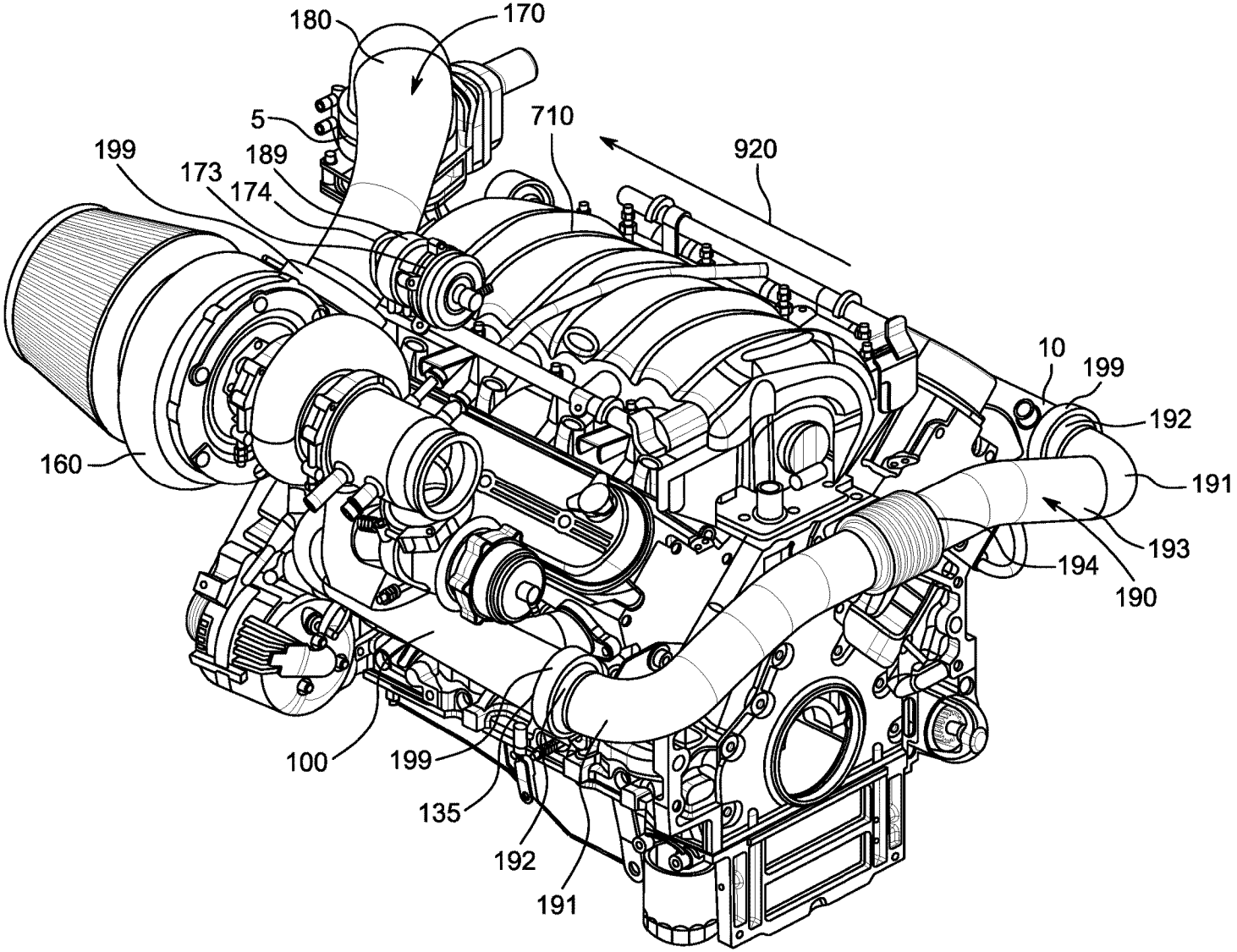
FIG. 5B is a schematic rear perspective view of a Standard Installation of the Stage 2 air intake-exhaust system of the present invention.

Referring to FIGS. 5A and 5B, the Stage 2 turbocharger air circuit 170 includes a Stage 2 air intake 180. Stage 2 air intake 180 comprises a curved pipe shaped to connect, at a first end, the Stage 2 air intake 180 to air intake connector 5, preferably with a T-bolt clamp 8, and to connect, at a second end, the Stage 2 air intake 180 to turbocharger compressed air outlet 165. The second end of Stage 2 air intake 180 is provided with means for coupling to compressed air outlet 165 of turbocharger 160, preferably a flanged connector (not visible) that is secured to flanged connector 178 of turbocharger 160 with a V-band clamp 199, visible in FIG. 5B. Between these first and second ends, Stage 2 air intake 180 is contoured to pass closely proximate the engine while being smoothly contoured, as shown in FIG. 5A.

Stage 2 air intake 180 includes a cylindrical connector 174 that defines an aperture 189 adapted to receive a blow-off valve 173, which is a spring-loaded cylindrical valve that will vent compressed air to the atmosphere above a selected pre-set pressure. The aperture for blow-off valve 173 is preferably positioned on Stage 2 air intake 180 so that the axis of valve 173 is oriented generally parallel to the axis 159 of turbocharger 160, to yield a more compact arrangement of components.

Crossover Pipe Assembly (190)

The function of crossover pipe assembly 190 in the Stage 2 configuration is to provide a passageway for the movement of exhaust gases from the single outlet exhaust manifold 10 to the turbo exhaust manifold 100. Referring to FIGS. 5A and 5B, crossover pipe assembly 190 includes two pipe elbows 191 connected by an intermediate piping assembly 193. Intermediate piping assembly 193 optionally includes a bellows joint 194 to lessen stresses that may arise from installation or operation.

The bend radii of the pipe elbows 191 preferably are the minimal approximate value that yields acceptably low risk of crack propagation during operation, so as result in the intermediate connecting pipe assembly 190 passing in close proximity to the engine 700, as illustrated in FIG. 5B.

The two pipe elbows 191 each terminate in a means for coupling. It is preferred that this means for coupling be the same means for coupling as is used for rearward end 35 of single outlet exhaust manifold 10 and rearward end 135 of turbo exhaust 100 to facilitate their connection. In particular, if end 35 has a flanged connector 41, and if end 135 has a flanged connector 141, then the terminal portion of each of the two pipe elbows 191 preferably is provided with a flanged connector 192. Furthermore, the flanged connectors 192 preferably have approximately the same dimensions as flanged connector 41 of single outlet exhaust manifold 10 and flanged connector 141 of turbo exhaust manifold 100.

Where the foregoing preferences are followed, the crossover pipe assembly 190 can be readily connected, using V-band clamps 199, to single outlet exhaust manifold 10 and/or turbo exhaust manifold 100 in any of the following three different connection configurations: crossover pipe assembly 190 connecting a left single outlet exhaust manifold 10L to a right turbo exhaust manifold 100R, crossover pipe assembly 190 connecting a left turbo exhaust manifold 100L connected to a right single outlet exhaust manifold 10R, and crossover pipe assembly 190 connecting a left turbo exhaust manifold 100L to a right turbo exhaust manifold 100R.

Stage 2 Configuration Design Preferences for Manifolds (10, 100)

As a general matter, it is preferred that the lengths L100L and/or L100R of turbo exhaust manifold 100 be selected so that, when taken in conjunction with the dimensions of pipe elbows 191, the crossover pipe assembly 190 clears the perimeter of engine 700 to which it will be proximate (in either a Standard Installation or a Reverse Installation), yet does not extend substantially beyond that perimeter of the end of the engine to which it will be proximate, so as to yield a compact installation package. Correspondingly, where it is desired to use a single outlet exhaust manifold 10 with a turbo exhaust manifold 100 in a Stage 2 configuration (and/or in a Stage 3 configuration as well), it is generally preferred that the length L10L or L10R be selected so that, when taken in conjunction with the dimensions of pipe elbows 191, the crossover pipe assembly 190 clears the perimeter of engine 700 to which it will be proximate (in either a Standard Installation or a Reverse Installation), yet does not extend substantially beyond that perimeter of the end of the engine to which it will be proximate, so as to yield a compact installation package.

Stage 2 Reverse Installation

FIGS. 5A and 5B depict turbo exhaust manifold 100 installed on engine 700 so that its rearward end 135 is proximate the rear of engine 700. When a Stage 2, 3, 4 or 5 engine configuration includes a turbo exhaust manifold 100 with this orientation, then that configuration is referred to herein as a "Standard Installation." However, in certain embodiments of the present invention, a turbo exhaust manifold 100 (and components connected to it) are installed on engine 700 rotated 180 degrees about the vertical direction relative to the Standard Installation orientation, such that the portions that are proximate the rear of engine 700 in the Standard Installation (furthest from the head of arrow 920) are instead proximate the front of engine 700 (closest to the head of arrow 920). Engine configurations having such orientations are referred to herein as a "Reverse Installation."

Figure 5C:
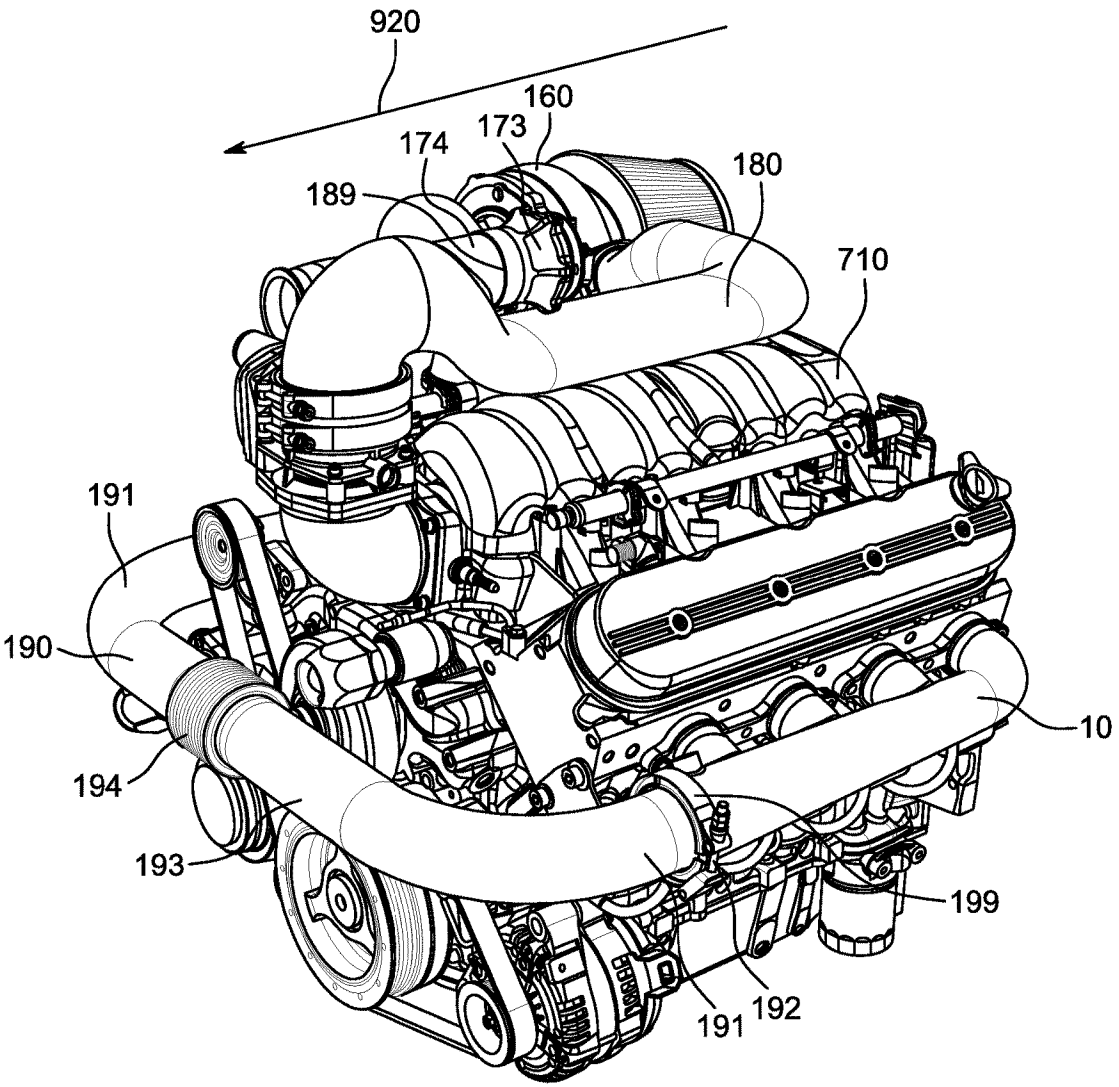
FIG. 5C is a schematic front perspective view of a Reverse Installation of the Stage 2 air intake-exhaust system of the present invention.

A Reverse Installation of the Stage 2 configuration is shown in FIG. 5C. In particular, the single outlet exhaust manifold 10, which is located on the right side of engine 700 in the Standard Installation shown in FIG. 5A, is rotated 180 degrees from the Standard Installation and installed on the left side of engine 700, as shown in FIG. 5C. In turn, turbo exhaust manifold 100, together with turbocharger 160 and turbocharger exhaust circuit 175, which are located on the left side of engine 700 in the Standard Installation shown in FIG. 5A, are rotated 180 degrees from the Standard Installation, with turbo exhaust manifold 100 being installed on the right side of engine 700.

As shown in FIG. 5C, the Stage 2 air intake 180 for a Reverse Installation has a different shape than in a Standard Installation, with air intake 180 oriented in substantial part in a longitudinal direction over the top of manifold 710, in order to accommodate the differing relative positions of air inlet 6 and turbocharger compressed air outlet 165. Otherwise, the Stage 2 air intake 180 for a Reverse Installation generally conforms to the specifications provided above in the description of Stage 2 air circuit 170. Cylindrical connector 174 preferably is repositioned in a Reverse Installation as shown in FIG. 5C to minimize the height of the Stage 2 configuration and maintain a compact package.

In a Reverse Installation of the Stage 2 configuration, crossover pipe assembly 190 passes across the front of engine 700 (closest to arrow 920), as shown in FIG. 5C. The exact shape of crossover pipe assembly 190 can differ between the Reverse Installation and the Standard Installation, in order to maintain close proximity of crossover pipe assembly 190 to the rear or front of engine 700, while standing clear of engine appurtenances that are specific to that installation orientation.

Upgrading from a Stage 1 Configuration to a Stage 2 Configuration

An engine having the Stage 2 configuration (in either a Standard Installation or a Reverse Installation) can be obtained by replacing a relatively small number of principal components of an engine 700 having a Stage 1 configuration, and adding a relatively small number of principal components. More specifically, to yield a Stage 2 configuration, the following principal components are removed from an engine 700 having a Stage 1 configuration: the dual rams-horn air intake 2 and their air filters 4; and one of the single outlet exhaust manifolds 10; and the following principal components are added to the engine 700: a turbo exhaust manifold 100, a turbocharger exhaust circuit 175, a Stage 2 air intake 180 and a crossover pipe assembly 190. The single outlet exhaust manifold 10 can be removed from either side of the engine without preference, provided it is replaced with a turbo exhaust manifold 100 intended for the same side. For convenience of reference in the descriptions of Stage 2 above and in Stage 3 following, it is assumed that it is manifold 10, visible in FIG. 1 on the left-hand side of an engine 700 having a Stage 1 Standard Installation, that is removed to obtain the Stage 2 configuration.

Stage 3 Configuration

Figure 13A:
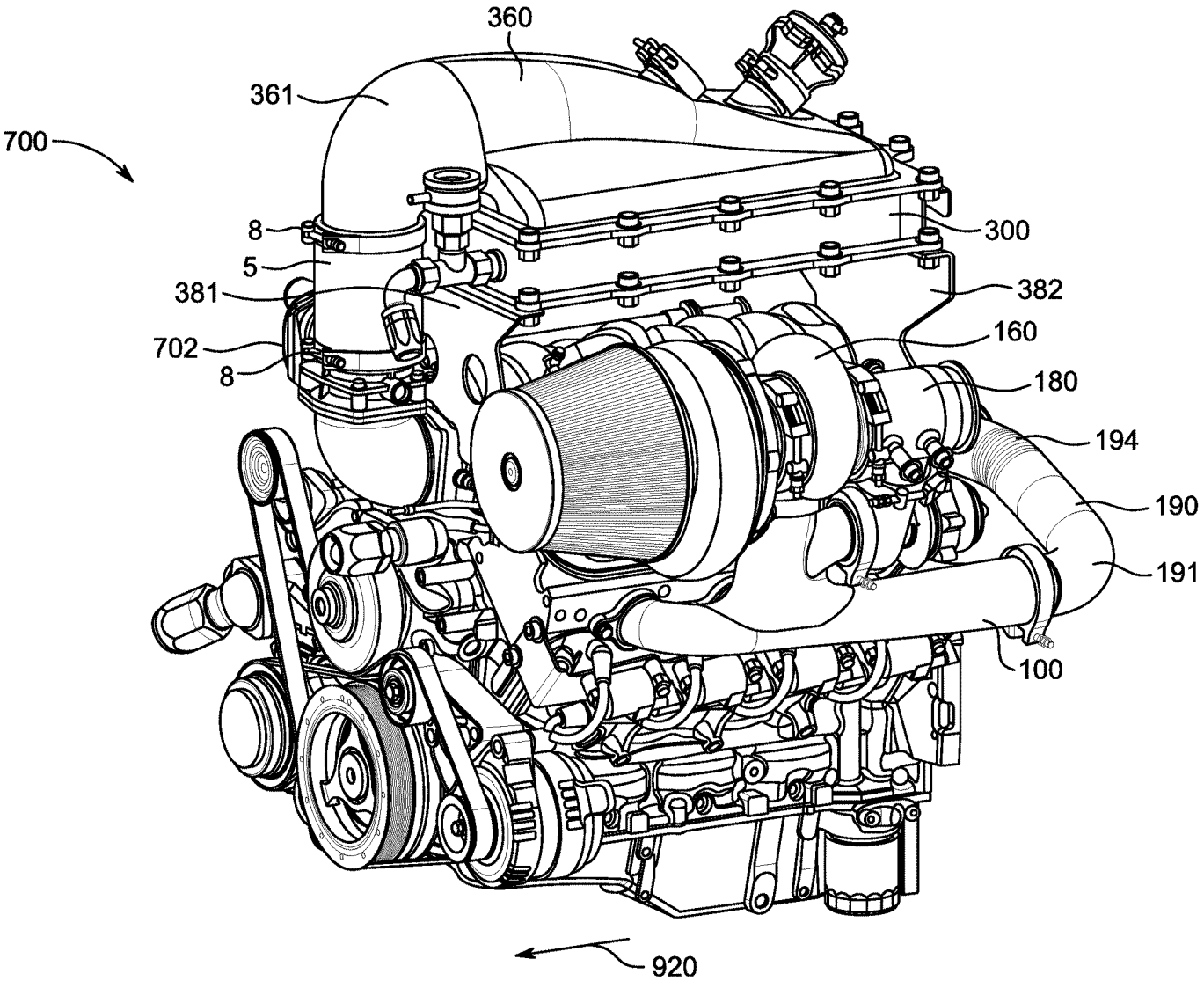
FIG. 13A is a schematic perspective front view of a Standard Installation of the Stage 3 air intake-exhaust system of the present invention.

Stage 3 is an engine configuration developing even more power than in Stage 2. The Stage 3 configuration is depicted in FIG. 13A, and includes an intercooler 300 mounted on the engine. The function of the intercooler is to cool the input air delivered by turbocharger 160, thereby increasing the density of the air received by each cylinder in its intake stroke, which in turn increases the force on the piston during combustion to increase engine power.

The principal components first utilized in Stage 3 are the intercooler 300, a single channel air inlet 320, and an air outlet 360, each described below.

Intercooler (300)

Figure 14:
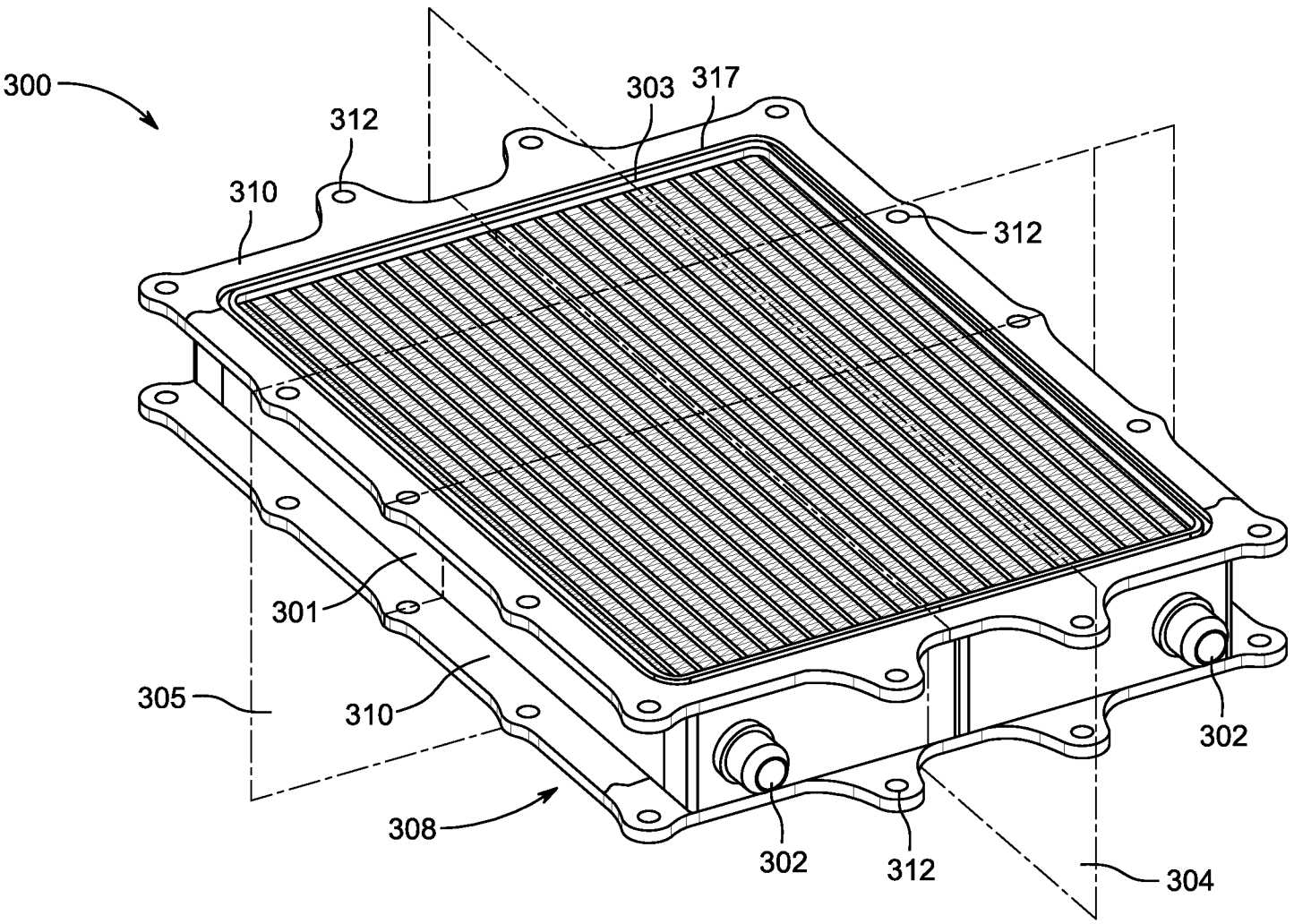
FIG. 14 is a perspective view of the intercooler first utilized in the Stage 3 air intake-exhaust system of the present invention.
Figure 15:
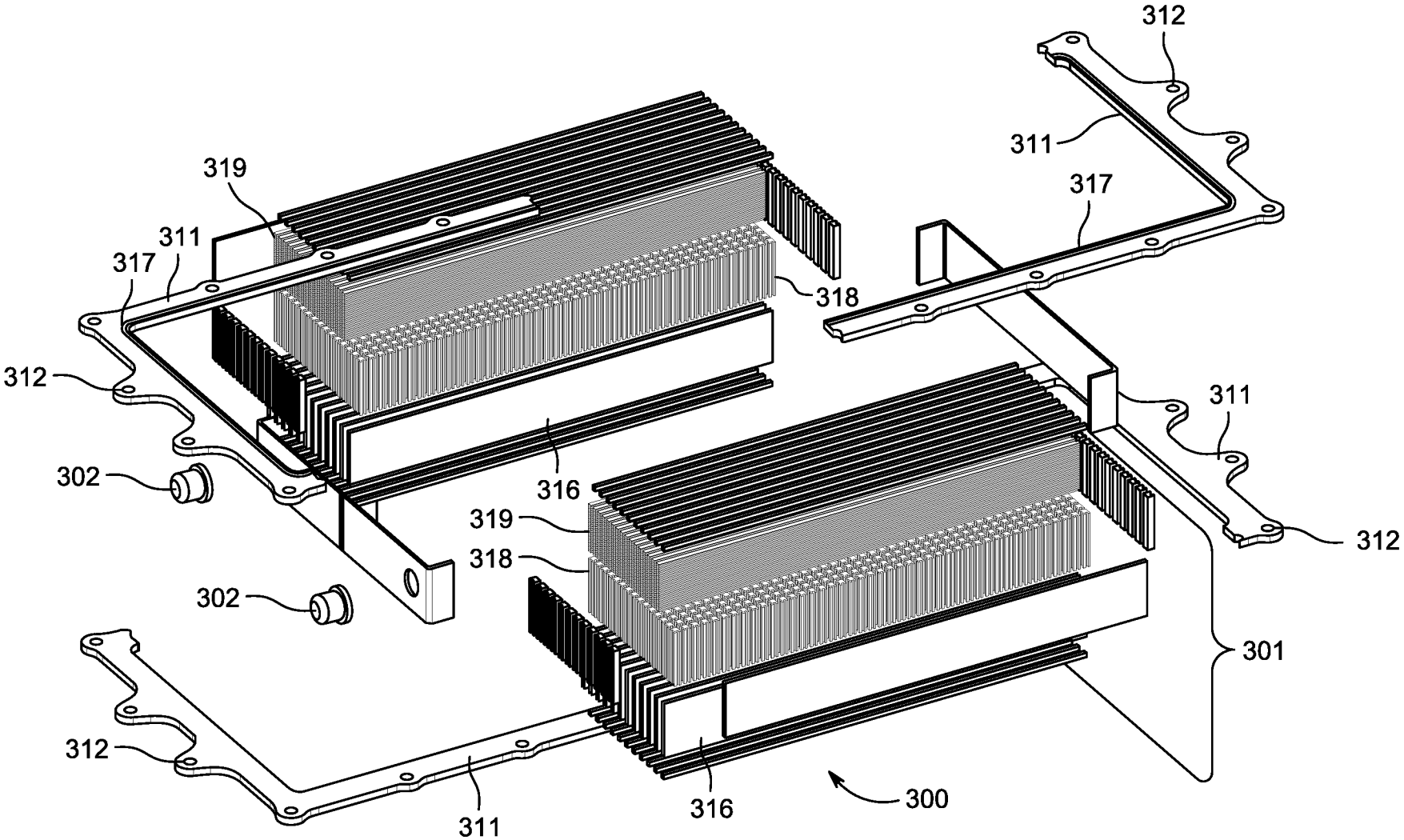
FIG. 15 is an exploded perspective view of the intercooler first utilized in the Stage 3 air intake-exhaust system of the present invention.

FIGS. 14 and 15 show an intercooler 300 in accordance with the present invention. In general, intercooler 300 in the preferred embodiment is a rectangular cuboid, with two opposing faces and four sides (in this disclosure, "rectangular" includes square shapes). In FIG. 14, there is a geometric plane 304, which evenly divides intercooler 300 in one direction (referred to as the "longitudinal" direction for convenience of reference), and a geometric plane 305, which evenly divides intercooler 300 in a second direction, perpendicular to the longitudinal direction (referred to as the "transverse" direction herein for convenience of reference).

The intersection of these two planes from time to time may be referred to herein as the "vertical" direction for convenience of reference.

There is additionally a third geometric plane 306 (not shown), which is perpendicular to planes 304 and 305, and may be referred to from time to time herein as the "horizontal" plane for convenience of reference. In this disclosure, the "plan" view of intercooler 300 refers to a view parallel to this horizontal geometric plane 306. In the case where intercooler 300 is not square in plan view (i.e., where one side is longer than an adjacent side), for reference purposes in this disclosure the longer side will be deemed to lie in the longitudinal direction, and the shorter side in the transverse direction.

Intercooler 300 includes a heat exchanger core 301 and two rectangular mounting flange structures, namely intercooler flange assemblies 310, one of which is secured to a first face 303 of intercooler core 301 about its periphery, and the other of which is secured to the second opposing face 308 (not visible in FIG. 14) of intercooler core 301 about its periphery. Faces 303, 308 generally are parallel to each other. Two fittings 302 are also provided for the ingress and egress of coolant.

The air to be cooled flows through the intercooler 300, entering through one face 303 or 308 of intercooler 300 and exiting through the other opposing face 303 or 308 of intercooler 300. The coolant flows generally in a plane perpendicular to the air flow, entering intercooler core 301 through one of fittings 302, passing between the faces 303, 308 of intercooler 300 to cool the air, and exiting intercooler core 301 through the other of fittings 302. The coolant preferably is liquid, and more preferably water, with or without an additive to increase the liquid state temperature range, such as ethylene glycol.

The heat exchanger core 301 utilizes a plate and bar structure, shown in exploded form in FIG. 15. In particular, the heat exchanger core 301 has a multi-layer structure of plural air fin sections 318 interleaved with plural water fins 319, where the individual air fins and water fins are separated by flow isolation sheets 316 interposed between them. Heat exchanger core 301 preferably is fabricated from aluminum or like material of relatively high thermal conductivity.

It is preferred that each of the intercooler flange assemblies 310 secured about the periphery of faces 303, 308 be substantially identical in design to the other. It is further preferred that each intercooler flange assembly 310 comprises two intercooler flange L-components 311. Referring to FIG. 15, each intercooler flange L-component 311 is L-shaped, and preferably is identical in size and geometry to the other L-components, so that when one L-component 311 is paired with another such L-component 311, they together form an intercooler flange assembly 310 in the form of a rectangular peripheral frame, which is joined to a face (303 or 308) of heat exchanger core 301 about its periphery.

The intercooler flange assemblies 310 can be fabricated from aluminum plate stock or the like, and are fastened by brazing, welding or the like to the opposing faces 303, 308 of a heat exchanger core 301, about their peripheries, to form an intercooler 300. Splitting each intercooler flange assembly 310 into two L-components 311 yields fabrication economies; i.e., multiple intercooler flange L-components 311 can be laid out, one against the other, and cut from one sheet, whereas cutting an intercooler flange assembly 310 as a one piece component leaves a large central cut-out, which may uneconomically need to be discarded. Further, any L-component 311 can be used on any of the four possible positions bounding the heat exchanger core 301.

Each intercooler flange assembly 310 preferably has plural spaced-apart bolt apertures 312 for receiving threaded bolts 314. It is additionally preferred that the bolt pattern for the intercooler flange assembly 310 affixed about the periphery of face 303 have the same bolt pattern as the intercooler flange assembly 310 affixed about the periphery of face 308.

It is additionally preferred that the bolt apertures 312 be symmetrically arranged about intercooler flange assembly 310. That is, referring to FIG. 14, it is preferred that the bolt pattern be symmetrically arranged to each side of longitudinal plane 304, and additionally be symmetrically arranged to each side of transverse plane 305. With these symmetric relationships, if the intercooler has a rectangular configuration, the bolt pattern presented in plan view is the same whether the intercooler is in its original orientation, or is rotated 180 degrees, or is flipped over. Likewise, if the intercooler has a square configuration, the bolt pattern presented in plan view with symmetrically arranged bolt apertures is the same whether the intercooler is in its original orientation, or is rotated 90 degrees, or is flipped over.

Single Channel Air Inlet (320)

Figure 16:
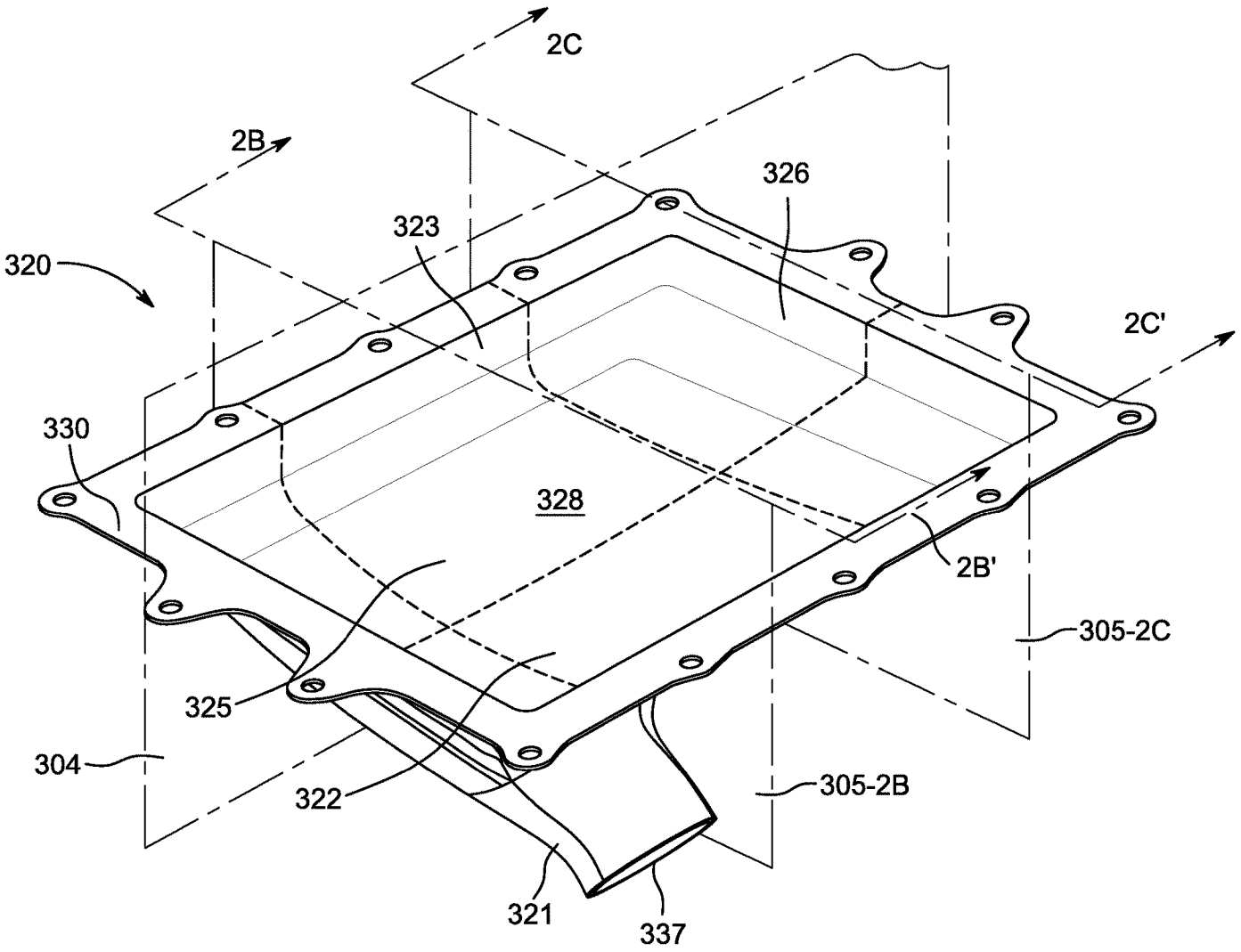
FIG. 16 is a perspective view of a single channel air inlet utilized in the Stage 3 air intake-exhaust system of the present invention.

FIG. 16 shows a single channel air inlet 320 for delivery of compressed air from turbocharger 160 to intercooler 300. Single channel air inlet 320 includes an air inlet pipe 321, an air inlet plenum 322 and an air inlet flange 330. Single channel air inlet 320 is adapted to be joined to intercooler 300 to form a unitary assembly, as described below.

Figure 20:
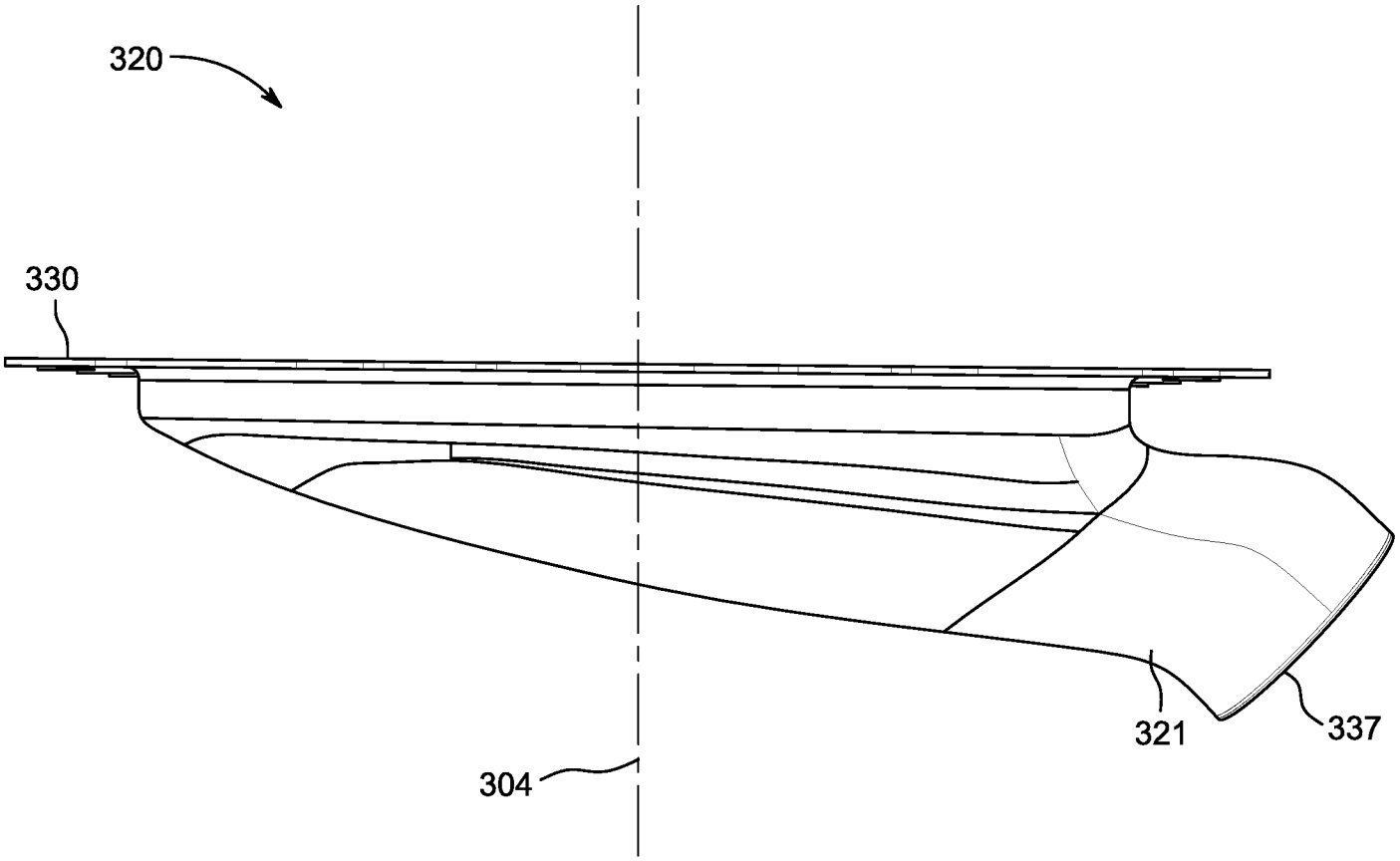
FIG. 20 is a front view of the single channel air inlet shown in FIG. 16.

Single channel air inlet 320 is configured to deliver air across one face (303 or 308) of intercooler 300. In the preferred embodiment, longitudinal plane 304 in FIG. 16 evenly divides air inlet 320 in plan view, and is approximately or exactly coplanar with longitudinal plane 304 in FIG. 14 that evenly divides intercooler 300. The intercooler 300/single channel air inlet 320 assembly in the preferred embodiment is particularly adapted to be positioned and mounted over the intake manifold 710 of engine 700, with longitudinal plane 304 being approximately or exactly coplanar with longitudinal plane 104 shown in FIG. 1. For this mounting position, it is preferred that air inlet 320 be configured so that longitudinal plane 304 does not evenly divide inlet pipe 321; rather, as shown for example in FIG. 20, inlet pipe 321 is positioned to one side of longitudinal plane 304 (shown on edge in FIG. 20). Such side positioning allows inlet pipe 321 to be closer to compressed air outlet 165 of turbocharger 160, thereby yielding a tighter and more compact engine accessory package. For the same reason, the centerline of inlet pipe 321 is generally transversely oriented, so that its inlet aperture 337 is positioned to one side of air inlet 320. Air flows in a generally transverse direction through inlet pipe 321 into plenum 322.

Figure 17:
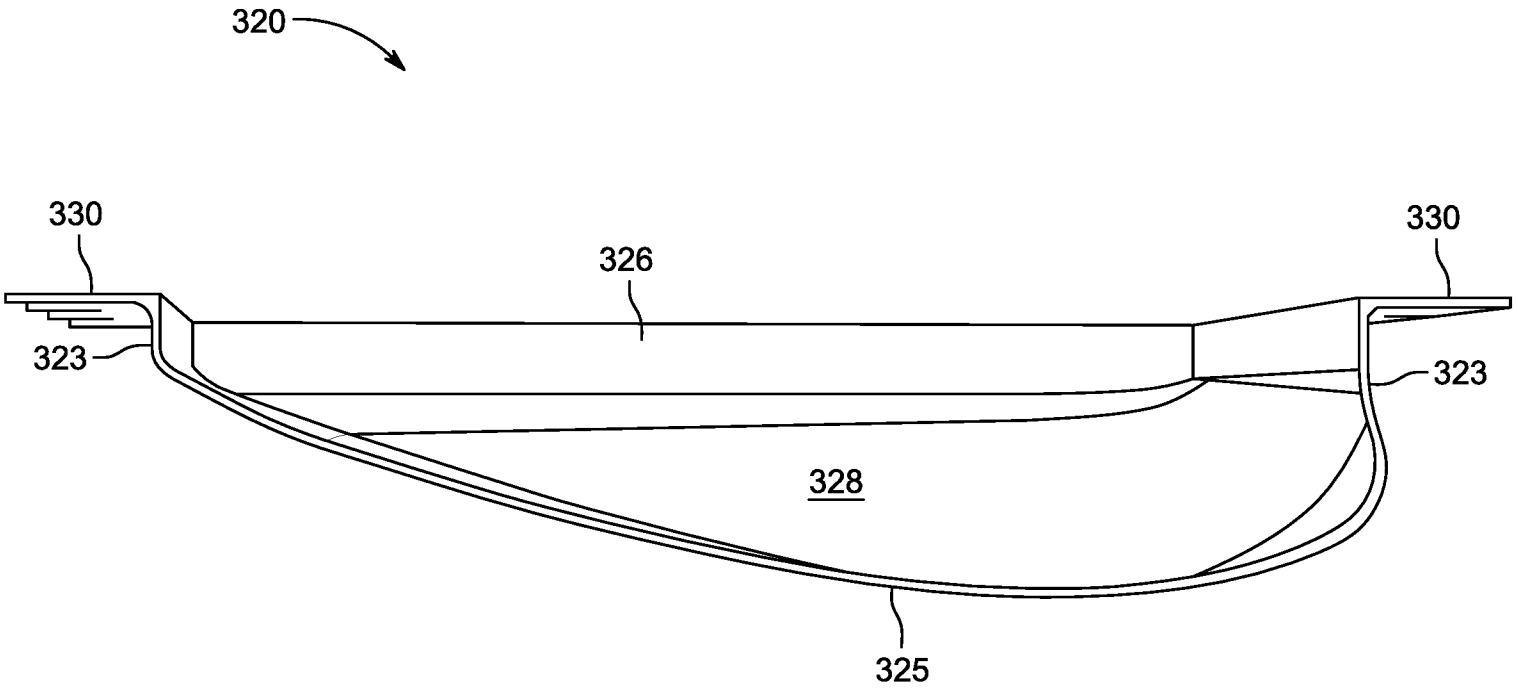
FIG. 17 is a view of the single channel air inlet shown in FIG. 16 which is sectioned on geometrical plane 305-2B and viewed as shown by section line 2B-2B'.
Figure 18:
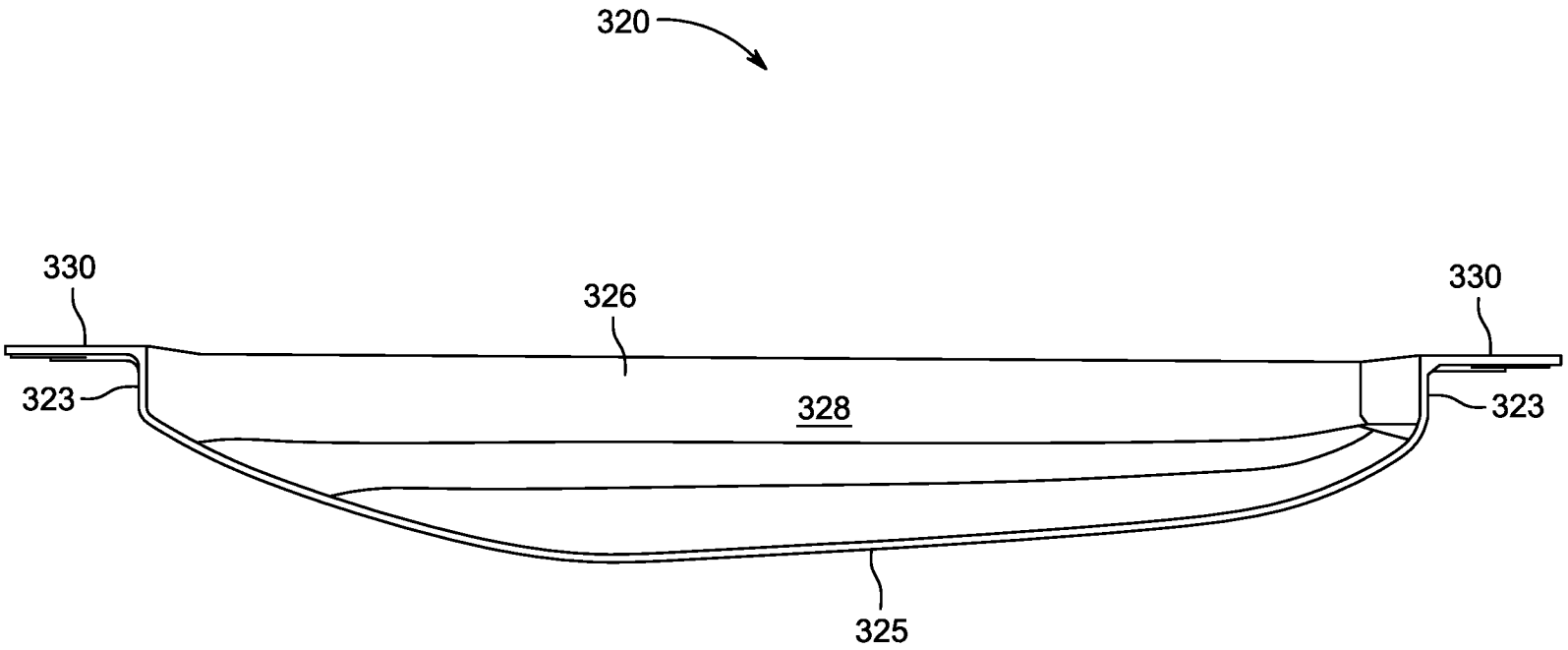
FIG. 18 is a view of the single channel air inlet shown in FIG. 16 which is sectioned on geometrical plane 305-2C and viewed as shown by section line 2C-2C'.

Plenum 322 is internally contoured to transition the transverse air flow from inlet pipe 321 to flow across the receiving face (303 or 308) of intercooler 300. Plenum 322 comprises four sidewalls (two longitudinal sidewalls 323, two transverse sidewalls 326), which are joined by a glacis 325. Sidewalls 323, 326 and glacis 325 together define an inlet plenum cavity 328 whose transverse cross-sectional area is greatest proximate to inlet pipe 321, least distal from inlet pipe 321, and which smoothly decreases between these two regions, as can be seen from FIGS. 16, 17 and 18. The transverse cross-section of inlet plenum cavity 328 at any longitudinal point is generally not symmetric about longitudinal plane 304, as is exemplified by FIGS. 17 and 18, but rather is shaped with the goal of inducing the air to be distributed across the receiving face (303 or 308) of intercooler 300 more evenly, minimizing or even eliminating areas of low air flow through the receiving face, while at the same time accommodating the particular shape and positioning of inlet pipe 321 and more generally maintaining the intercooler 300/single channel air inlet 320 assembly as a compact package. In general, plenum cavity is deeper adjacent inlet pipe 321 than distal from inlet pipe 321.

It is preferred that air inlet flange 330 of single channel air inlet 320 be substantially identical in size and geometry to intercooler flange assembly 310, and have the same pattern of bolt apertures as intercooler flange assembly 310. Accordingly, air inlet flange 330 can be bolted to either of the two intercooler flange assemblies 310 of an intercooler 300.

Figure 19:
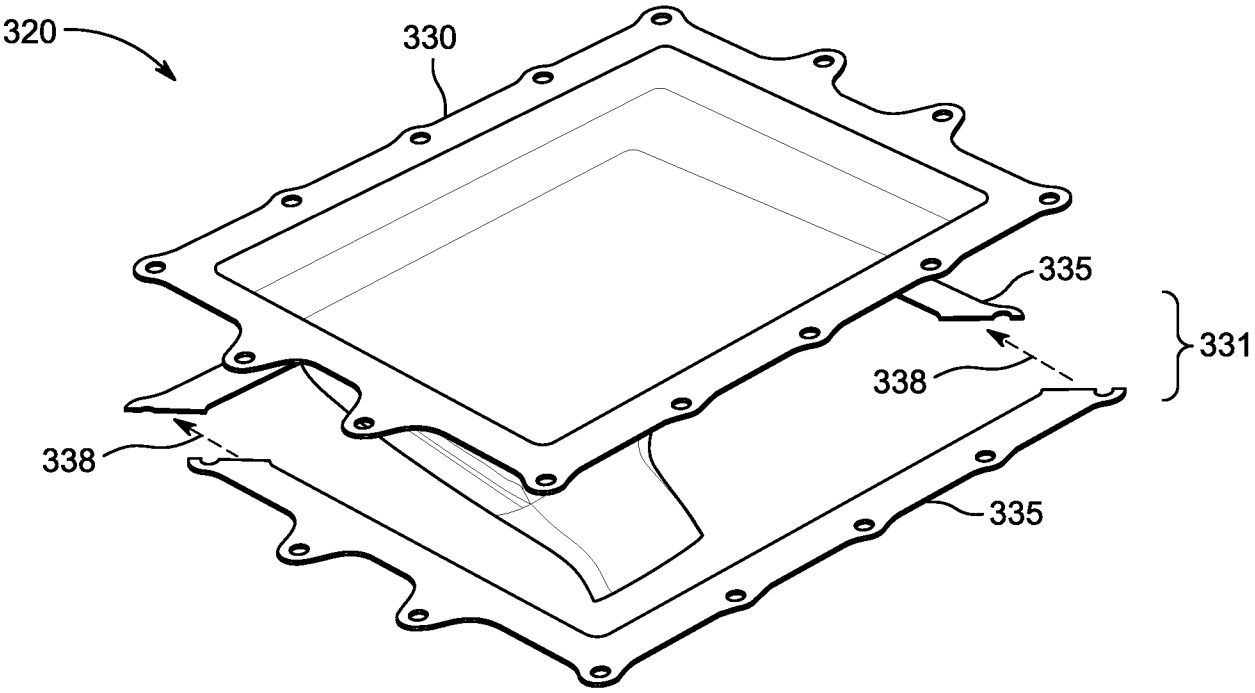
FIG. 19 is a perspective view of the single channel air inlet shown in FIG. 16 and its inlet seal assembly.

There is optionally provided an inlet seal assembly 331 to facilitate securing air inlet 320 to intercooler 300. It is particularly preferred that inlet seal assembly 331 includes two inlet seal L-components 335. As shown in FIG. 19, each inlet seal L-component 335 is L-shaped, and preferably is identical in size and geometry to the other inlet seal L-component 335, so that when one such L-component 335 is paired with another such L-component 335 (arrows 338 in FIG. 19), they together form an inlet seal assembly 331 in the form of a rectangular frame. Splitting the inlet seal assembly 331 into L-shaped components 335 yields fabrication economies, as described above in regard to intercooler flange assembly 310 and intercooler flange L-components 311. Inlet seal assembly 331 preferably has the same pattern of bolt apertures as both intercooler flange assembly 310 and air inlet flange 330.

Single channel air inlet 320 can be fabricated from sheet metal, such as steel or aluminum, either from a single piece of stock or from multiple pieces then assembled and fastened together, such as by riveting, brazing or welding. Alternatively, air inlet 320 can be fabricated from plastics such as HDPE, or from composite materials such as temperature-resistant fiberglass/fiberglass resin, carbon fiber, Kevlar and others. The inlet seal L-components 335 are preferably fabricated from aluminum plate stock or the like.

Figure 25:
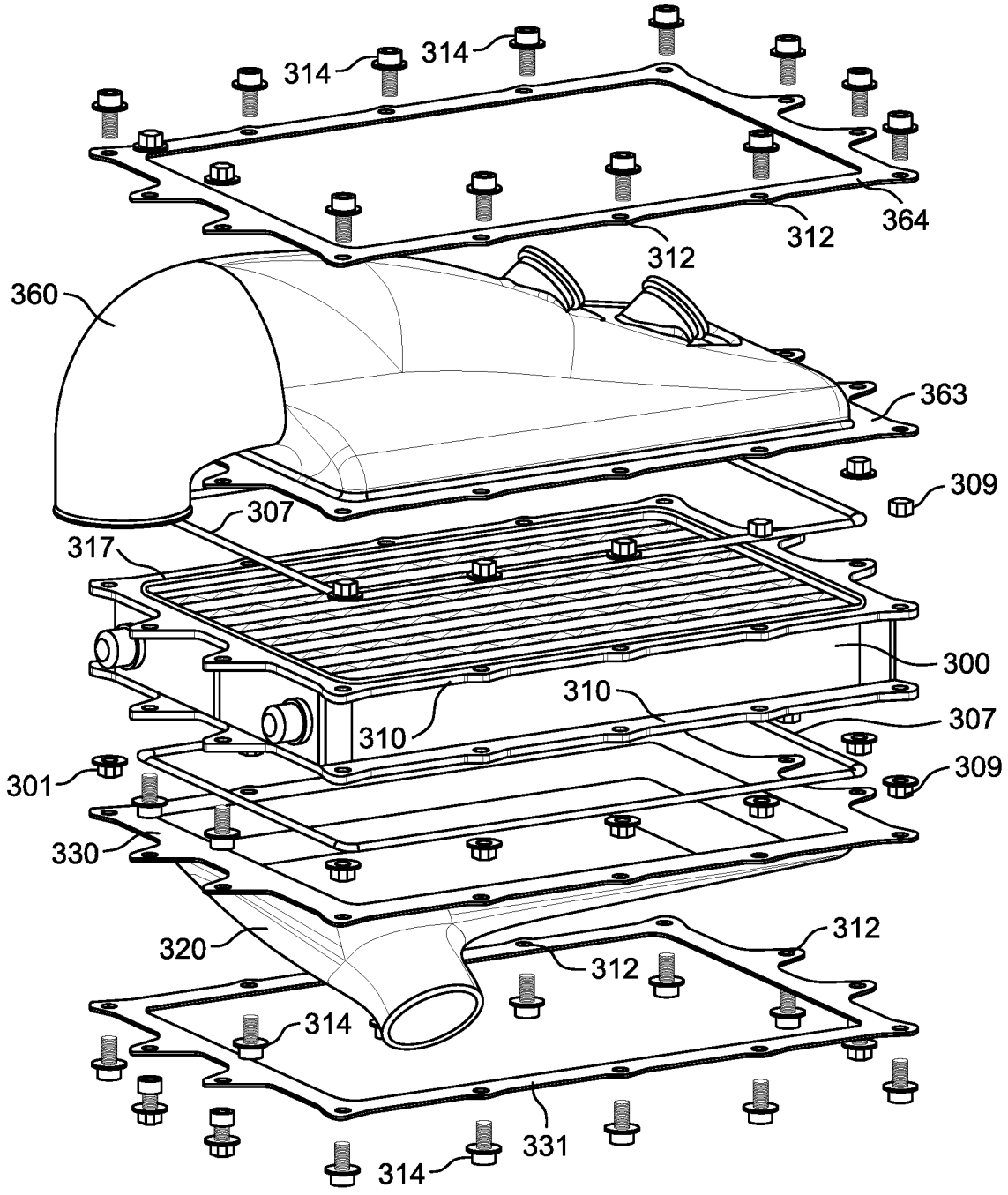
FIG. 25 is an exploded perspective view of a configuration of the intercooler system assembly utilized in the Stage 3 air intake-exhaust system of the present invention.

With reference to FIG. 25, the preferred embodiments of intercooler 300 and single channel air inlet 320 are assembled by positioning air inlet flange 330 between an inlet seal assembly 331 and one of the two intercooler flange assemblies 310 of intercooler 300; following which inlet seal assembly 331 and the selected intercooler flange assembly 310 are urged together, such as by means of nuts 309 and bolts 314, to yield a unitary air inlet/intercooler system. Inlet seal assembly 331 distributes the compressive joinder loads around the periphery of air inlet flange 330 to provide a better seal than would be attained by using bolts alone creating pressure points at discrete locations along air inlet flange 330. A resilient sealing gasket, component or structure may additionally be interposed between air inlet flange 330 and intercooler flange assembly 310 to contribute to sealing. For example, FIG. 14 shows an optionally provided sealing groove 317 on the exterior face of each intercooler flange assembly 310 for receiving an O-ring 307 and yielding a relatively air-tight seal between intercooler 300 and air inlet 320.

Air Outlet (360)

Figure 21:
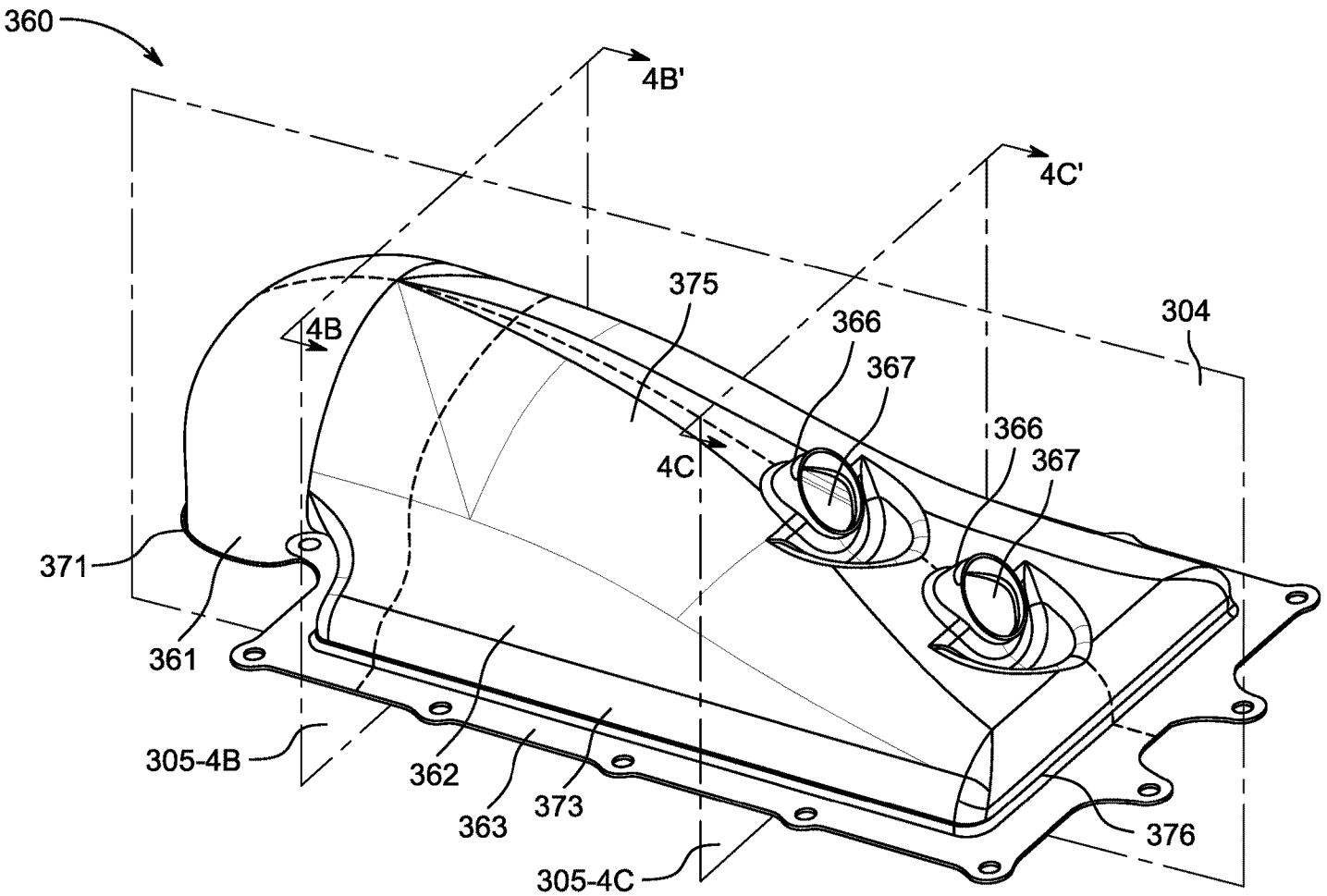
FIG. 21 is a perspective view of an air outlet first utilized in the Stage 3 air intake-exhaust system of the present invention.
Figure 22:
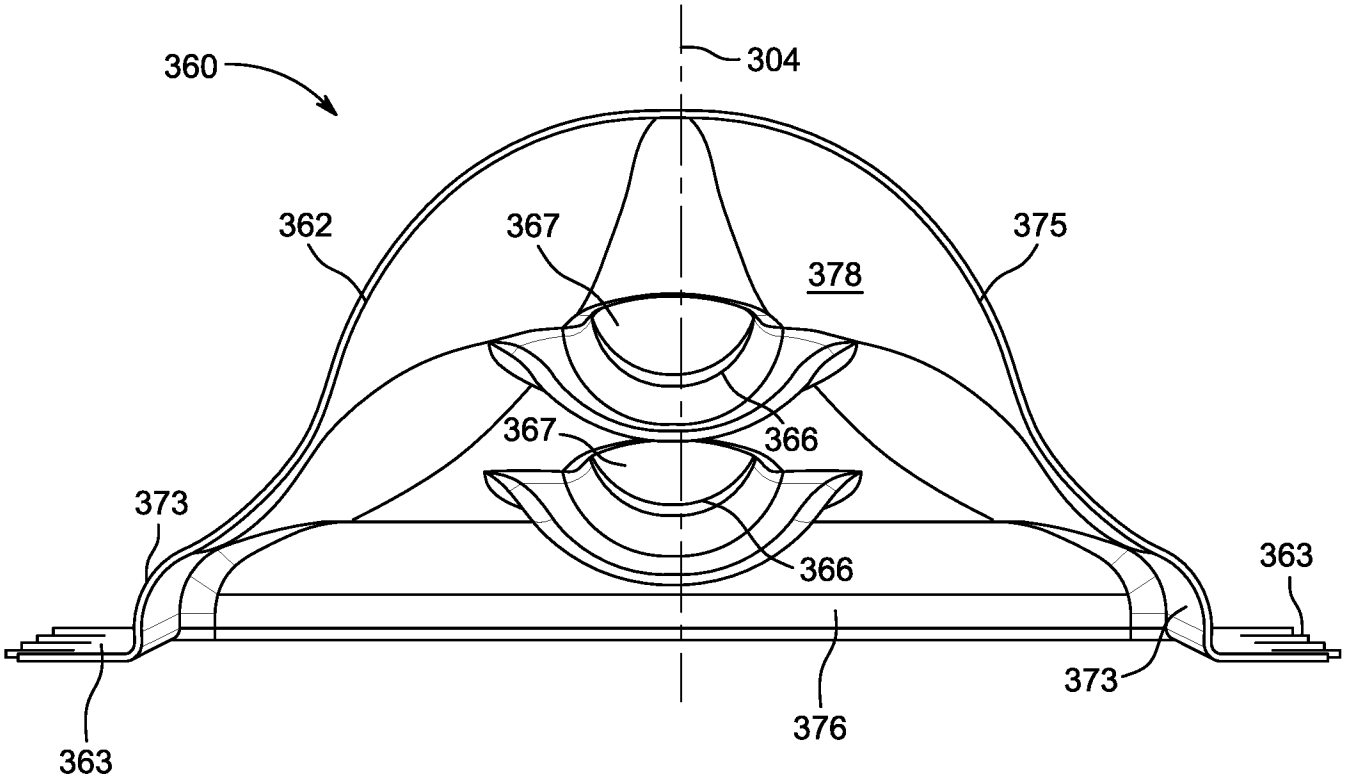
FIG. 22 is a view of the air outlet shown in FIG. 21 sectioned on geometrical plane 305-4B and viewed as shown by section line 4B-4B'.
Figure 23:
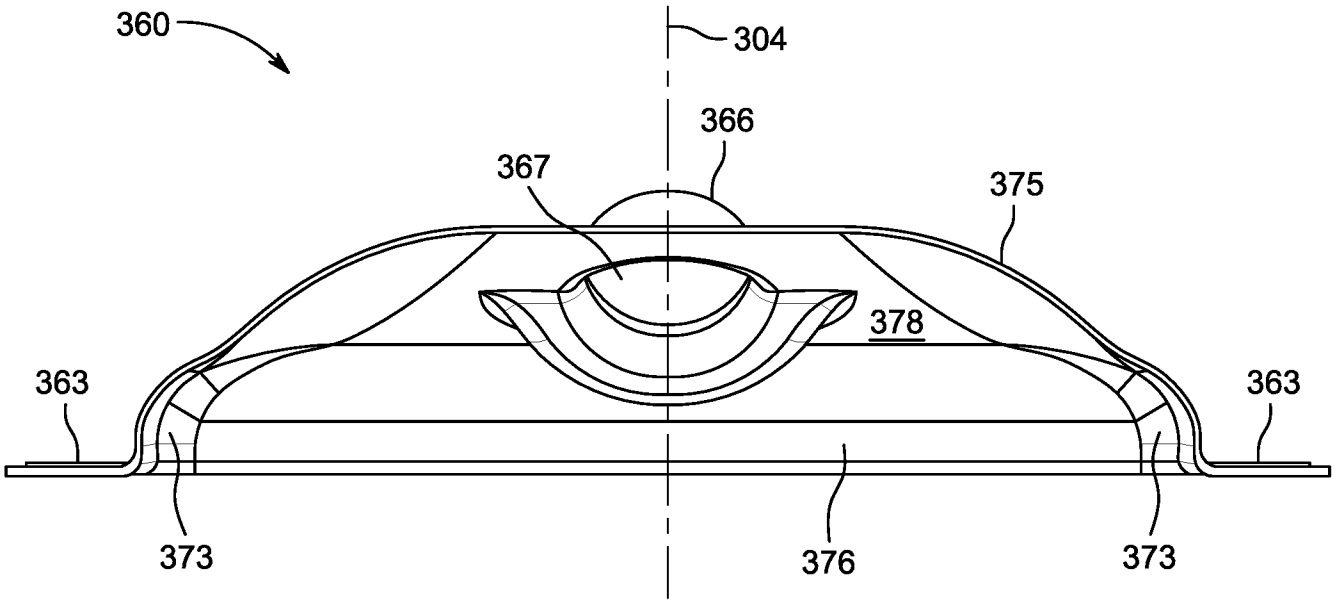
FIG. 23 is a view of the air outlet shown in FIG. 21 sectioned on geometrical plane 305-4C and viewed as shown by section line 4C-4C'.

FIG. 21 shows an air outlet 360 for delivery of cooled compressed air from intercooler 300 to intake manifold 710 of engine 700. Air outlet 360 includes an air outlet pipe 361, an air outlet plenum 362 and an air outlet flange 363. In the embodiment of FIGS. 21-23, air outlet plenum 362 includes two cylindrical connectors 366, each defining an aperture 367. Air outlet 360 is adapted to be joined to intercooler 300 to form a unitary assembly, as described below.

Air outlet 360 is configured to receive air issuing from one face (303 or 308) of intercooler 300. In the preferred embodiment, longitudinal plane 304 in FIG. 21 evenly divides air outlet pipe 361, and is coplanar with longitudinal plane 304 in FIG. 14 that evenly divides intercooler 300. The intercooler 300/air outlet 360 assembly in the preferred embodiment is particularly adapted to be mounted over intake manifold 710 engine 700, with longitudinal plane 304 passing through the crankshaft axis 701 (coincident with longitudinal plane 104 in FIG. 1). In this orientation, air outlet plenum 362 is internally contoured to transition the air issuing from one of the faces (303 or 308) of intercooler 300 into air outlet pipe 361, to be routed to engine intake manifold 710. The centerline of the outlet aperture 371 of air outlet pipe 361 in the preferred embodiment preferably resides in longitudinal plane 304 and is oriented in the vertical direction. The mouth of outlet aperture 371 is oriented in a horizontal plane 306. These design features provide a compact connection to engine intake manifold 710. There is a bend in air outlet pipe 361 to redirect air received from plenum 362 to outlet 371.

Air outlet plenum 362 comprises four sidewalls (two longitudinal sidewalls 373, two transverse sidewalls 376) joined by a carapace 375. Sidewalls 373, 376 and carapace 375 together define an outlet plenum cavity 378 whose transverse cross-sectional area is greatest proximate to air outlet pipe 361, least distal from air outlet pipe 361, and which smoothly decreases between these two regions, as can be seen from FIGS. 21, 22 and 23. The transverse cross-section of outlet plenum cavity 378 is generally symmetric about longitudinal plane 304, as shown in FIGS. 22 and 23.

Connectors 366, shown in FIG. 21, are adapted to be coupled to two blow-off valves 173 to be received in apertures 367. The provision of two connectors 366 permit the use of two blow-off valves 173 for increased air flow. Either or both can be capped if not utilized.

It is preferred that air outlet flange 363 be identical in size and geometry to intercooler flange assembly 310, and have the same pattern of bolt apertures as intercooler flange assembly 310. Accordingly, air outlet flange 363 can be bolted to either of the two intercooler flange assemblies 310 of an intercooler 300.

Figure 24:
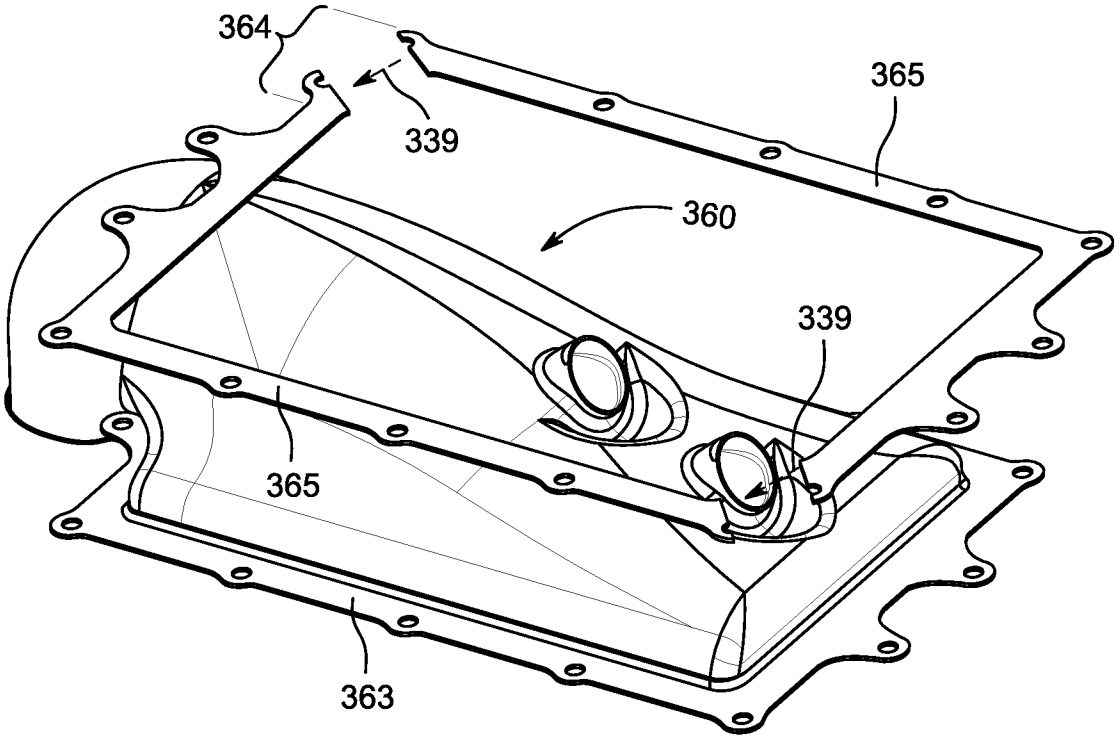
FIG. 24 is a perspective view of the air outlet shown in FIG. 21 and its outlet seal assembly.

There is optionally provided an outlet seal assembly 364 to facilitate securing air outlet 360 to intercooler 300. It is particularly preferred that each outlet seal assembly 364 includes two outlet seal L-components 365. As shown in FIG. 24, each outlet seal L-component 365 is L-shaped, and preferably is identical in size and geometry to the other outlet seal L-component 365, so that when one such L-component 365 is paired with another such L-component 365 (arrows 339 in FIG. 24), they together form an outlet seal assembly 364 in the form of a rectangular frame. Splitting the outlet seal assembly 364 into L-components 365 yields fabrication economies, as described above in regard to intercooler flange assembly 310 and intercooler flange L-components 311. Outlet seal assembly 364 preferably has the same pattern of bolt apertures as intercooler flange assemblies 310 and air outlet flange 363.

Air outlet 360 can be fabricated from sheet metal, such as steel or aluminum, either from a single piece of stock or from multiple pieces, and then assembled and fastened together, such as by riveting, brazing or welding. Alternatively, air outlet 360 can be fabricated from plastics such as HDPE, or from composite materials such as temperature-resistant fiberglass/fiberglass resin, carbon fiber, Kevlar and others. The outlet seal L-components 365 preferably are fabricated from aluminum plate stock or the like.

FIG. 25 depicts the assembly of the preferred embodiments of air outlet 360 and intercooler 300. In particular, air outlet flange 363 is positioned between an outlet seal assembly 364 and one of the two intercooler flange assemblies 310; following which outlet seal assembly 364 and the selected intercooler flange assembly 310 are urged together, such as by means of nuts 309 and bolts 314, to yield a unitary air outlet/intercooler system. A resilient sealing gasket, component or structure may additionally be interposed between air outlet flange 363 and intercooler flange assembly 310 to contribute to sealing. For example, FIG. 14 shows an optionally provided sealing groove 317 on the exterior face of each intercooler flange assembly 310 for receiving an O-ring 307 and yielding a relatively air-tight seal between intercooler 300 and air outlet 360.

It is preferred that the single channel air inlet 320/intercooler 300/air outlet 360 assembly be positioned and mounted over the air intake manifold 710 of engine 700, between the cylinder banks of engine 700 as discussed above, and held in place by two brackets, front bracket 381 and rear bracket 382, as shown in FIG. 13A. Brackets 381, 382 preferably are bent from aluminum plate and are secured with nuts and bolts to the underside of single channel air inlet 320, below air inlet seal assembly 331, and to the cylinder heads of engine 700 with nuts and bolts. In this position, outlet aperture 371 is positioned over throttle assembly 702, to which it passes cooled compressed air by way of air intake connector 5. Air intake connector 5 is secured at one end to throttle assembly 702 with a T-bolt clamp 8, and is secured at a second end to air outlet pipe 361 with a T-bolt clamp 8. Air intake connector 5 in the Stage 3 configuration is longer than in the Stage 1 configuration and the Stage 2 configuration, so as to accommodate the height of the single channel air inlet 320/intercooler 300/air outlet 360 assembly.

A single channel air inlet, an intercooler and an air outlet generally corresponding in design respectively to single channel air inlet 320, intercooler 300 and air outlet 360 are described in U.S. Provisional Application No. 62/687,461 entitled "Intercooler and Intercooler Systems," filed Jun. 20, 2018. The contents of U.S. Provisional Application No. 62/687,461 are hereby incorporated by reference as if fully set forth herein, including the aforementioned single channel air inlet, intercooler and air outlet designs, found for example at paragraphs 28-44, 53-60, 62 and FIGS. 1A-2E, 4A-4D and 5A-5B thereof, among others, of U.S. Provisional Application No. 62/687,461.

Stage 3 Turbocharger Air Circuit

The Stage 3 turbocharger air circuit 380 features the components for the supply of compressed air from turbocharger 160 to air inlet pipe 321 of single channel air inlet 320.

Given the location of turbocharger 160 (mounted on turbocharger support column 152 of turbo exhaust manifold 100) and the preferred location of single channel air inlet 320 (between the cylinder banks of engine 700 above the engine intake manifold 710, as shown in FIG. 13A), the overall design elements are sufficiently compact that air inlet pipe 321 optionally includes the Stage 3 turbocharger air circuit 380 as an integral component. That is, the length and orientation of air inlet pipe 321 can be made to directly connect air inlet pipe 321 to compressed air outlet 165 of turbocharger 160.

Figure 26:
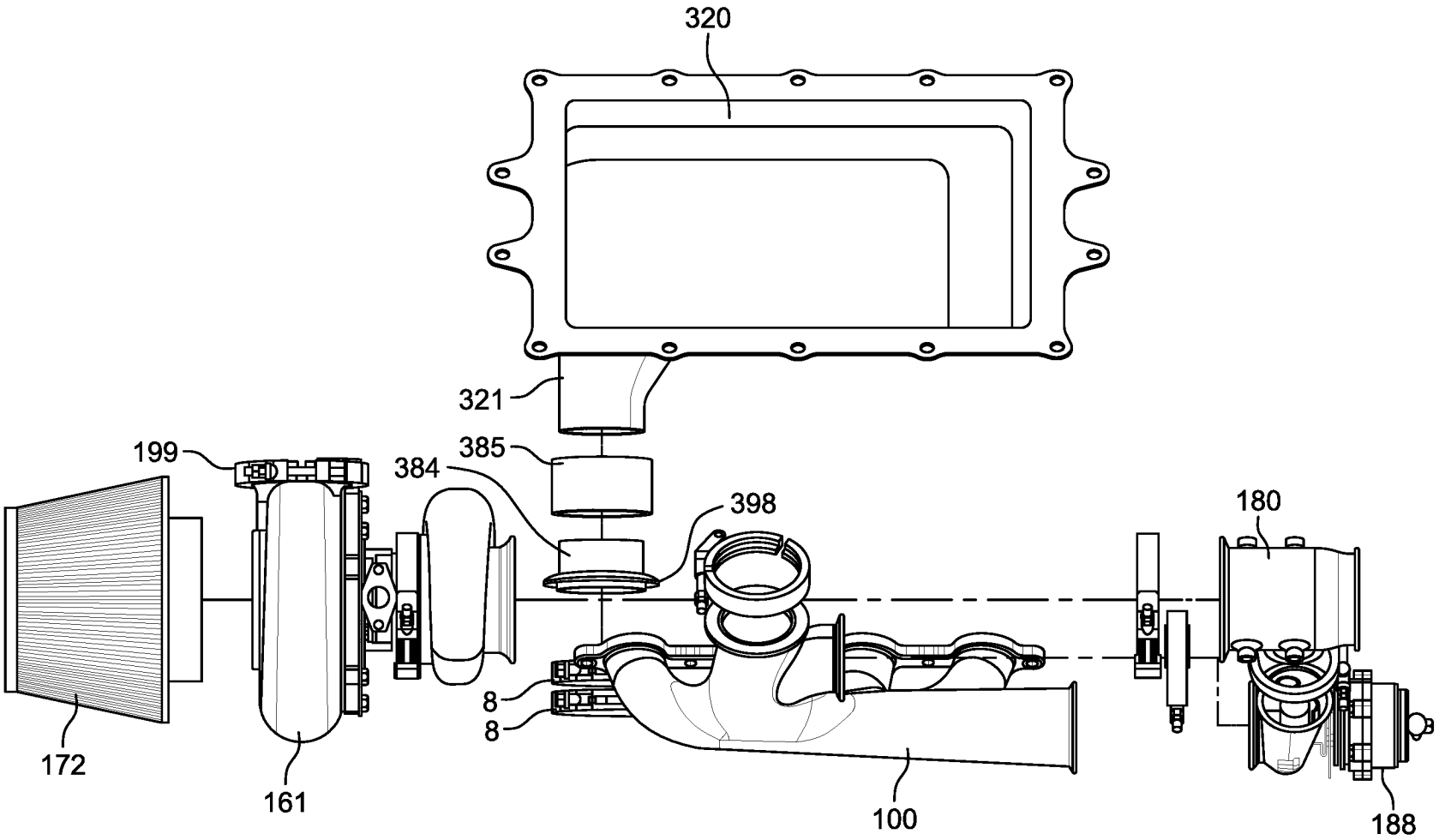
FIG. 26 is an exploded schematic view of the turbocharger, turbocharger exhaust circuit and single channel air inlet utilized in the Stage 3 air intake-exhaust system of the present invention.

Alternatively, it is preferred to interpose a resilient connection between air inlet pipe 321 and compressed air outlet 165 of turbocharger 160. Referring to FIG. 26, there is a relatively short air inlet connection hose 385, for example HPS silicone hose, secured at a first end to air inlet pipe 321 using a T-bolt hose clamp 8, and secured at a second end to a flanged adaptor 384 using a T-bolt hose clamp 8. The flanged portion 398 of adaptor 384 in turn is secured to flanged connector 178 of turbocharger 160 using a V-clamp 199.

To allow the engine to better function with the volume of air made available in the Stage 3 configuration (and also in the Stages 4 and 5 configurations), it is preferred to utilize pistons that increase the cylinder volume at top dead center, such as by substituting pistons with reduced crown height.

Stage 3 Reverse Installation

Figure 13B:
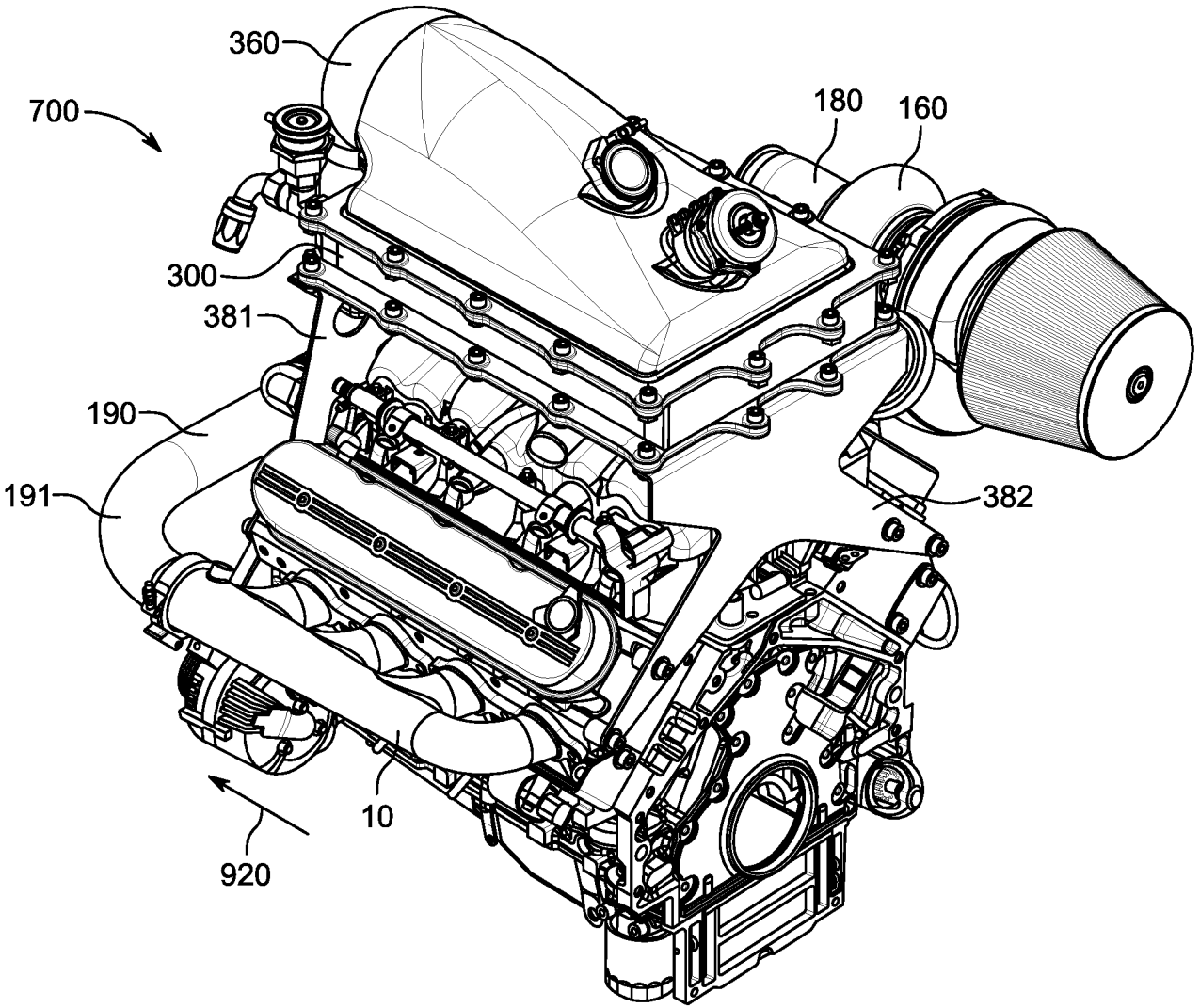
FIG. 13B is a schematic perspective rear view of a Reverse Installation of the Stage 3 air intake-exhaust system of the present invention.

FIG. 13A depicts a Standard Installation of the Stage 3 configuration (which has one single outlet exhaust manifold 10 and one turbo exhaust manifold 100). However, in another embodiment, the Stage 3 configuration can be in a Reverse Installation, as shown in FIG. 13B. In particular, the exhaust manifold 10 is rotated 180 degrees from the Standard Installation and installed on the left side of engine 700, and turbo exhaust manifold 100, together with turbocharger 160 and turbocharger exhaust circuit 175, are rotated 180 degrees from the Standard Installation, with turbo exhaust manifold 100 being installed on the right side of engine 700.

In a Reverse Installation of the Stage 3 configuration, the crossover pipe assembly 190 passes across the front of engine 700 (closest to arrow 920), as show in FIG. 13B. As in the case of a Reverse Installation of the Stage 2 configuration, the exact shape of crossover pipe assembly 190 can differ in the Stage 3 configuration between the Reverse Installation and the Standard Installation, in order to maintain close proximity of crossover pipe assembly 190 to the rear or front of engine 700, while standing clear of engine appurtenances that are specific to that installation orientation.

On the other hand, air outlet 360 in accordance with the preferred embodiment utilizes the same orientation (air outlet pipe 361 toward the front of the engine, positioned over air intake elbow 6) in both a Standard Installation and a Reverse Installation of a Stage 3 configuration. The preferred symmetric arrangement of the bolt pattern of intercooler flange assembly 310 and air inlet flange 350 permits installation of a single channel air inlet 320/intercooler 300/air outlet 360 assembly in either a Standard Installation or a Reverse Installation without the need for employing different components for each.

Upgrading from a Stage 2 Configuration to a Stage 3 Configuration

An engine having the Stage 3 configuration (in either a Standard Installation or a Reverse Installation) can be obtained by replacing a relatively small number of principal components of an engine having a Stage 2 configuration, and adding a relatively small number of additional principal components. More specifically, to yield a Stage 3 configuration, the following component is removed from an engine having a Stage 2 configuration: Stage 2 air intake 180; and the following principal components are added to engine 700: single channel air inlet 320, intercooler 300 and air outlet 360. Rather than being discarded, any blow-off valve 173 positioned in Stage 2 air intake 180 can be inserted into one of apertures 367 of its respective cylindrical connector 366, for further utilization in the Stage 3 configuration. The function of crossover pipe assembly 190 in the Stage 3 configuration is that same as in the Stage 2 configuration: to provide a passageway for the movement of exhaust gases from the single outlet exhaust manifold 10 to the turbo exhaust manifold 100.

Stage 4 Configuration

Figure 27A:
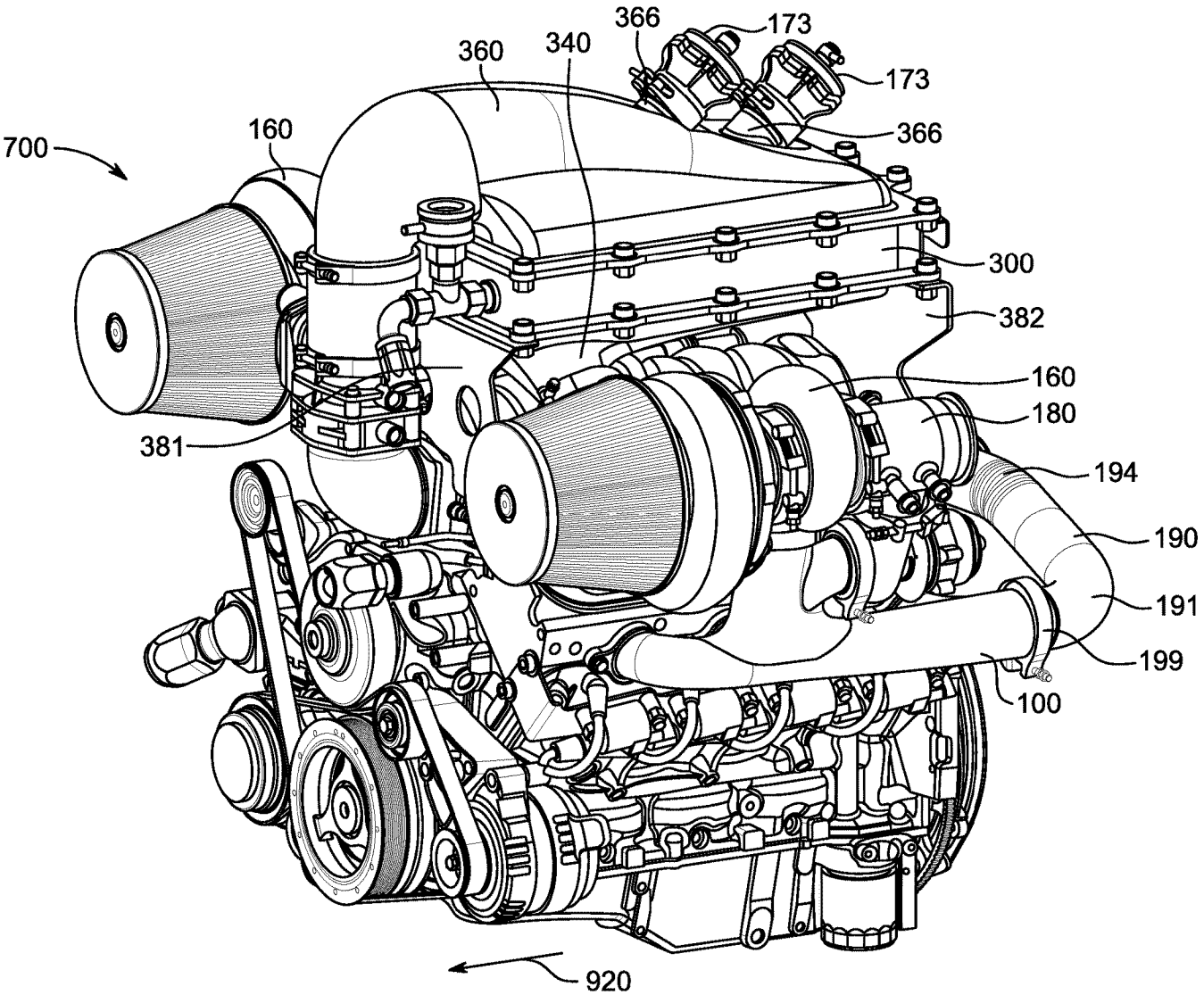
FIG. 27A is a schematic perspective front view of a Standard Installation of the Stage 4 air intake-exhaust system of the present invention.

Stage 4 is an engine configuration developing yet more power than in Stage 3. The Stage 4 configuration is depicted in FIG. 27A, which includes two turbochargers 160 (one more than in Stages 2 and 3), each of which feeds compressed air to intercooler 300. The function of the additional turbocharger 160 is to further increase the amount of enthalpy extracted from the exhaust gases to deliver an even larger charge of air to the engine cylinders during the intake stroke. The function of the crossover pipe assembly 190 in the Stage 4 configuration is to provide exhaust pressure communication between the two turbo exhaust manifolds 100.

The principal components first utilized in the Stage 4 configuration are a second turbocharger 160, substantially as first described above in connection with the Stage 2 configuration, and a dual channel air inlet 340, described below, in place of single channel air inlet 320. Stage 4 additionally utilizes a second turbo exhaust manifold 100, plus a second turbocharger exhaust gas circuit 175, both previously described in connection with the Stage 2 configuration. The dimensions of certain aspects of this second turbo exhaust manifold 100 may differ from the comparable dimensions of its counterpart for the other engine cylinder bank, depending upon the turbocharger configuration, as explained below. Given the volume of the compressed air flow generated in the Stage 4 configuration, it is preferred to utilize two blow-off valves 173, which are received in each of the two apertures 367 of cylindrical connectors 366 in air outlet 360, as shown for example in FIG. 27A.

Dual Channel Air Inlet (340)

Figure 28:
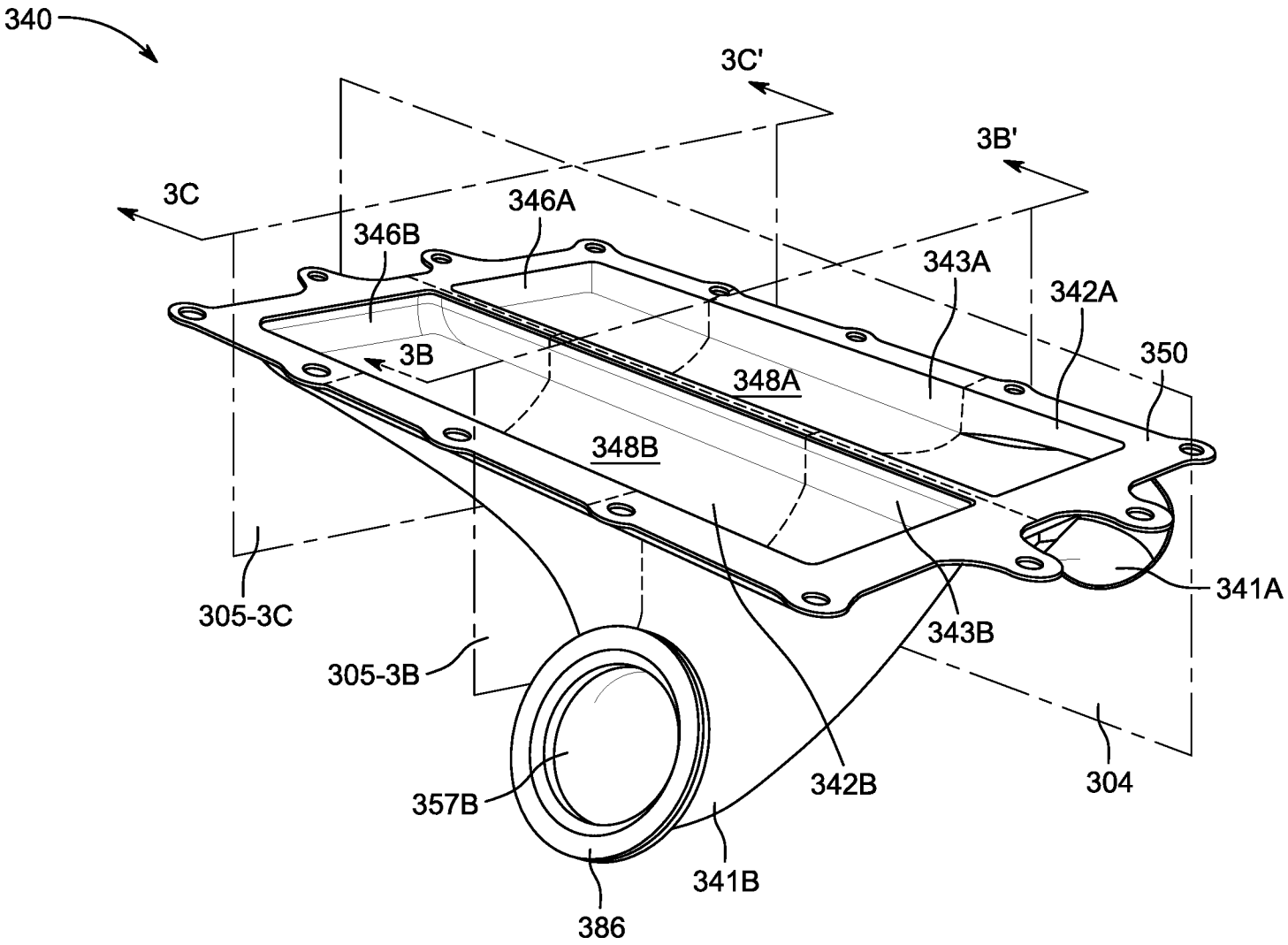
FIG. 28 is a perspective view of a dual channel air inlet first utilized in the Stage 4 air intake-exhaust system of the present invention.
Figure 31:
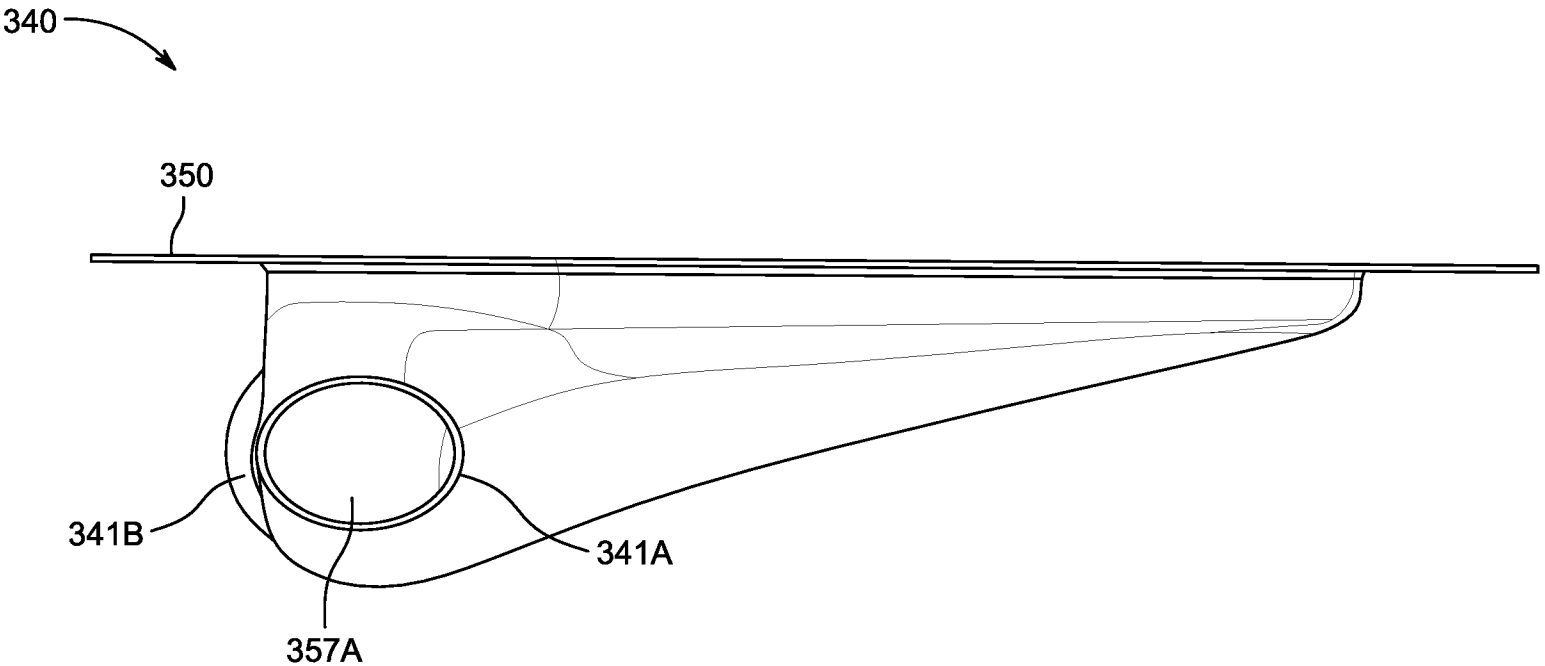
FIG. 31 is a side view of the dual channel air inlet shown in FIG. 28.

FIG. 28 shows a dual channel air inlet 340 for delivery of compressed air through two channels, conduits or pipes, from two turbochargers 160 to intercooler 300. In comparison with single channel air inlet 320, dual channel air inlet 340 is characterized by having two plenums. Accordingly, referring to FIGS. 28, 31 and 32, dual channel air inlet 340 includes a first air inlet pipe 341A, a second air inlet pipe 341B, a first air inlet plenum 342A, a second air inlet plenum 342B and an air inlet flange 350. Dual channel air inlet 340 is adapted to be joined to intercooler 300 to form a unitary assembly, as described below.

Figure 32:
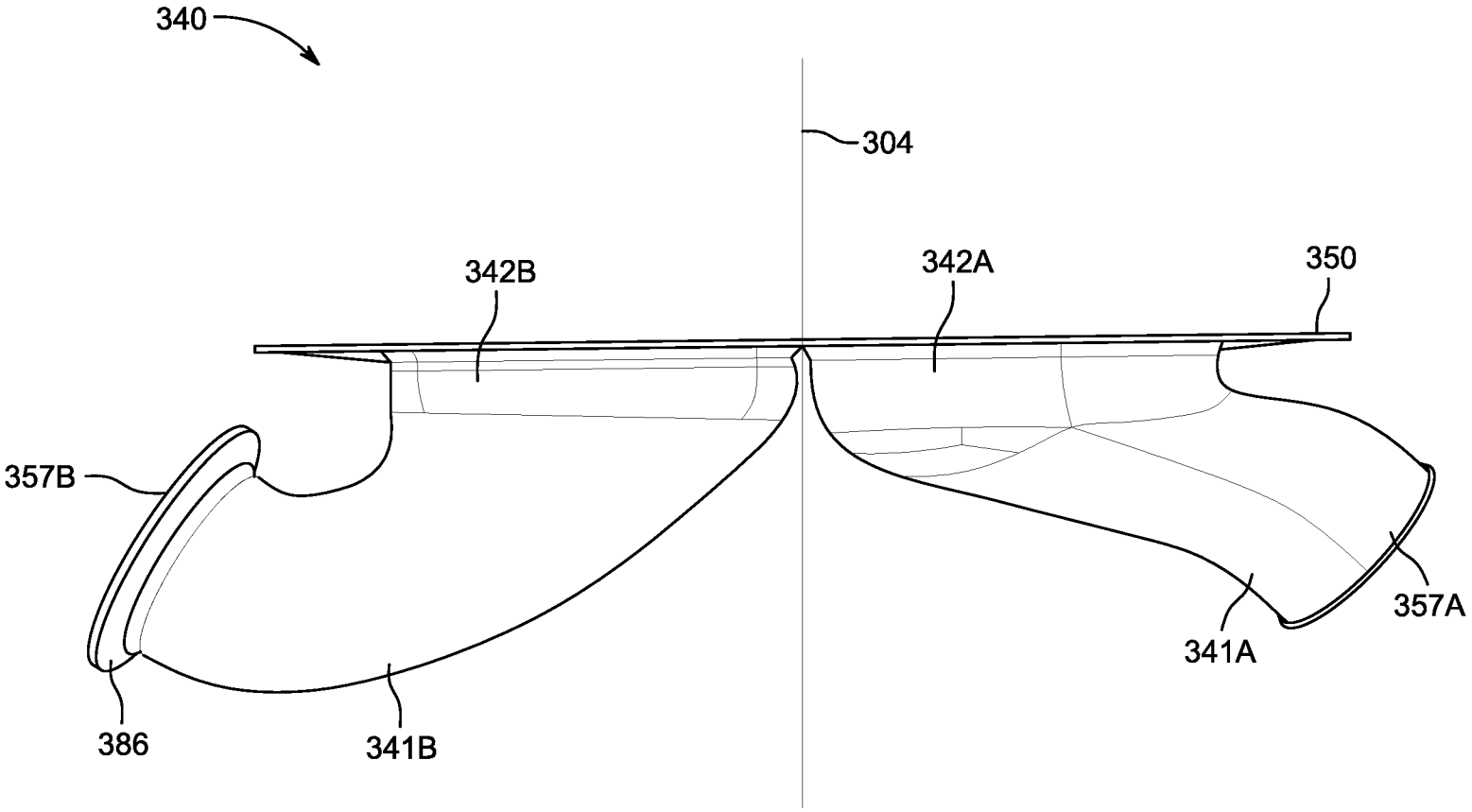
FIG. 32 is a front view of the dual channel air inlet shown in FIG. 28.

Dual channel air inlet 340 is configured to deliver air across one face (303 or 308) of intercooler 300. In the preferred embodiment, longitudinal plane 304 in FIG. 28 evenly divides air inlet 340 in plan view, and is coplanar with longitudinal plane 304 in FIG. 14 that evenly divides intercooler 300. The intercooler 300/dual channel air inlet 340 assembly in the preferred embodiment is particularly adapted to be positioned and mounted over intake manifold 710 of engine 700, with longitudinal plane 304 being exactly or approximately coplanar with longitudinal plane 104 shown in FIG. 1. For this mounting position, it is preferred that dual channel air inlet 340 be configured so that longitudinal plane 304 does not pass through either inlet pipe 341A or 341B; rather, as shown in FIG. 32 inlet pipes 341A and 341B preferably are each positioned to one side of longitudinal plane 304 (shown on edge in FIG. 32), one to one side and the other to the other side. Such side positioning allows each of inlet pipes 341A and 341B to be closer, in an appropriately configured system, to a corresponding air compressor air outlet, thereby yielding a tighter and more compact engine accessory package. For the same reason, the centerline of each of inlet pipes 341A and 341B is generally transversely oriented, so that its respective inlet aperture, 357A, 357B, is to one side of air inlet 340, and so as to receive and route air flow in a generally transverse direction into air inlet plenum 342A and 342B respectively.

The shapes of inlet pipes 341A and 341B may or may not be the same, in accordance with other engine system aspects. For example, in the case where the associated connecting systems are symmetric about longitudinal plane 304, inlet pipes 341A and 341B can have the same shapes. However, some turbochargers, such as for example turbocharger 160 depicted in FIGS. 11A and 11B, are asymmetrical in shape. The connection of dual channel air inlet 340 with such turbochargers can differ in location and orientation, depending on to which side of longitudinal plane 304 the connection is being made. To accommodate those cases, inlet pipes 341A and 341B can differ in shape, as shown in FIG. 32, so as to compactly connect to a corresponding turbocharger.

Figure 29:
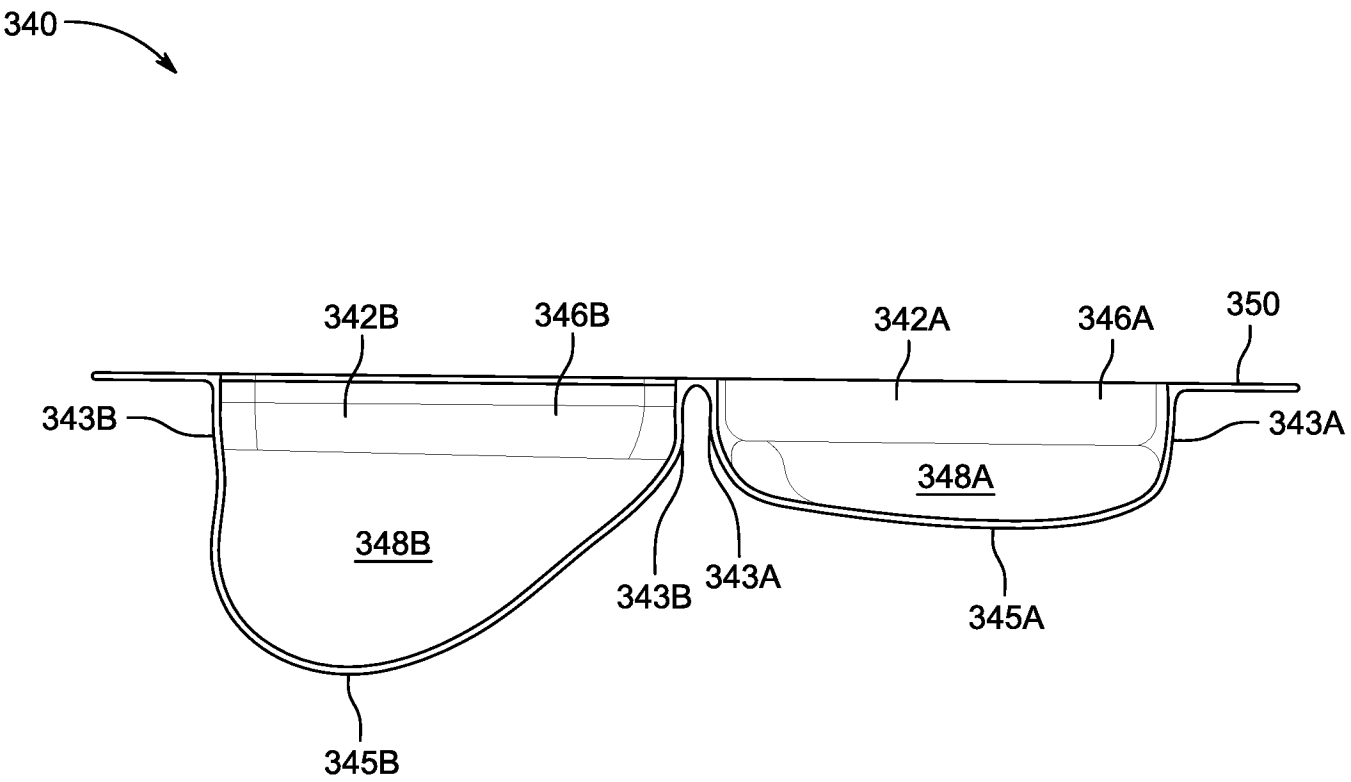
FIG. 29 is a view of the dual channel air inlet shown in FIG. 28 which is sectioned on geometrical plane 305-3B and viewed as shown by section line 3B-3B'.
Figure 30:
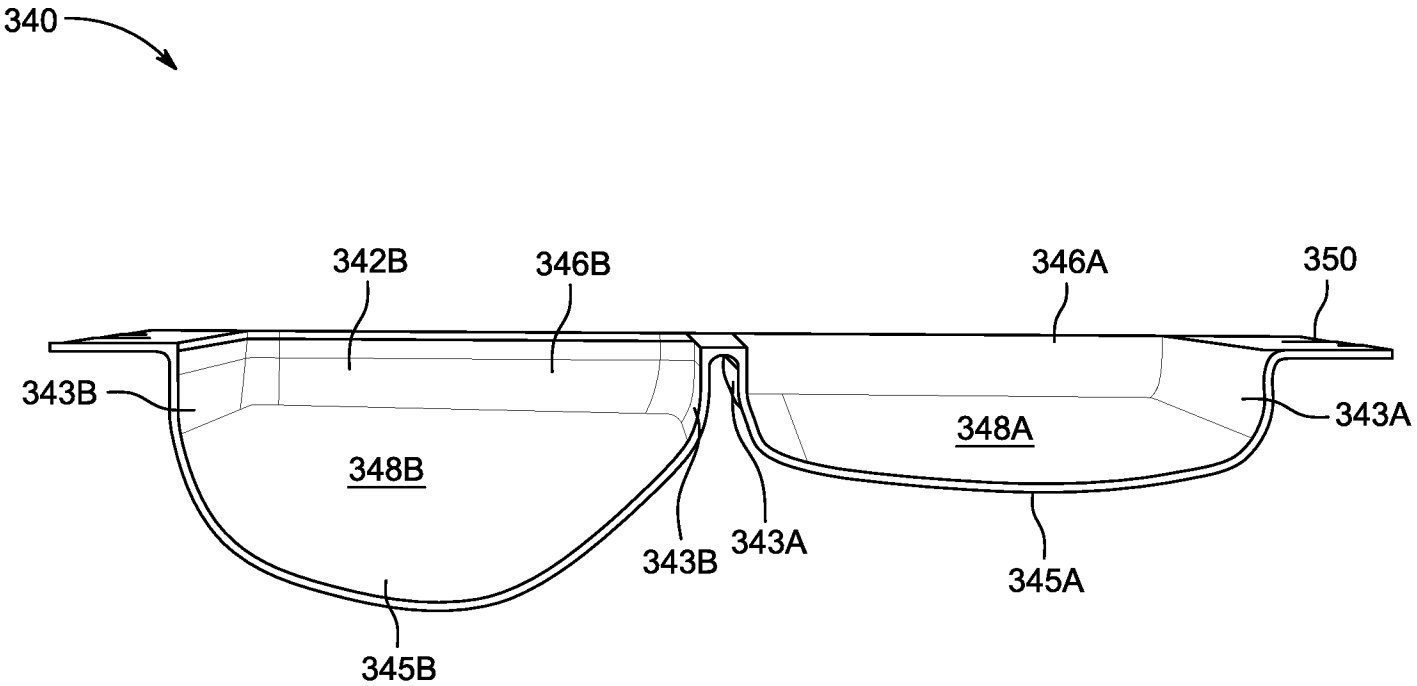
FIG. 30 is a view of the dual channel air inlet shown in FIG. 28 which is sectioned on geometrical plane 305-3C and viewed as shown by section line 3C-3C'.

In the preferred embodiment shown in FIGS. 28-32, air inlet pipe 341A delivers air to air inlet plenum 342A, and air inlet pipe 341B delivers air to air inlet plenum 342B; the inlet plenums 342A and 342B are substantially independent. As an alternative embodiment, one large plenum 342 can be utilized instead. Each plenum 342A and 342B in the preferred embodiment is internally contoured to transition the transverse air flow from inlet pipes 341A and 341B respectively to flow across the receiving face (303 or 308) of intercooler 300. Plenum 342A comprises four sidewalls (two longitudinal sidewalls 343A, two transverse sidewalls 346A), which are joined by a glacis 345A (see FIG. 29), and plenum 342B comprises four sidewalls (two longitudinal sidewalls 343B, two transverse sidewalls 346B), which are joined by a glacis 345B (FIG. 29).

Sidewalls 343A, 346A and glacis 345A together define a first inlet plenum cavity 348A whose transverse cross-sectional area is greatest proximate to inlet pipe 341A, least distal from inlet pipe 341A, and which generally decreases between these two regions in a smooth manner, as shown in FIGS. 28, 29, 30 and 31. Likewise, sidewalls 343B, 346B and glacis 345B together define a second inlet plenum cavity 348B whose transverse cross-sectional area is greatest proximate to inlet pipe 341B, least distal from inlet pipe 341B, and which generally decreases between these two regions in a smooth manner, as shown in FIGS. 28, 29, 30 and 31. The transverse cross-section of each of inlet plenum cavities 348A and 348B at any longitudinal point in the preferred embodiment will have a shape that in general will depart from symmetry, as is exemplified by FIGS. 29 and 30, since each cavity is shaped with the goal of inducing the air to be distributed across the receiving face (303 or 308) of intercooler 300 more evenly, minimizing or even eliminating areas of low air flow through the receiving face, while at the same time accommodating the particular shape and positioning of air inlet pipe 341A or 341B and more generally maintaining the intercooler 300/dual channel air inlet 340 assembly as a compact package.

It is preferred that air inlet flange 350 of dual channel air inlet 340 be identical in size and geometry to intercooler flange assembly 310, and have the same pattern of bolt apertures as intercooler flange assembly 310. Accordingly, air inlet flange 343 can be bolted to either of the two intercooler flange assemblies 310 of an intercooler 300. Additionally, dual channel air inlet 340 can be affixed to intercooler 330 in substantially the same manner as described above in connection with single channel air inlet 330, including utilizing the same inlet seal assembly 331.

Dual channel air inlet 340 can be fabricated from sheet metal, such as steel or aluminum, either from a single piece of stock or from multiple pieces then assembled and fastened together, such as by riveting, brazing or welding.

Alternatively, dual channel air inlet 340 can be fabricated from plastics such as HDPE, or from composite materials such as temperature-resistant fiberglass/fiberglass resin, carbon fiber, Kevlar and others.

The preferred embodiments of dual channel air inlet 340 and intercooler 300 are assembled in the same way as single channel air inlet 320, as described in reference to the Stage 3 configuration and FIG. 25, with dual channel air inlet 340 being utilized in lieu of single channel air inlet 320. The preferred positioning and mounting location of the dual channel air inlet 340/intercooler 300/air outlet 360 assembly is the same as the single channel air inlet 320/intercooler 300/air outlet 360 assembly in the Stage 3 configuration (over the air intake manifold 710 of engine 700, between the cylinder banks of engine 700, as described above). The dual channel air inlet 340/intercooler 300/air outlet 360 assembly can be held in place by the same brackets 381, 382, shown in FIG. 27A, as were employed in the Stage 3 configuration.

A dual channel air inlet generally corresponding in design to dual channel air inlet 340 is described in U.S. Provisional Application No. 62/687,461 entitled "Intercooler and Intercooler Systems," filed Jun. 20, 2018. The contents of U.S. Provisional Application No. 62/687,461 are hereby incorporated by reference as if fully set forth herein, including the aforementioned dual channel air inlet design, found for example at paragraphs 45-52, 63-64 and FIGS. 3A-3E and 6-7 thereof, among others, of U.S. Provisional Application No. 62/687,461.

Stage 4 Turbocharger Air Circuit (390)

The Stage 4 turbocharger air circuit 390 features the components for the supply of compressed air from each of turbochargers 160 to a respective air inlet pipes 341A, 341B of dual channel air inlet 340.

Given the location of turbochargers 160 (mounted on turbocharger support columns 152 of turbo exhaust manifolds 100) and the preferred location of dual channel air inlet 340 (between the cylinder banks of engine 700 above the engine intake manifold 710, as shown in FIG. 27A), the overall design elements are sufficiently compact that air inlet pipes 341A, 341B optionally can include the Stage 4 turbocharger air circuit 390 as an integrated component. That is, the length and orientation of each air inlet pipe 341A, 341B can be made to directly connect to a respective compressed air outlet 165 of each of the turbochargers 160 utilized in the Stage 4 configuration.

Alternatively, optionally there is provided one or more resilient connecting components between either or both of air inlet pipes 341A, 341B and a respective compressed air outlet 165 of the turbochargers 160. For example, in one embodiment it is preferred to interpose a resilient connection between air inlet pipe 341A and compressed air outlet 165 of the turbocharger 160 mounted to turbocharger support column 152 of turbo exhaust manifold 100L. The specific components (adaptor 384, connecting hose 385, T-bolt clamps 8) and configuration can be the same as utilized in regard to the connection with air inlet pipe 321 in the Stage 3 configuration described above and shown in FIG. 26. With such a coupling arrangement, air inlet pipe 341B can be rigidly connected to the compressed air outlet 165 of the turbocharger 160 that is mounted to the turbocharger support column 152 of turbo exhaust manifold 100R. Such a rigid connection can be realized by providing inlet aperture 357B with a flanged connector 386 (shown in FIGS. 28 and 32), which is secured to flanged connector 178 of compressed air outlet 165 of such turbocharger 160, with a V-band clamp 199.

The air outlet 360 in the Stage 4 configuration can be connected to the throttle assembly 702 in the same manner, and using the same components, as described above for the Stage 3 configuration.

Stage 4 Configuration Turbo Exhaust Manifold Design Preferences (100L, 100R)

In the type of turbocharger 160 depicted in FIGS. 11A and 11B, the exhaust gas passes to the turbine wheel through a turbine scroll passage 166. Correspondingly, there is an air compressor turbine scroll passage 167 that delivers compressed air to the turbocharger compressed air outlet 165. The shapes of these scroll passages generally result in turbocharger 160 being radially asymmetric about turbocharger axis 159 (non-axisymmetric). Since a Stage 4 configuration utilizes two turbochargers 160, certain positional differences in the transverse plane may arise from the turbocharger asymmetries. These differences are accommodated by the present invention in one of two ways.

First, in one embodiment of the present invention, it is preferred that the two turbochargers 160 utilized in the Stage 4 configuration rotate in opposite directions, and that their air and exhaust gas intake and outlet components are mirrored in design. For this embodiment, the overall arrangement of exhaust manifolds 100L and 100R and their associated turbochargers 160 will be symmetric about the longitudinal plane 104 of engine 700, notwithstanding that the turbochargers 160 are themselves asymmetric, as described above.

In another embodiment of the present invention, the same design of turbocharger 160 (each rotating in the same direction) is used with exhaust manifolds 100L and 100R. For this embodiment, the values of angle F and offset OF are not the same for exhaust manifolds 100L and 100R, but rather differ. This embodiment is depicted in FIG. 33, which shows exhaust manifolds 100L and 100R connected to a schematically depicted engine 700, divided by vertical plane 104. Among other things, FIG. 33 shows a turbocharger 160L mounted on circular mount 154 of exhaust manifold 100L, and a turbocharger 160R mounted on circular mount 154 of exhaust manifold 100R, with the centerlines 159 of turbochargers 160L, 160R oriented generally parallel to plane 104. In this embodiment, it is preferred that the angular and dimensional relationships relating to exhaust gas routing circuit 150 be appropriately adjusted for each of exhaust manifolds 100L and 100R such that when turbochargers 160L and 160R are respectively mounted on circular mounts 154 of turbocharger support columns 152 of exhaust manifold 100L and 100R: the distance TCL from the centerline 159 of turbocharger 160L to plane 104 is approximately the same as the distance TCR from the centerline 159 of turbocharger 160R to plane 104 ("Relationship B"); and the centerline 159 of turbocharger 160L lies in approximately the same horizontal plane as the centerline 159 of turbocharger 160R ("Relationship C").

As an example of an adjustment in angular relationships directed to realizing Relationship B, in FIG. 33 the angle FL subtended by plane 102 and plane 103 of exhaust manifold 100L, and the angle FR subtended by plane 102 and plane 103 of exhaust manifold 100R, are each adjusted such that when the turbochargers 160L and 160R are respectively mounted on support columns 152 of exhaust manifolds 100L and 100R, the distance TCL from the centerline 159 of turbocharger 160L to plane 104 is approximately the same as the distance TCR from the centerline 159 of turbocharge 160R to plane 104.

It is additionally preferred that the foregoing angular relationships and dimensions be appropriately adjusted such that: the distance RPL from the centerline 157 of bypass pipe 153 of exhaust manifold 100L to plane 104 is approximately the same as the distance RPR from the centerline 157 of bypass pipe 153 of exhaust manifold 100R to plane 104 ("Relationship D"); and the centerline 157 of bypass pipe 153 of exhaust manifold 100L lie in approximately the same horizontal plane as the centerline 157 of bypass pipe 153 of exhaust manifold 100R ("Relationship E").

As an example of an adjustment in dimensional relationships directed to realizing Relationship D, in FIG. 33 the axial centerline 157 of exhaust gas bypass pipe 153 of exhaust manifold 100L is offset from 100L's plane 103 a distance OFL, and the axial centerline 157 of exhaust gas bypass pipe 153 of exhaust manifold 100R is offset from 100R's plane 103 a distance OFR, such that the distance RPL from the centerline 157 of bypass pipe 153 of manifold 100L to plane 104 is approximately the same as the distance RPR from the centerline 157 of bypass pipe 153 of manifold 100R to plane 104.

Otherwise, except as discussed above in connection with Relationships A-E, the components of exhaust manifolds 100L and 100R as relevant here mirror each other (e.g., dimensions and orientations of exhaust stack assemblies 120, manifold plenums 130, locations of exhaust gas routing circuits 150 on manifold plenums 130). These mirrored relationships can facilitate achieving these results: the distance EPL between centerline 129 of manifold plenum 130 of exhaust manifold 100L and vertical plane 104 of engine 700 being approximately the same as the distance EPR between centerline 129 of manifold plenum 130 of exhaust manifold 100R and vertical plane 104 of engine 700 ("Relationship F"); centerline 129 of manifold plenum 130 of exhaust manifold 100L lying in approximately the same horizontal plane as the centerline 129 of manifold plenum 130 of exhaust manifold 100R ("Relationship G"); centerline 156 of support column 152 of exhaust manifold 100L lying approximately in the same transverse plane (i.e., having an orthogonal relationship with the crankshaft centerline 701), as the centerline 156 of support column 152 of exhaust manifold 100R ("Relationship H"); and bypass outlet 151 of exhaust gas bypass pipe 153 of exhaust manifold 100L lying approximately in the same vertical plane, transversely oriented to plane 104, as the bypass outlet 151 of exhaust gas bypass pipe 153 of exhaust manifold 100R ("Relationship I").

The foregoing Relationships A-I are preferred in the embodiment shown in FIG. 33 to augment the intercooperative nature of the components, and increase the customizable aspects of the present invention, by making easier connecting the elements of exhaust manifolds 100L, 100R, as well as the turbochargers 160L and 160R, with other components that are symmetrically arranged about vertical plane 104 and/or the vehicle centerline. In a particular embodiment as shown in FIG. 3B suitable for use with an LS3 model 6.2 liter displacement V-8 engine, angle FL is less than the angle FR, angle FL is about 86 degrees and angle FR is about 121.5 degrees. In addition, in the same embodiment the offset OFL is less than the offset OFR, offset OFL is about 0.22 inch and offset OFR is about 1.91 inches.

Stage 4 Reverse Installation

Figure 27B:
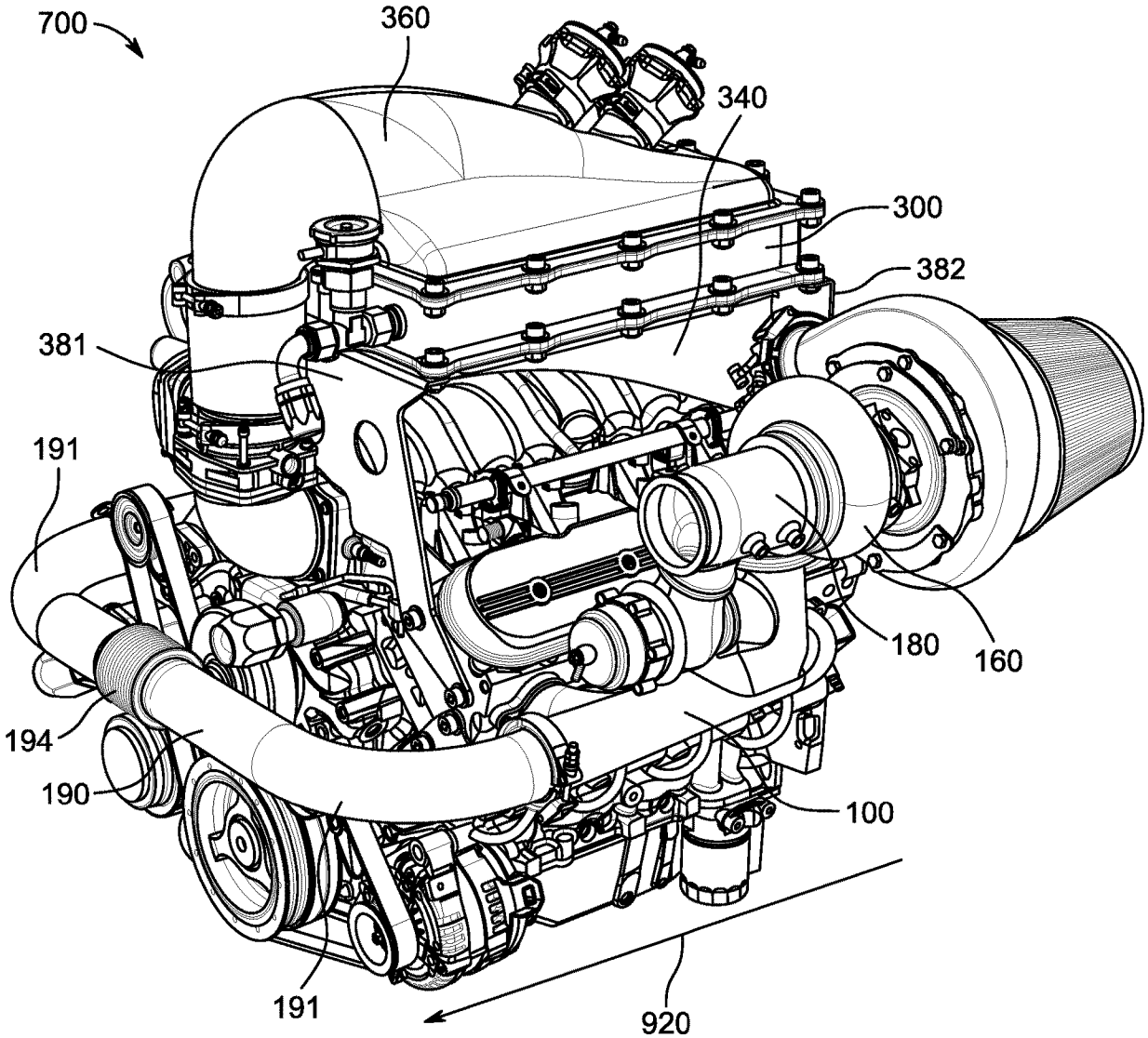
FIG. 27B is a schematic perspective front view of a Reverse Installation of the Stage 4 air intake-exhaust system of the present invention.

FIG. 27A depicts a Standard Installation of the Stage 4 configuration (which has two turbo exhaust manifolds 100). However, in another embodiment, the Stage 4 configuration can be in a Reverse Installation, as shown in FIG. 27B. In particular, each turbo exhaust manifold 100 (together with its associated turbocharger 160, turbocharger exhaust circuit 175, and any non-integral (i.e., additional and separate) components of Stage 4 turbocharger air circuit 390) and the dual channel air inlet 340 are rotated 180 degrees from the Standard Installation.

In a Reverse Installation of the Stage 4 configuration, the crossover pipe assembly 190 passes across the front of engine 700 (closest to arrow 920), as shown in FIG. 27B. As in the case of a Reverse Installation of the Stage 2 and Stage 3 configurations, the exact shape of crossover pipe assembly 190 can differ in the Stage 4 configuration between the Reverse Installation and the Standard Installation On the other hand, air outlet 360 in accordance with the preferred embodiment utilizes the same orientation (air outlet pipe 361 toward the front of the engine, positioned over air intake elbow 6) in both a Standard Installation and a Reverse Installation. The preferred symmetric arrangement of the bolt pattern of intercooler flange assembly 310 and air inlet flange 350 permits installation of a dual channel air inlet 340/intercooler 300/air outlet 360 assembly in either a Standard Installation or a Reverse Installation without the need for employing different components for each.

Upgrading from a Stage 3 Configuration to a Stage 4 Configuration

Optionally, an engine having a Stage 4 configuration (in either a Standard Installation or a Reverse Installation) can be obtained by replacing a relatively small number of principal components of an engine 700 having a Stage 3 configuration, and adding a relatively small number of additional principal components. More specifically, to yield a Stage 4 configuration, the following components are removed from an engine 700 having a Stage 3 configuration: the remaining single outlet exhaust manifold 10, and single channel air inlet 320; and the following principal components are added to the engine 700: a second turbo exhaust manifold 100 (in place of the removed single outlet exhaust manifold 10), a dual channel air inlet 340 (replacing the removed single channel air inlet 320); and a second turbocharger exhaust circuit 175.

Stage 5 Configuration

Figure 34:
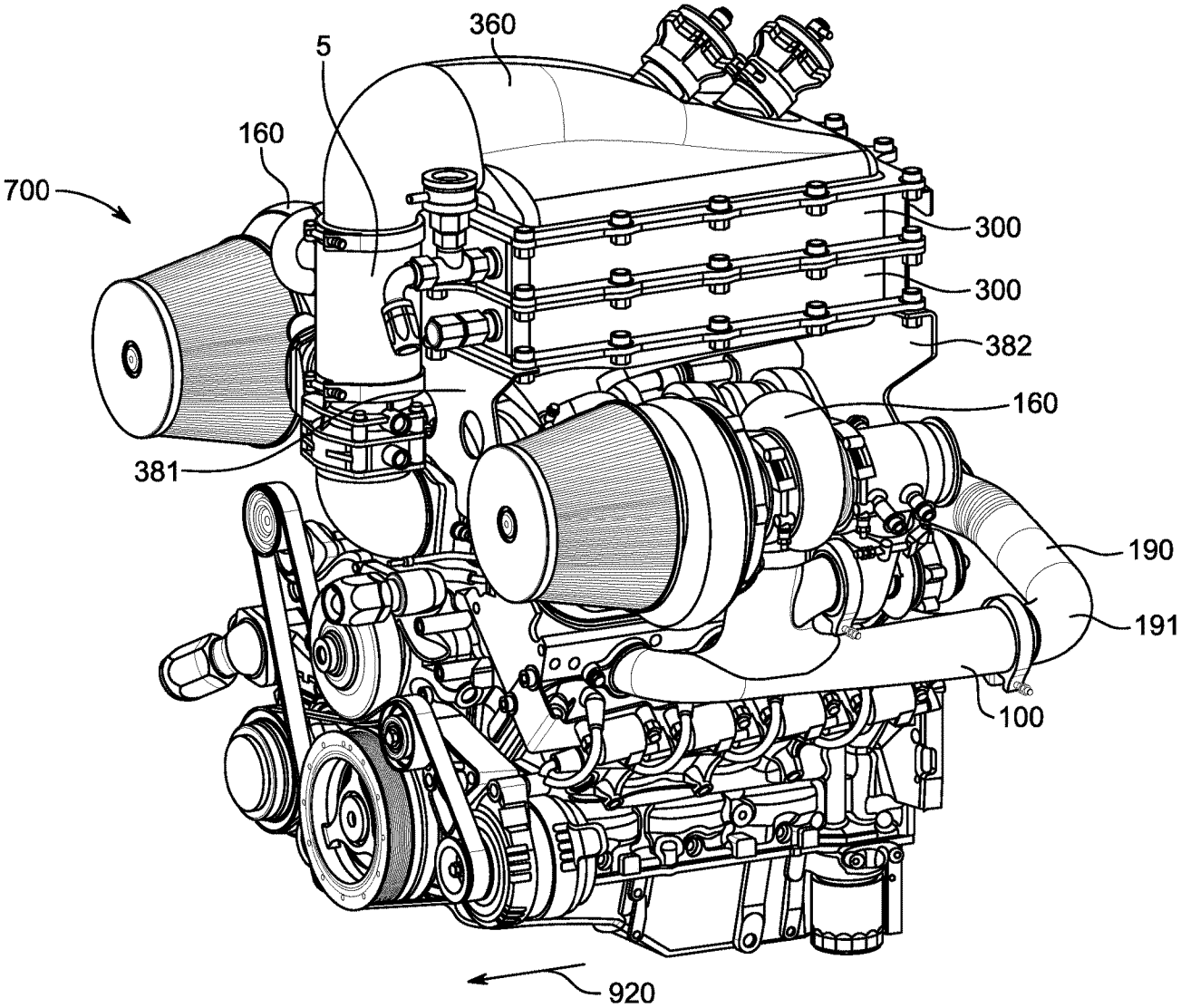
FIG. 34 is a schematic perspective rear view of the Stage 5 air intake-exhaust system of the present invention mounted on an engine.

Stage 5 is an engine configuration developing even further power than in Stage 4. The Stage 5 configuration is depicted in FIG. 34, which includes two intercoolers 300, stacked vertically. The principal component first utilized in Stage 5 is a second intercooler 300.

As shown in FIG. 34, the preferred location of the dual channel air inlet 340/intercooler 300/intercooler 300/air outlet 360 assembly in the Stage 5 configuration is the same as in the Stage 4 configuration (over the air intake manifold 710 of engine 700, between the cylinder banks of engine 700). In this preferred location, the dual channel air inlet 340/intercooler 300/intercooler 300/air outlet 360 assembly can be held in place by the same two brackets 381, 382 that were used in the Stage 3 configuration and the Stage 4 configuration, as shown in FIG. 34.

A two intercooler design that generally corresponds with the utilization of the two intercoolers 300 as disclosed herein is described in U.S. Provisional Application No. 62/687,461 entitled "Intercooler and Intercooler Systems," filed Jun. 20, 2018. The contents of U.S. Provisional Application No. 62/687,461 are hereby incorporated by reference as if fully set forth herein, including the aforementioned two intercooler design and components utilized in connection therewith, found for example at paragraphs 28-37, 45-60, 62-64, FIGS. 1A-1B, 3A-5A and 7 thereof, among others, of U.S. Provisional Application No. 62/687,461.

Stage 5 Reverse Installation

FIG. 34 depicts a Standard Installation of the Stage 5 configuration. However, in another embodiment, the Stage 5 configuration can be in a Reverse Installation. In particular, each turbo exhaust manifold 100 (together with its associated turbocharger 160, turbocharger exhaust circuit 175, any non-integral (i.e., additional and separate) components of Stage 4 turbocharger air circuit 390) and the dual channel air inlet 340 are rotated 180 degrees from the Standard Installation.

In a Reverse Installation, the crossover pipe assembly 190 passes across the front of engine 700 (closest to arrow 920). As in the case of a Reverse Installation of the Stage 2, Stage 3 and Stage 4 configurations, the exact shape of crossover pipe assembly 190 can differ in the Stage 5 configuration between the Reverse Installation and the Standard Installation On the other hand, air outlet 360 in accordance with the preferred embodiment utilizes the same orientation (air outlet pipe 361 toward the front of the engine, positioned over air intake elbow 6) in both a Standard Installation and a Reverse Installation. The preferred symmetric arrangement of the bolt pattern of intercooler flange assembly 310 and air inlet flange 350 permits installation of a single channel air inlet 320/intercooler 300/intercooler 300/air outlet 360 assembly in either a Standard Installation or a Reverse Installation without the need for employing different components for each.

Upgrading from a Stage 4 Configuration to a Stage 5 Configuration

Optionally, an engine having a Stage 5 configuration (in either a Standard Installation or a Reverse Installation) can be obtained by bolting a second intercooler 300 to a first intercooler 300 along their adjacent flange assemblies 310 between dual channel air inlet 340 and air outlet 360. Relative to the Stage 4 configuration, a longer air intake connector 5 is utilized in the Stage 5 configuration to accommodate the additional height resulting from addition of the second intercooler 300. The function of crossover pipe assembly 190 in the Stage 5 configuration is the same as in the Stage 4 configuration.

The foregoing detailed description is for illustration only and is not to be deemed as limiting the inventions, which are defined in the appended claims.

What is claimed is:

1. A system for configuring in different power stages an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows, comprising:

a Stage 1 package including:

a first exhaust manifold adapted to be secured to the first row of cylinders for receiving and collecting in a plenum exhaust gases from the first row of cylinders, the first exhaust manifold including a first exhaust gas discharge aperture for discharging exhaust gases, the first exhaust gas discharge aperture located at a first fixed spatial position when the first exhaust manifold is secured to the first row of cylinders, and first connecting means proximate the first exhaust gas aperture; and a second exhaust manifold adapted to be secured to the second row of cylinders for receiving and collecting in a plenum exhaust gases from the second row of cylinders, the second exhaust manifold including a second exhaust gas discharge aperture for discharging exhaust gases, the second exhaust gas discharge aperture located at a second fixed spatial position when the second exhaust manifold is secured to the first row of cylinders, and second connecting means proximate the second exhaust gas aperture; and a Stage 2 package including a first turbo exhaust manifold adapted to be secured to the first row of cylinders for receiving and collecting in a plenum exhaust gases at least from the first row of cylinders, the first turbo exhaust manifold including a first turbocharger connection aperture adapted for mounting a turbocharger and for delivering to the turbocharger exhaust gases from either the first row of cylinders or the first row of cylinders and the second row of cylinders, a first exhaust gas passage aperture and third connecting means proximate the first exhaust gas passage aperture, the first turbo exhaust manifold being dimensioned so that the first exhaust gas passage aperture is located at about the first fixed spatial position when the first turbo exhaust manifold is secured to the first row of cylinders in lieu of the first exhaust manifold; and a crossover pipe assembly having a second exhaust gas passage aperture and fourth connecting means proximate the second exhaust gas passage aperture, and a third exhaust gas passage aperture and fifth connecting means proximate the third exhaust gas passage aperture, where the fourth and fifth connecting means are each adapted for coupling to any two of the first, second and third connecting means.

2. The system of claim 1, further comprising a Stage 3 package including:

a first air inlet configured for receiving compressed air from a turbocharger mounted on the first turbo exhaust manifold and delivering the compressed air to an intercooler;

an air outlet for receiving compressed air from an intercooler and configured for delivering the compressed air to an intake manifold of the internal combustion engine;

a first intercooler for receipt of compressed air from the first air inlet and for delivering the compressed air to the air outlet; and the first intercooler, the first air inlet and the air outlet each having a symmetric flange adapted for mechanical joining of the first air inlet and the air outlet to the first intercooler.

3. The system of claim 2, further comprising a Stage 4 package including:

a second turbo exhaust manifold adapted to be secured to the second row of cylinders for receiving and collecting in a plenum exhaust gases from the second row of cylinders, the second turbo exhaust manifold including a second turbocharger connection aperture adapted for having mounted thereon a turbocharger and for delivering to the turbocharger exhaust gases from the second row of cylinders, a fourth exhaust gas passage aperture and sixth connecting means proximate the fourth exhaust gas passage aperture, the sixth connecting means adapted for coupling to any of the fourth and fifth connecting means of the crossover pipe assembly, the first turbo exhaust manifold being dimensioned so that the fourth exhaust gas passage aperture is located at about the second fixed spatial position when the second turbo exhaust manifold is secured to the second row of cylinders in lieu of the second exhaust manifold; and a second air inlet configured for receiving compressed air from a turbocharger mounted on the first turbo exhaust manifold and from a turbocharger mounted on the second turbo exhaust manifold, and for delivering the compressed air to an intercooler, the second air inlet including a flange adapted for mechanical joining of the second air inlet to the first intercooler.

4. An exhaust gas system for an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows, comprising:

a first exhaust manifold adapted for receiving exhaust gases from the first row of cylinders and having a first aperture, positioned at a distal end of a generally annular plenum of the first exhaust manifold, for the passage of exhaust gases;

a second exhaust manifold adapted for receiving exhaust gas from the second row of cylinders and having a second aperture, positioned at a distal end of a generally annular plenum of the second exhaust manifold, for the passage of exhaust gases between the first aperture and the second aperture, the second exhaust manifold additionally having a third aperture adapted for having mounted thereon a turbocharger thereon and for discharge of exhaust gases to a turbocharger mounted thereon; and a crossover pipe assembly defining a passageway for the passage of exhaust gases between the first exhaust manifold and the second exhaust manifold, the crossover pipe assembly having a fourth aperture at one end and a fifth aperture at a second end, the fourth aperture connected to the first aperture and the fifth aperture connected to the second aperture.

5. The system of interrelated parts of claim 4, further comprising a Stage 5 package including a second intercooler having a symmetric flange adapted for mechanical joining between the first intercooler and the second air inlet or the first intercooler and the air outlet.

6. The exhaust gas system of claim 4, wherein the first exhaust manifold has a first length, and the second exhaust manifold has a second length, and wherein the first length and the second length are each of a size that the crossover pipe assembly is proximate a first face of the internal combustion engine when the first exhaust manifold and the second exhaust manifold are mounted to the engine in a first orientation, and the crossover pipe assembly is proximate a second face of the internal combustion engine when the first exhaust manifold and the second exhaust manifold are mounted to the engine in a second orientation.

7. A propulsion system for an automotive vehicle comprising:

an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows;

a first exhaust manifold connected to a first row of cylinders and adapted for receiving exhaust gases therefrom, the first exhaust manifold having a first aperture, positioned at a distal end of a generally annular plenum of the first exhaust manifold, for the passage of exhaust gases;

a second exhaust manifold connected to the second row of cylinders and adapted for receiving exhaust gas therefrom, the second exhaust manifold having a second aperture, positioned at a distal end of a generally annular plenum of the second exhaust manifold, for the passage of exhaust gases between the first exhaust manifold and the second exhaust manifold, the second exhaust manifold additionally having a third aperture adapted for mounting a turbocharger thereon and for discharge of exhaust gases from the first and second exhaust manifolds to a turbocharger mounted thereon;

a crossover pipe assembly defining a passageway for the passage of exhaust gases between the first exhaust manifold and the second exhaust manifold, the crossover pipe assembly having a fourth aperture at one end and a fifth aperture at a second end, the fourth aperture connected to the first aperture and the fifth aperture connected to the second aperture, the crossover pipe assembly located proximate a perimeter face of the engine.

8. The propulsion system of claim 7, wherein the crossover pipe assembly is located proximate a face of the engine from which a driveshaft connection is made to a crankshaft of the engine.

9. The propulsion system of claim 7, wherein the crossover pipe assembly is located proximate a face of the engine having a belt-driven accessory.

10. A turbocharger system for an internal combustion engine having plural cylinders comprising:

an exhaust manifold adapted for receiving exhaust gas from at least two of the plural cylinders and having a aperture, positioned at a distal end of a generally annular plenum of the first exhaust manifold, for the passage of exhaust gases, an exhaust gas routing circuit comprising a turbocharger support column and a bypass pipe;

the turbocharger support column having a first end and a second end, the first end of the turbocharger support column joined to the generally annular plenum;

a turbocharger having an exhaust gas inlet and an exhaust gas outlet, the exhaust gas inlet being joined to the second end of the turbocharger support column;

the bypass pipe having a third end and a fourth end, the third end of the bypass pipe being joined to the turbocharger support column;

an exhaust bypass relief valve having a first bypass inlet and a bypass outlet, the bypass inlet of the exhaust bypass relief valve being joined to the fourth end of the bypass pipe; and a tee connector having a spent exhaust inlet, a second bypass inlet and a discharge outlet, the spent exhaust inlet being joined to the turbocharger exhaust gas outlet and the second bypass inlet being joined to the bypass outlet of the exhaust bypass relief valve.

11. A pair of exhaust manifolds for an internal combustion piston engine having a front and a rear, and comprising a crankshaft having a centerline, a first row of at least two cylinders inclined relative to a first vertical plane containing the crankshaft centerline, the first row of cylinders having discharge ports, a second row of at least two cylinders inclined relative to the first vertical plane, the second row of cylinders having discharge ports, the two rows of cylinders forming a V configuration with the first vertical plane being approximately equidistant between the two rows and being approximately perpendicular to a first horizontal plane containing the crankshaft centerline, the discharge ports of the first row of cylinders being offset an offset distance relative to the front or the rear of the respective discharge ports of the second set of cylinders, the pair of exhaust manifolds comprising:

(1) a first exhaust manifold adapted to be joined to the discharge ports of the first row of cylinders of the engine, the first exhaust manifold including (a) a first set of plural exhaust stack assemblies adapted for joining to the discharge ports of the first row of cylinders to receive exhaust gases from the first row of cylinders; (b) a first manifold plenum joined to the first set of plural exhaust stack assemblies and having a terminal portion defining a first exhaust gas passageway and a forward end distal from the terminal portion, the distance between the terminal portion and the forward end defining a first length; (c) each exhaust stack assembly of the first set plural exhaust stack assemblies comprising a leader pipe and an exhaust connector, wherein (i) a first end of each leader pipe is joined to a first end of the exhaust connector of the exhaust stack assembly, (ii) a second end of each exhaust connector is joined to the first manifold plenum, (iii) a second end of each leader pipe terminates in means for joining the leader pipe to the internal combustion engine to receive exhaust gases from the engine, (iv) each leader pipe is oriented at a first angle in a second vertical plane orthogonal to the crankshaft centerline so that the plural exhaust stack assemblies are approximately located in a second horizontal plane when joined to the internal combustion piston engine, and (v) each leader pipe is oriented at a second angle in the second horizontal plane inclined toward the first exhaust gas passageway; (d) a first exhaust stack assembly of the first set of plural exhaust stack assemblies of the first exhaust manifold having a second length and joined to the first manifold plenum at the forward end; and (e) the first and second lengths defining the overall length of the first exhaust manifold;

(2) a second exhaust manifold adapted to be joined to the discharge ports of the second row of cylinders of the engine, the second exhaust manifold including (a) a second set of plural exhaust stack assemblies adapted for joining to the discharge ports of the second row of cylinders to receive exhaust gases from the second row of cylinders; (b) a second manifold plenum joined to the second set of plural exhaust stack assemblies and having a terminal portion defining a second exhaust gas passageway and a forward end distal from the terminal portion, the distance between the terminal portion and the forward end defining a third length; (c) each exhaust stack assembly of the second set plural exhaust stack assemblies comprising a leader pipe and an exhaust connector, wherein (i) a first end of each leader pipe is joined to a first end of the exhaust connector of the exhaust stack assembly, (ii) a second end of each exhaust connector is joined to the first manifold plenum, (iii) a second end of each leader pipe terminates in means for joining the leader pipe to the internal combustion engine to receive exhaust gases from the engine, (iv) each leader pipe is oriented at the first angle in the second vertical plane orthogonal to the crankshaft centerline so that the plural exhaust stack assemblies are approximately located in the second horizontal plane when joined to the internal combustion piston engine, and (v) each leader pipe is oriented at the second angle in the second horizontal plane inclined toward the second exhaust gas passageway; (c) a second exhaust stack assembly of the second set of plural exhaust stack assemblies of the second exhaust manifold has a fourth length and is joined to the second manifold plenum at the forward end; and (d) the third and fourth lengths defining the overall length of the second exhaust manifold; and (3) one or more of the first, second, third and fourth lengths being adjusted in dimension so that the terminal portion of the manifold plenum of the first exhaust manifold and the terminal portion of the manifold plenum of the second exhaust manifold are located approximately on a third vertical plane orthogonal to the crankshaft centerline when the first and second manifolds are joined to the engine.

12. The pair of exhaust manifolds as in claim 11, wherein the first manifold plenum has a first passage centerline, the second manifold plenum has a second passage centerline, and the first exhaust manifold and the second exhaust manifold are configured so that the first and second passage centerlines are approximately equidistant from the first vertical plane when the first and second manifolds are joined to the engine.

13. The pair of exhaust manifolds as in claim 12, wherein the first exhaust manifold and the second exhaust manifold are configured so that the first and second passage centerlines are located approximately in a third horizontal plane when the first and second manifolds are joined to the discharge ports of the engine.

14. A set of exhaust manifolds for an internal combustion piston engine having a front and a rear, and comprising a crankshaft having a centerline, a first row of at least two cylinders inclined relative to a first vertical plane containing the crankshaft centerline, the first row of cylinders having discharge ports, a second row of at least two cylinders inclined relative to the first vertical plane, the second row of cylinders having discharge ports, the two rows of cylinders forming a V configuration with the first vertical plane being approximately equidistant between the two rows and being approximately perpendicular to a first horizontal plane containing the crankshaft centerline, the discharge ports of the first row of cylinders being offset an offset distance relative to the front or the rear of the respective discharge ports of the second set of cylinders, the pair of exhaust manifolds comprising:

(1) a first exhaust manifold adapted to be joined to the discharge ports of the first row of cylinders of the engine, the first exhaust manifold including (a) a first set of plural exhaust stack assemblies adapted for joining to the discharge ports of the first row of cylinders to receive exhaust gases from the first row of cylinders; (b) a first manifold plenum joined to the to the first set of plural exhaust stack assemblies and having a terminal portion defining a first exhaust gas passageway and a forward end distal from the terminal portion, the distance between the terminal portion and the forward end defining a first length; (c) each exhaust stack assembly of the first set plural exhaust stack assemblies comprising a leader pipe and an exhaust connector, wherein (i) a first end of each leader pipe is joined to a first end of the exhaust connector of the exhaust stack assembly, (ii) a second end of each exhaust connector is joined to the first manifold plenum, (iii) a second end of each leader pipe terminates in means for joining the leader pipe to the internal combustion engine to receive exhaust gases from the engine, (iv) each leader pipe is oriented at a first angle in a second vertical plane orthogonal to the crankshaft centerline so that the plural exhaust stack assemblies are approximately located in a second horizontal plane when joined to the internal combustion piston engine, and (v) each leader pipe is oriented at a second angle in the second horizontal plane inclined toward the first exhaust gas passageway; (d) a first exhaust stack assembly of the first set of plural exhaust stack assemblies of the first exhaust manifold having a second length and joined to the first manifold plenum at the forward end; and (e) the first and second lengths defining the overall length of the first exhaust manifold;

(2) a second exhaust manifold adapted to be joined to the discharge ports of the second row of cylinders of the engine, the second exhaust manifold including (a) a second set of plural exhaust stack assemblies adapted for joining to the discharge ports of the second row of cylinders to receive exhaust gases from the second row of cylinders; (b) a second manifold plenum joined to the second set of plural exhaust stack assemblies and having a terminal portion defining a second exhaust gas passageway and a forward end distal from the terminal portion, the distance between the terminal portion and the forward end defining a third length; (c) an exhaust gas routing circuit joined to the second manifold plenum, the exhaust gas routing circuit comprising a turbocharger support column and a bypass pipe, the turbocharger support column joined with the second manifold plenum and terminating in a first exhaust gas outlet adapted for receiving a turbocharger mounted thereon, and the bypass pipe joined with the support column and terminating in a second exhaust gas outlet adapted for connection to an exhaust bypass relief valve; (d) a second exhaust stack assembly of the second set of plural exhaust stack assemblies of the second exhaust manifold having a fourth length and joined to the second manifold plenum at the forward end; and (e) the third and fourth lengths defining the overall length of the second exhaust manifold; and (3) one or more of the first, second, third and fourth lengths being adjusted in dimension so that the terminal portion of the manifold plenum of the first exhaust manifold and the terminal portion of the manifold plenum of the second exhaust manifold are located approximately on a third vertical plane orthogonal to the crankshaft centerline when the first and second manifolds are joined to the engine.

15. The pair of exhaust manifolds as in claim 14, wherein the first manifold plenum has a first passage centerline, the second manifold plenum has a second passage centerline, and the first exhaust manifold and the second exhaust manifold are configured so that the first and second passage centerlines are approximately equidistant from the first vertical plane when the first and second manifolds are joined to the engine.

16. The pair of exhaust manifolds as in claim 15, wherein the first exhaust manifold and the second exhaust manifold are configured so that the first and second passage centerlines are located approximately in a third horizontal plane when the first and second manifolds are joined to the discharge ports of the engine.

* * * * *